US010094562B2

(12) United States Patent
Borschke et al.

(10) Patent No.: US 10,094,562 B2
(45) Date of Patent: Oct. 9, 2018

(54) IGNITER APPARATUS FOR A SMOKING ARTICLE, AND ASSOCIATED METHOD

(71) Applicant: R. J. REYNOLDS TOBACCO COMPANY, Winston-Salem, NC (US)

(72) Inventors: August Joseph Borschke, Winston-Salem, NC (US); Michael Francis Dube, Winston-Salem, NC (US); Cynthia Stewart Stokes, Lexington, NC (US); Jason Eugene Kobisky, Winston-Salem, NC (US); Bruce Alan Bengtsson, Winston-Salem, NC (US); Dennis L. Potter, Kernersville, NC (US); Jeffrey S. Taggart, Cleveland Heights, OH (US); Geoffrey W. Kennard, Chardon, OH (US); Robert F. Soreo, Cleveland Heights, OH (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1022 days.

(21) Appl. No.: 14/178,081

(22) Filed: Feb. 11, 2014

(65) Prior Publication Data

US 2015/0226432 A1 Aug. 13, 2015

(51) Int. Cl.

| | |
|---|---|
| ***F23Q 2/32*** | (2006.01) |
| ***F23Q 13/04*** | (2006.01) |
| ***F23Q 2/34*** | (2006.01) |

(52) U.S. Cl.

CPC ..... *F23Q 13/04* (2013.01); *F23Q 2/345* (2013.01)

(58) Field of Classification Search

CPC ..... F23Q 2/345
USPC ..... 431/253, 126
See application file for complete search history.

(56) References Cited

U.S. PATENT DOCUMENTS

| | | | | |
|---|---|---|---|---|
| 2,032,695 A | | 3/1936 | Gimera et al. | |
| 2,510,449 A | * | 6/1950 | Williams | F23Q 2/345 422/125 |
| 2,521,630 A | * | 9/1950 | Florman | F23Q 2/32 422/293 |
| 2,737,037 A | | 3/1956 | Zellweger | |

(Continued)

FOREIGN PATENT DOCUMENTS

| | | |
|---|---|---|
| EP | 1 808 087 | 7/2007 |
| EP | 2 550 879 | 1/2013 |

(Continued)

*Primary Examiner* — Avinash Savani
*Assistant Examiner* — Deepak Deean
(74) *Attorney, Agent, or Firm* — Womble Bond Dickinson (US) LLP

(57) ABSTRACT

An igniter apparatus is provided, comprising a heat precursor source having a heat precursor; a heating arrangement configured to, on demand, receive the heat precursor from the heat precursor source and to emit heat associated with the heat precursor and capable of igniting an ignitable article; and a sensory precursor source having a sensory precursor substance, wherein the sensory precursor substance is configured to provide a perceptible sensory effect, and wherein the sensory precursor source is in communication with the heating arrangement and is configured to release the sensory precursor substance in association with the heat emitted by the heating arrangement. An associated method is also provided.

14 Claims, 33 Drawing Sheets

(56) References Cited

U.S. PATENT DOCUMENTS

| | | | | | |
|---|---|---|---|---|---|
| 3,355,913 | A | * | 12/1967 | Frangos | F23D 91/02 126/350.1 |
| 3,416,709 | A | * | 12/1968 | Shultz | B01F 5/0256 222/145.6 |
| 3,551,092 | A | | 12/1970 | Masson | |
| 3,756,766 | A | | 9/1973 | Green | |
| 3,766,946 | A | | 10/1973 | Corarg | |
| 3,829,737 | A | | 8/1974 | Johnsson | |
| 4,222,734 | A | | 9/1980 | Nolf | |
| 4,487,570 | A | | 12/1984 | Lowenthal | |
| 4,583,939 | A | * | 4/1986 | Brickwedde | F23Q 2/32 431/253 |
| 4,692,590 | A | | 9/1987 | Spector | |
| 4,895,511 | A | * | 1/1990 | Schmid | F23Q 2/161 422/126 |
| 4,954,077 | A | | 9/1990 | Tamura | |
| 5,059,852 | A | | 10/1991 | Meury | |
| 5,308,240 | A | | 5/1994 | Lowenthal | |
| 5,649,554 | A | | 7/1997 | Sprinkel et al. | |
| 5,848,596 | A | | 12/1998 | Zelenik | |
| 6,056,539 | A | * | 5/2000 | Carlson | F23Q 2/32 431/253 |
| 6,478,575 | B2 | | 11/2002 | Sher | |
| 6,503,459 | B1 | * | 1/2003 | Leonard | A01M 1/2088 422/120 |
| 6,632,082 | B1 | | 10/2003 | Smith | |
| 6,676,405 | B2 | | 1/2004 | Sewalt | |
| 6,726,470 | B1 | | 4/2004 | Meister | |
| 6,902,392 | B2 | | 6/2005 | Johnson | |
| 7,479,098 | B2 | | 1/2009 | Thomas et al. | |
| 7,753,056 | B2 | | 7/2010 | Borschke et al. | |
| 7,836,897 | B2 | | 11/2010 | Borschke et al. | |
| 7,946,293 | B2 | | 5/2011 | Gerardi | |
| 8,464,726 | B2 | | 6/2013 | Sebastian et al. | |
| 8,469,035 | B2 | | 6/2013 | Banerjee et al. | |
| 8,616,217 | B2 | | 12/2013 | Tsurizumi et al. | |
| 2007/0215167 | A1 | | 9/2007 | Llewellyn Crooks et al. | |
| 2010/0221207 | A1 | | 9/2010 | Watkins et al. | |
| 2012/0042885 | A1 | | 2/2012 | Stone et al. | |
| 2012/0091218 | A1 | | 4/2012 | Mikkelsen et al. | |
| 2012/0315588 | A1 | | 12/2012 | Kondrat | |
| 2013/0133675 | A1 | | 5/2013 | Shinozaki et al. | |
| 2013/0146075 | A1 | | 6/2013 | Poget et al. | |
| 2013/0157922 | A1 | | 6/2013 | Mikkelsen et al. | |
| 2013/0202788 | A1 | | 8/2013 | Mikkelsen et al. | |
| 2014/0026904 | A1 | | 1/2014 | Monty et al. | |

FOREIGN PATENT DOCUMENTS

| | | | | | |
|---|---|---|---|---|---|
| FR | 2690976 | A1 | * | 11/1993 | F23Q 2/163 |
| JP | H05 45451 | U | | 6/1993 | |
| WO | WO 2006082029 | A2 | * | 8/2006 | F21K 5/00 |
| WO | WO 2012/164077 | | | 12/2012 | |
| WO | WO 2013/098380 | | | 7/2013 | |
| WO | WO 2013/098405 | | | 7/2013 | |
| WO | WO 2013/098410 | | | 7/2013 | |
| WO | WO 2013/104914 | | | 7/2013 | |
| WO | WO 2013/120849 | | | 8/2013 | |
| WO | WO 2013/120854 | | | 8/2013 | |

* cited by examiner

IGNITER APPARATUS FOR A SMOKING ARTICLE, AND ASSOCIATED METHOD

BACKGROUND OF THE DISCLOSURE

Field of the Disclosure

The present disclosure relates to products made or derived from tobacco, or that otherwise incorporate tobacco, and are intended for human consumption; and more particularly, to an igniter apparatus and method for components and configurations of such smoking articles.

Disclosure of Related Art

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999); which is incorporated herein by reference. A traditional type of cigarettes is employed by a smoker by lighting one end thereof and burning the tobacco rod. The smoker then receives mainstream smoke into his/her mouth by drawing on the opposite end (e.g., the filter end or mouth end) of the cigarette. Through the years, efforts have been made to improve upon the components, construction and performance of smoking articles. See, for example, the background art, and cigarette components and technology, discussed in U.S. Pat. No. 7,479,098 to Thomas et al. and U.S. Pat. No. 7,753,056, both to Borschke et al.; which are incorporated herein by reference.

Certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette recently has been marketed in Japan by Japan Tobacco Inc. under the brand name "Steam Hot One." Furthermore, various types of smoking products incorporating carbonaceous fuel elements for heat generation and aerosol formation recently have been set forth in the patent literature. See, for example, the types of smoking products proposed in U.S. Pat. No. 7,836,897 to Borschke et al.; U.S. Pat. No. 8,469,035 to Banerjee et al. and U.S. Pat. No. 8,464,726 to Sebastian et al.; US Pat. Pub. Nos. 2012/0042885 to Stone et al.; 2013/0019888 to Tsuruizumi et al; 2013/0133675 to Shinozaki et al. and 2013/0146075 to Poget et al.; PCT WO Nos. 2012/0164077 to Gladden et al.; 2013/098380 to Raether et al.; 2013/098405 to Zuber et al.; 2013/098410 to Zuber et al.; 2013/104914 to Woodcock; 2013/120849 to Roudier et al.; 2013/120854 to Mironov; EP 1808087 to Baba et al. and EP 2550879 to Tsuruizumi et al.; which are incorporated by reference herein in their entirety. A historical perspective of technology related to various types of smoking products incorporating carbonaceous fuel elements for heat generation and aerosol formation may be found, for example, in the background are discussed in US Pat. Pub. No. 2007/0215167 to Llewellyn Crooks et al., which is also incorporated herein by reference.

It would be highly desirable to provide a manner or method for lighting or otherwise lighting smoking articles that are intended to burn tobacco to produce smoke, or that are otherwise intended to produce aerosol as a result of ignition of a combustible fuel element or source. In particular, it would be desirable to enhance the lighting experience of a smoker of a smoking article. For example, it would be desirable provide a manner or method for efficiently and effectively introducing enhanced sensory or other perceptible effects for a smoker to experience upon ignition of a smoking article for use, as well as during the period that the smoking article is smoked.

BRIEF SUMMARY OF THE DISCLOSURE

The above and other needs are met by aspects of the present disclosure which, in one aspect, provides an igniter apparatus, comprising a heat precursor source having a heat precursor; a heating arrangement configured to, on demand, receive the heat precursor from the heat precursor source and to emit heat associated with the heat precursor and capable of igniting an ignitable article; and a sensory precursor source having a sensory precursor substance, wherein the sensory precursor substance is configured to provide a perceptible sensory effect, and wherein the sensory precursor source is in communication with the heating arrangement and is configured to release the sensory precursor substance in association with the heat emitted by the heating arrangement.

Another aspect of the present disclosure provides an ignition method, comprising providing, on demand, a heat precursor from a heat precursor source; emitting heat associated with the heat precursor and capable of igniting an ignitable article from a heating arrangement configured to receive the heat precursor from the heat precursor source; and providing a perceptible sensory effect associated with a sensory precursor substance from a sensory precursor source in communication with the heating arrangement, wherein the heating arrangement is configured to release the sensory precursor substance in association with the heat emitted thereby.

Embodiments of the present disclosure thus relate to igniter apparatuses and ignition methods for smoking articles, and in particular, for rod-shaped smoking articles, such as cigarettes, wherein the smoking article includes a lighting end (i.e., an upstream end) and a mouth end (i.e., a downstream end). The smoking article may also include an aerosol-generation system that includes (i) a heat generation segment, and (ii) an aerosol-generating region or segment located downstream from the heat generation segment. The heat generation segment may be formed or extruded from carbonaceous materials, in order to produce heat when lit; and hence, provide heat for the physically separate aerosol-generating region for aerosol generation.

In a general aspect, embodiments of the present disclosure may broadly implement apparatuses and methods involving a discrete device such as an igniter apparatus, external to the smoking article, being configured to deliver one or more elements or components (wherein one or more such elements or components may be exogenous to the smoking article) of a sensory or perceptive arrangement to the smoking article, so as to facilitate delivery of the sensory or perceptive arrangement or effect associated therewith via the smoking article to the user thereof. Generally, the sensory or perceptive arrangement or effect associated therewith delivered to the user via the smoking article is desirably prominent during the initial (i.e., lighting) puffs of the smoking article, though in other aspects, the sensory or perceptive arrangement or effect associated therewith may desirably be provided to the user following the initial puffs up to exhaustion of the consumption of the smoking article. In other general aspects, the sensory or perceptive arrangement or effect associated therewith delivered or provided to the user via the smoking article may be selected to complement the smoke produced by lighting the smoking article and/or throughout the smoking process, to facilitate the enjoyment of the smoking article by the user, to increase the satisfaction of the user in consuming the smoking article, and/or to otherwise enhance the user experience with the smoking article.

Further features and advantages of the present disclosure are set forth in more detail in the following description.

BRIEF DESCRIPTION OF THE DRAWINGS

Figure 1:
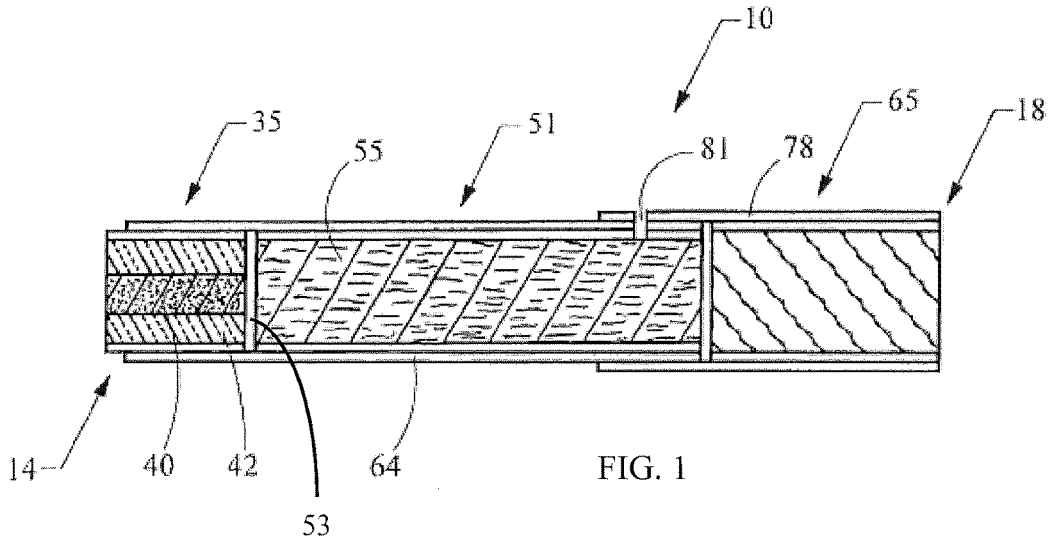
Figure 2:
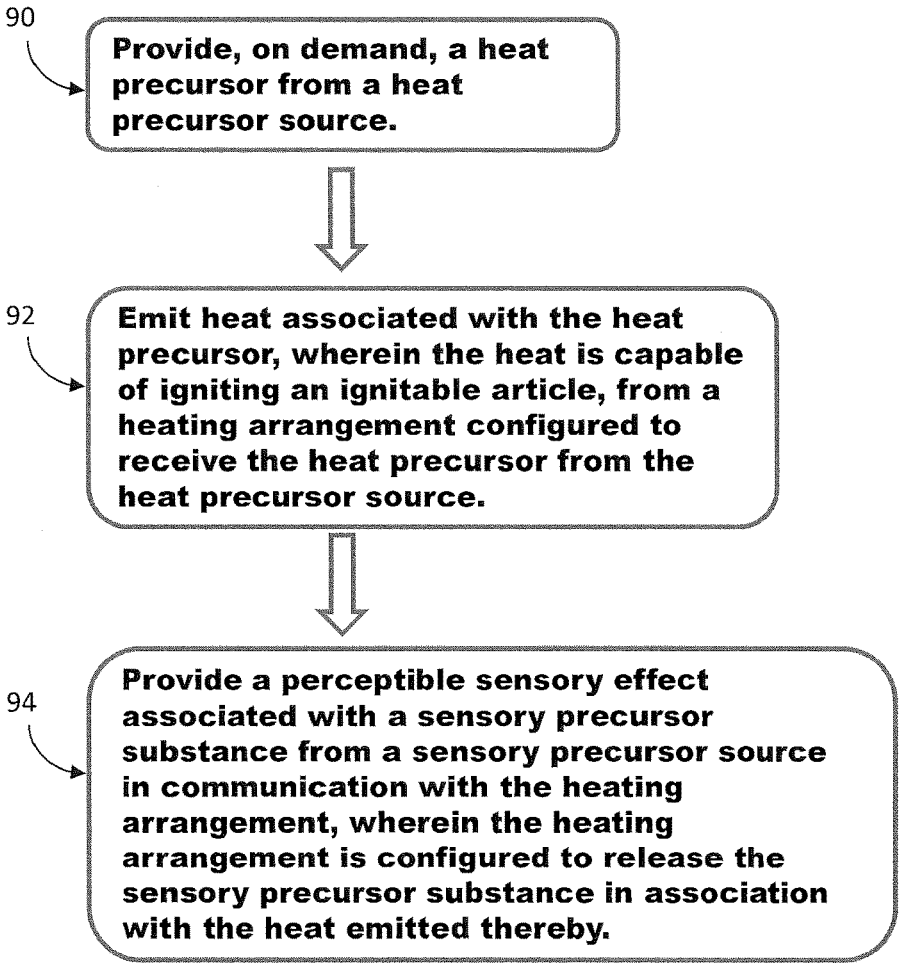
Figure 31:
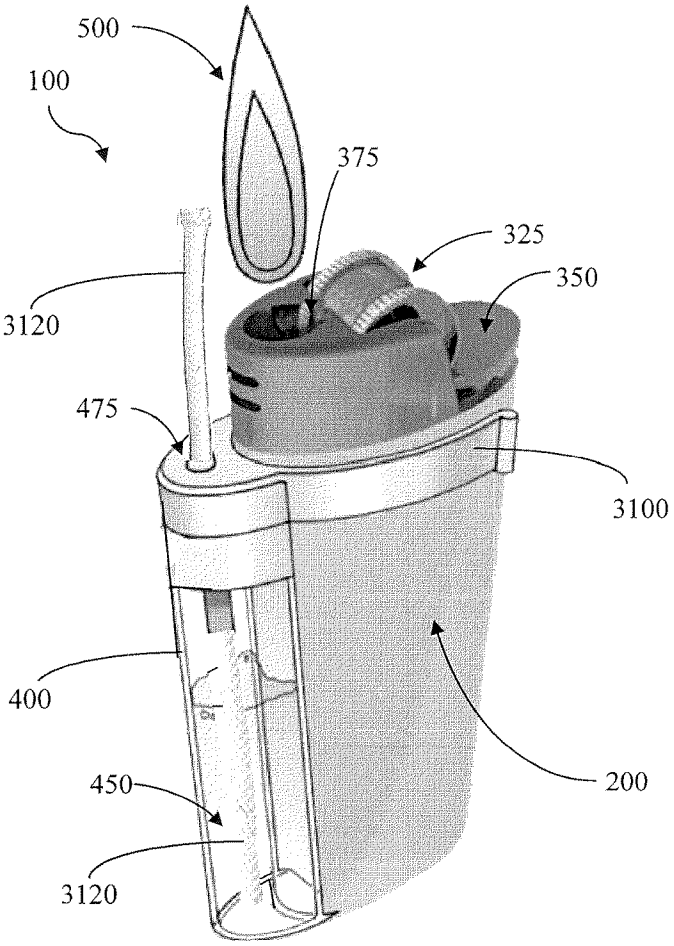
Figure 32:
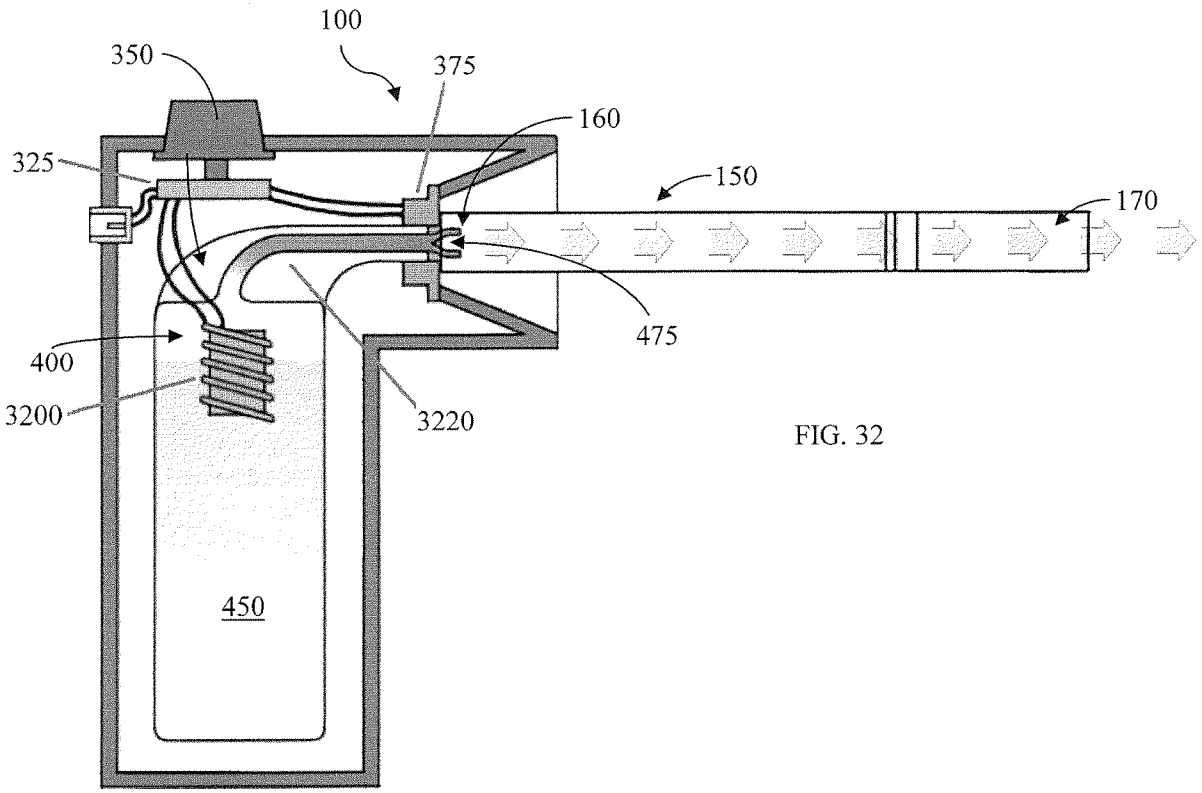
Figure 33:
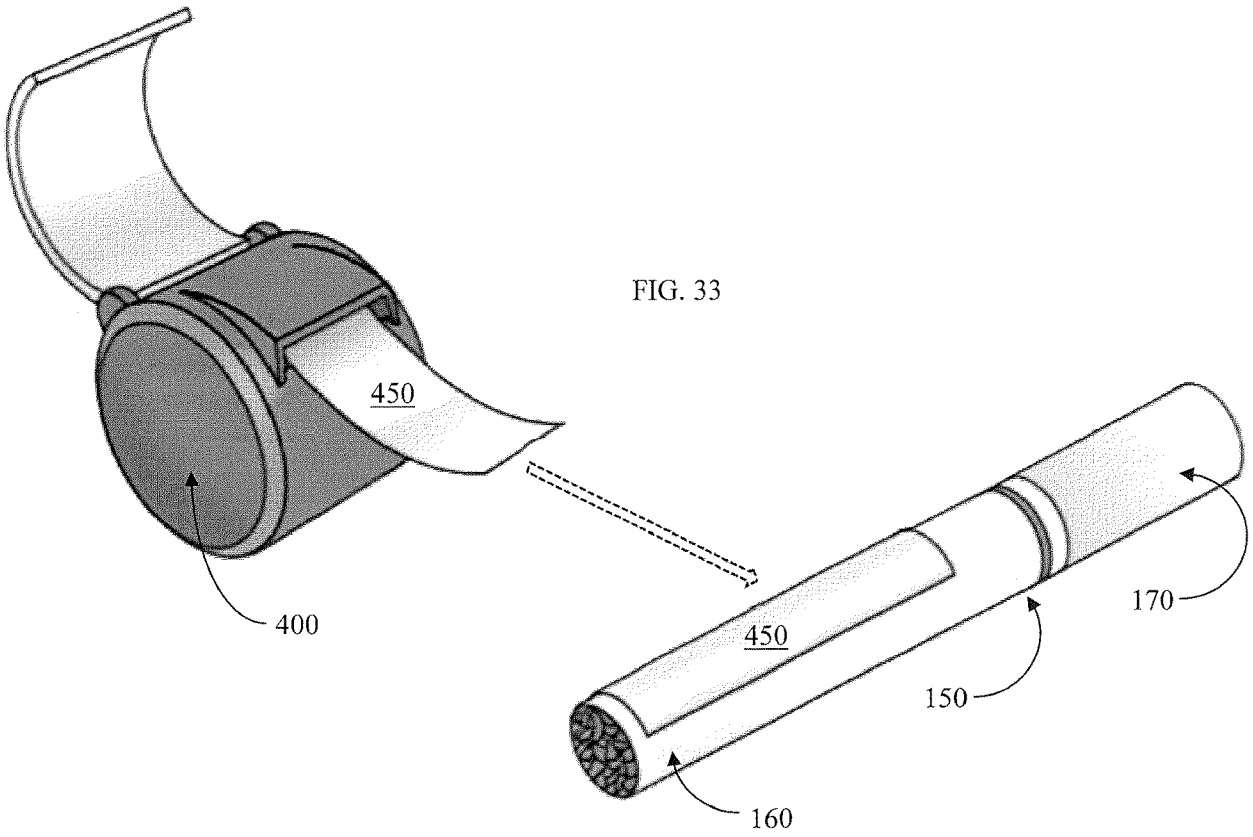

Having thus described the disclosure in general terms, reference will now be made to the accompanying drawings, which are not necessarily drawn to scale, and wherein:

FIG. 1 schematically illustrates a longitudinal cross-sectional view of a representative smoking article;

FIG. 2 schematically illustrates an ignition method, according to one aspect of the present disclosure;

FIGS. 3-30 each schematically illustrate various arrangements of an igniter apparatus incorporating a sensory precursor delivery arrangement for a smoking article, according to various aspects of the present disclosure;

FIGS. 31 and 32 schematically illustrate alternate arrangements of an igniter apparatus incorporating a sensory precursor delivery arrangement for a smoking article, according to other aspects of the present disclosure; and FIG. 33 schematically illustrates an alternate sensory precursor delivery arrangement for a smoking article, according to another aspect of the present disclosure.

DETAILED DESCRIPTION OF THE PREFERRED EMBODIMENTS

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

Aspects and embodiments of the present disclosure may relate, for example, to apparatuses and methods involving a discrete device such as an igniter apparatus, external to the smoking article, configured to deliver one or more elements or components of a sensory or perceptive arrangement to the smoking article, so as to facilitate delivery of the sensory or perceptive arrangement or effect associated therewith via the smoking article to the user thereof. Accordingly, such aspects may relate to or otherwise involve various smoking articles, and the arrangement of various components thereof, in such an arrangement as to be responsive to or otherwise facilitate the delivery of the one or more elements or components from the discrete device to the smoking article, and delivery of the sensory or perceptive arrangement or effect associated therewith at least partially through the smoking article to the smoker. See, for example, the types of smoking articles discussed in the background art and referenced in U.S. patent application Ser. No. 14/098,137 to Ademe et al., which is incorporated herein by reference.

FIG. 1 illustrates a representative smoking article 10 in the form of a cigarette. The smoking article 10 has a rod-like shape, and includes a lighting end 14 and a mouth end 18. At the lighting end 14 is positioned a longitudinally-extending, generally cylindrical, heat generation segment 35. The heat generation segment 35 includes a heat source 40 circumscribed by insulation 42, which may be coaxially encircled by wrapping material 45. The heat source 40 preferably is configured to be activated by direct ignition of the lighting end 14. The smoking article 10 also includes a filter segment 65 located at the other end (mouth end 18), and an aerosol-generating segment 51 (which may incorporate tobacco) that is located in between those two segments.

The heat source 40 may include a combustible fuel element that has a generally cylindrical shape and can incorporate a combustible carbonaceous material. Such combustible carbonaceous materials generally have high carbon content. Preferred carbonaceous materials may be comprised predominantly of carbon, typically have carbon contents of greater than about 60 percent, generally greater than about 70 percent, often greater than about 80 percent, and frequently greater than about 90 percent, on a dry weight basis. Such combustible fuel elements can incorporate components other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). A representative fuel element, for example, has a length of about 12 mm and an overall outside diameter of about 4.2 mm. A representative fuel element can be extruded or compounded using a ground or powdered carbonaceous material, and has a density that is greater than about 0.5 $g/cm^3$, often greater than about 0.7 $g/cm^3$, and frequently greater than about 1 $g/cm^3$, on a dry weight basis. See, for example, the types of fuel element components, formulations and designs set forth and referenced in U.S. Pat. No. 5,551,451 to Riggs et al.; U.S. Pat. No. 7,836,897 to Borschke et al., and U.S. Pat. No. 5,461,879 to Barnes et al.; and US Pat. Pub. Nos. 2007/0215167 to Llewellyn Crooks et al. and 2007/0215168 to Banerjee et al. and U.S. patent application Ser. No. 14/098,137 to Ademe et al.; which are incorporated herein by reference in their entirety. Still other embodiments of fuel elements may include those of the types described in U.S. Pat. No. 4,819,655 to Roberts et al. or U.S. Pat. App. Pub. No. 2009/0044818 to Takeuchi et al., each of which is incorporated herein by reference.

The fuel element preferably is circumscribed or otherwise jacketed by insulation 42, or other suitable material. A representative layer of insulation 42 can comprise glass filaments or fibers. The insulation 42 can act as a jacket that assists in maintaining the heat source 40 firmly in place within the smoking article 10. The insulation preferably is configured such that drawn air and aerosol can pass readily therethrough. The insulation 42 can be provided as a multi-layer component including an inner layer or mat 47 of non-woven glass filaments, an intermediate layer of reconstituted tobacco paper, and an outer layer of non-woven glass filaments. These may be concentrically oriented or each overwrapping and/or circumscribing the heat source. Various other insulation embodiments may be molded, extruded, foamed, or otherwise formed. Examples of insulation materials, components of insulation assemblies, configurations of representative insulation assemblies within heat generation segments, wrapping materials for insulation assemblies, and manners and methods for producing those components and assemblies, are set forth and referenced in U.S. Pat. App. Pub. No. 2012/0042885 to Stone et al. and U.S. patent application Ser. No. 14/098,137 to Ademe et al., which is incorporated herein by reference. Insulation assemblies have been incorporated within the types of cigarettes commercially marketed under the trade names "Premier" and "Eclipse" by R. J. Reynolds Tobacco Company, and as "Steam Hot One" cigarette marketed by Japan Tobacco Inc.

Preferably, both ends of the heat generation segment 35 are open to expose at least the heat source 40 and insulation 42 at the lighting end 14. The heat source 40 and the surrounding insulation 42 can be configured so that the length of both materials is co-extensive (i.e., the ends of the insulation 42 are flush with the respective ends of the heat source 40, and particularly at the downstream end of the heat generation segment). Optionally, though not necessarily preferably, the insulation 42 may extend slightly beyond (e.g., from about 0.5 mm to about 2 mm beyond) either or both ends of the heat source 40. Moreover, heat and/or heated air produced when the lighting end 14 is ignited during use of the smoking article 10 can readily pass through the heat generation segment 35 during draw by the smoker on the mouth end 18.

The heat generation segment 35 preferably is positioned with one end disposed at the lighting end 14, and is axially aligned in an end-to-end relationship with a downstream aerosol-generating segment 51. The close proximity of the heat generation segment 35 to the lighting end 14 provides for direct ignition of the heat source/fuel element 40 of the heat generation segment 35. The aerosol-generating segment 51 typically includes a substrate material 55 that, in turn, acts as a carrier for an aerosol-forming agent or material (not shown). For example, the aerosol-generating segment 51 can include a reconstituted tobacco material that includes processing aids, flavoring agents, and glycerin. The foregoing components of the aerosol-generating segment 51 can be disposed within, and circumscribed by, a wrapping material. The wrapping material can be configured to facilitate the transfer of heat from the lighting end 14 of the smoking article 10 (e.g., from the heat generation segment 35) to components of the aerosol-generating segment 51. That is, the aerosol-generating segment 51 and the heat generation segment 35 are configured in a heat exchange relationship with one another. The heat exchange relationship is such that sufficient heat from the heat source 40 is supplied to the aerosol-formation region to volatilize aerosol-forming material for aerosol formation. In some embodiments, the heat exchange relationship is achieved by positioning those physically separate segments in close proximity to one another. A heat exchange relationship also can be achieved by extending a heat conductive material from the vicinity of the heat source 40 into or around the region occupied by the aerosol-generating segment 51.

A representative wrapping material for the substrate material 55 may include heat conductive properties to conduct heat from the heat generation segment 35 to the aerosol-generating segment 51, in order to provide for the volatilization of the aerosol forming components contained therein. The substrate material 55 may be about 10 mm to about 22 mm in length, with certain embodiments being about 11 mm up to about 21 mm. The substrate material 55 can be provided from a blend of flavorful and aromatic tobaccos in cut filler form. Those tobaccos, in turn, can be treated with aerosol-forming material and/or at least one flavoring agent. The substrate material can be provided from a processed tobacco (e.g., a reconstituted tobacco manufactured using cast sheet or papermaking types of processes) in cut filler form. Certain cast sheet constructions may include about 270 to about 300 mg of tobacco per 10 mm of linear length. That tobacco, in turn, can be treated with, or processed to incorporate, aerosol-forming material and/or at least one flavoring agent, as well as a burn retardant (e.g., diammonium phosphate or another salt) configured to help prevent ignition and/or scorching by the heat-generation segment. A metal inner surface of the wrapping material of the aerosol-generating segment 51 can act as a carrier for aerosol-forming material and/or at least one flavoring agent. In other embodiments, the substrate 55 may include a tobacco paper or non-tobacco gathered paper formed as a plug section. The plug section may be loaded with aerosol-forming materials, flavorants, tobacco extracts, or the like in a variety of forms (e.g., microencapsulated, liquid, powdered). A burn retardant (e.g., diammonium phosphate or another salt) may be applied to at least a distal/lighting-end portion of the substrate to help prevent ignition and/or scorching by the heat-generation segment. In these and/or other embodiments, the substrate 55 may include pellets or beads formed from marumarized and/or non-marumarized tobacco. Marumarized tobacco is known, for example, from U.S. Pat. No. 5,105,831 to Banerjee, et al., which is incorporated herein by reference. See also, those types of substrates set forth in and referenced in U.S. patent application Ser. No. 14/098,137 to Ademe et al. and U.S. Pat. App. Pub. Nos. 2004/0173229 to Crooks et al., 2011/0271971 to Conner et al. and 2012/0042885 to Stone et al. which are incorporated herein by reference. Preferably, both ends of the aerosol-generating segment 51 are open to expose the substrate material 55 thereof.

Together, the heat generating segment 35 and the aerosol-generating segment 51 form an aerosol-generation system. The aerosol-generating segment 51 is positioned adjacent to the downstream end of the heat generation segment 35 such that those segments 51, 35 are axially aligned in an end-to-end relationship. Those segments can abut one another, or be positioned in a slightly spaced apart relationship, which may include a buffer region 53. The outer cross-sectional shapes and dimensions of those segments, when viewed transversely to the longitudinal axis of the smoking article 10, can be essentially identical to one another. The physical arrangement of those components preferably is such that heat is transferred (e.g., by means that includes conductive and convective heat transfer) from the heat source 40 to the adjacent substrate material 55, throughout the time that the heat source is activated (e.g., burned) during use of the smoking article 10.

A buffer region 53 may reduce potential scorching or other thermal degradation of portions of the aerosol-generating segment 51. The buffer region 53 may mainly include empty air space, or it may be partially or substantially completely filled with a non-combustible material such as, for example, metal, organic, inorganic, ceramic, or polymeric materials, or any combination thereof. The buffer regions may be from about 1 mm to about 10 mm or more in thickness (length), but often will be about 2 mm to about 5 mm in thickness (length).

The components of the aerosol-generation system preferably are attached to one another, and secured in place using an overwrap material 64. For example, the overwrap material 64 can include a paper wrapping material or a laminated paper-type material that circumscribes each of the heat generation segment 35, and at least a portion of outer longitudinally extending surface of the aerosol-generating segment 51. The inner surface of the overwrap material 64 may be secured to the outer surfaces of the components it circumscribes by a suitable adhesive.

The smoking article 10 preferably includes a suitable mouthpiece such as, for example, a filter element 65, positioned at the mouth end 18 thereof. The filter element 65 preferably is positioned at one end of the cigarette rod adjacent to one end of the aerosol-generating segment 51, such that the filter element 65 and the aerosol-generating segment 51 are axially aligned in an end-to-end relationship, abutting one another but without any barrier therebetween. Preferably, the general cross-sectional shapes and dimensions of those segments 51, 65 are essentially identical to one another when viewed transversely to the longitudinal axis of the smoking article. The filter element 65 may include filter material 70 that is overwrapped along the longitudinally extending surface thereof with circumscribing plug wrap material. In one example, the filter material 70 includes plasticized cellulose acetate tow, while in some examples the filter material may further include activated charcoal in an amount from about 20 to about 80 mg disposed as a discrete charge or dispersed throughout the acetate tow in a "Dalmatian type" filter. Both ends of the filter element 65 preferably are open to permit the passage of aerosol therethrough. The aerosol-generating system preferably is attached to the filter element 65 using tipping material 78. The smoking article optionally can be air-diluted by providing appropriate perforations 81 in the vicinity of the mouth end region 18, as is known in the art. Filters may include materials and may be manufactured by methods such as, for example, those disclosed and referenced in U.S. patent application Ser. No. 14/098,137 to Ademe et al., which is incorporated herein by reference.

The aerosol-forming materials can vary, and mixtures of various aerosol-forming materials can be used, as can various combinations and varieties of flavoring agents (including various materials that alter the sensory and/or organoleptic character or nature of mainstream aerosol of a smoking article), wrapping materials, mouth-end pieces, filter elements, plug wrap, and tipping material. Representative types of these components are set forth in and referenced in U.S. patent application Ser. No. 14/098,137 to Ademe et al. and U.S. Pat. App. Pub. No. 2007/0215167 to Llewellyn Crooks, et al., which are incorporated herein by reference.

Cigarettes described with reference to FIG. 1 may be used in much the same manner as those cigarettes commercially marketed under the trade names "Premier" and "Eclipse" by R. J. Reynolds Tobacco Company and "Steam Hot One" by Japan Tobacco Inc. That is, during use in accordance with the present invention, the smoker lights the lighting end 14 of the smoking article 10 using that type of igniter apparatus that is described in greater detail hereinafter, in a manner similar to the way that conventional smoking articles are lit, such that the fuel element 40 at the lighting end 14 is ignited. The mouth end 18 of the smoking article 10 is placed in the lips of the smoker. Aerosol generated by the aerosol generation system is drawn through the smoking article 10, through the filter element 65, and into the mouth of the smoker. That is, when smoked, the smoking article yields visible mainstream aerosol that resembles the mainstream tobacco smoke of traditional cigarettes that burn tobacco cut filler.

Aspects and embodiments of the present disclosure thus acknowledge that smoking article of the types disclosed herein may include or do include many different components or elements. In some instances, as also disclosed herein, it is evident that two or more components may interact to form the desired function or provide the desired effect. Moreover, in some aspects, a component or combination of components may be, for example, actuated by exposure to heat to form the desired function or provide the desired effect. As such, certain aspects of the present disclosure generally relate, for example, to apparatuses and methods involving a discrete device such as an igniter apparatus, external to the smoking article, configured to deliver one or more elements or components (wherein one or more such elements or components may be exogenous to the smoking article) of a sensory or perceptive arrangement to the smoking article, so as to facilitate delivery of the sensory or perceptive arrangement or effect associated therewith via the smoking article to the user thereof. Accordingly, such aspects may relate to or otherwise involve various smoking articles, and the arrangement of various components thereof, in such an arrangement as to be responsive to or otherwise facilitate the delivery of the one or more elements or components from the discrete device to the smoking article, and delivery of the sensory or perceptive arrangement or effect associated therewith at least partially through the smoking article to the user. In addition, aspects of the present disclosure involving the sensory or perceptive arrangement or effect associated therewith delivered to the user may otherwise be similarly applicable to other forms and arrangements of smoking articles such as, for example, conventional cigarettes, cigars, or pipes.

In general, aspects of the present disclosure may broadly implement apparatuses and methods involving a discrete device such as an igniter apparatus, external to the smoking article, being configured to deliver one or more elements or components (wherein one or more such elements or components may be exogenous to the smoking article) of a sensory or perceptive arrangement to the smoking article, so as to facilitate delivery of the sensory or perceptive arrangement or effect associated therewith via the smoking article to the user thereof. In some instances, exogenous elements or components may include materials or substances that were not included in the smoking article during the manufacture thereof, or otherwise may include desirable elements or components added to the smoking article from externally thereto. That is, particular aspects of the disclosure, for example, are directed to enhancing the flavor in a cigarette by adding flavor to a manufactured cigarette during lighting, and/or otherwise introducing flavor to a cigarette that has been manufactured without incorporation of an added flavor. Alternatively stated, in some aspects, a lighter and the lighting process for a cigarette may be implemented to introduce flavor into the cigarette. Generally, the sensory or perceptive arrangement or effect associated therewith delivered to the user via the smoking article is desirably prominent during the initial (i.e., lighting) puffs of the smoking article, though in other aspects, the sensory or perceptive arrangement or effect associated therewith may desirably be provided to the user following the initial puffs up to exhaustion of the consumption of the smoking article. In other general aspects, the sensory or perceptive arrangement or effect (i.e., a flavor or aroma) associated therewith delivered or provided to the user via the smoking article may be selected to complement the smoke produced by lighting the smoking article and/or throughout the smoking process, to facilitate the enjoyment of the smoking article by the user, to increase the satisfaction of the user in consuming the smoking article, and/or to otherwise enhance the user experience with the smoking article.

One aspect of the present disclosure, as schematically illustrated in FIG. 2, thus involves an ignition method, which comprises providing, on demand, a heat precursor from a heat precursor source (block 90); emitting heat associated with the heat precursor, wherein the heat is capable of igniting an ignitable article, from a heating arrangement configured to receive the heat precursor from the heat precursor source (block 92); and providing a perceptible sensory effect, such as a flavor or aroma, associated with a sensory precursor substance from a sensory precursor source in communication with the heating arrangement, wherein the heating arrangement is configured to release the sensory precursor substance in association with the heat emitted thereby (block 94).

In aspects where the heat precursor source comprises a fuel source having an ignitable fuel as the heat precursor, and the heating arrangement comprises an igniter arrangement, the method may further comprise igniting the fuel received from the fuel source with the igniter arrangement to produce a flame having the heat associated therewith for igniting the ignitable article. The fuel may be mixed with the sensory precursor substance prior to the resulting mixture being received by the igniter arrangement, or upon ignition thereof to produce the flame. In other instances, the sensory precursor substance may be directed into interaction with the flame. The sensory precursor substance may, in some aspects, be actuated by interacting the sensory precursor substance with the fuel, to thereby produce the perceptible sensory effect. In other instances, the sensory precursor substance may be actuated by igniting the sensory precursor substance, or by interacting the sensory precursor substance with the heat associated with the flame or the heat associated with the flame, to thereby produce the perceptible sensory effect.

In some aspects, the step of igniting the fuel to produce a flame having the heat associated therewith may further comprise emitting the sensory precursor substance without actuation thereof by one of the flame and the heat associated therewith. That is, the sensory precursor substance may be substantially unaffected by the heat/flame. Further, an aerosol may be formed from the sensory precursor substance, by exposing the sensory precursor substance to the flame and/or the heat associated therewith. In particular instances, the heat and the sensory precursor substance associated therewith are configured to interact with an ignitable article, such as a smoking article, and the method may further comprise interacting the sensory precursor substance with an element of the ignitable article to form an aerosol. That is, the sensory precursor substance from the igniter apparatus may require interaction with an element of the ignitable article, in order to form an aerosol.

In other aspects, the heating arrangement may include a heat-emitting element and the sensory precursor source may be disposed adjacent to the heat-emitting element. In such instances, the method may comprise actuating the sensory precursor substance with the heat emitted by the heat-emitting element, and may further comprise emitting the sensory precursor substance in association with the heat emitted by the heat-emitting element.

In still other aspects, the sensory precursor source may be configured as a consumable element comprised of the sensory precursor substance, and the method may further comprise consuming the consumable element and actuating the sensory precursor substance in response to the heat emitted by the heat-emitting element. Otherwise, the sensory precursor source may be configured as a non-consumable element comprised of the sensory precursor substance, and the method may further comprise actuating the sensory precursor substance of the non-consumable element in response to the heat emitted by the heat-emitting element.

In some aspects, the heat precursor source may comprise an electrical power source having electrical power as the heat precursor, and the heating arrangement may comprise a heating element, such as a resistive heating element. In such instances, the method may further comprise powering the heating element with the electrical power received from the electrical power source to produce the heat for igniting the ignitable article. In other aspects, the heat precursor source may comprise a catalyst source having a catalyst as the heat precursor, and the heating arrangement may comprise a heating membrane, wherein the method may further comprise reacting the heating membrane with the catalyst received from the catalyst source to produce the heat for igniting the ignitable article. In still further aspects, the heat precursor source may comprise a fuel source having an ignitable fuel as the heat precursor, and the heating arrangement may comprise a heating membrane, wherein the method may further comprise reacting the fuel received from the fuel source with a catalyst received from a catalyst source to produce the heat for igniting the ignitable article. In such instances, the step of emitting heat may further comprise emitting the sensory precursor substance without actuation thereof by the catalyst.

Various arrangements of apparatuses according to aspects of the present disclosure will now be addressed in detail. In some instances, a particular aspect may be referred to as being similar to one or more other aspects disclosed herein. In such instances, even though particular details may not be expressly discussed for a particular aspect, one skilled in the art will appreciate that the disclosure related to that aspect will incorporate details and disclosure of the other aspects indicated as being similar in nature. For example, a recitation that the arrangement shown in FIG. 10 is similar to the arrangement shown in FIG. 9 will serve to incorporate the disclosure of and description related to the arrangement of FIG. 9 into the disclosure of and description related to the arrangement of FIG. 10. As schematically illustrated, for example, in FIGS. 3-30, one aspect of the present disclosure involves an igniter apparatus, generally indicated by the numeral 100. Such an igniter apparatus 100 may comprise, for instance, a heat precursor source 200 having a heat precursor element 250. For example, the heat precursor source 200 (otherwise referred to herein as a "fuel source") may comprise a reservoir, and the heat precursor element 250 may comprise, for example, butane or other suitable organic fuel capable of being ignited to produce heat. One skilled in the art will appreciate, however, that the heat precursor element may not necessarily be restricted to a combustible material capable of producing heat. For example, the heat precursor source 200, in some instances, may comprise a power reservoir (i.e., a battery, capacitor, etc.) having a heat precursor element comprising, for example, electric power (i.e., for powering a resistive heating element). One skilled in the art will also appreciate that the heat precursor source 200 may be refillable (or rechargeable), or may otherwise be configured to be disposable or replaceable.

The igniter apparatus 100 may further comprise a heating arrangement 300 configured to, on demand, receive the heat precursor element 250 from the heat precursor source 200, and to emit heat associated with the heat precursor element 250. For example, the heating arrangement 300 may include an on-demand actuator 350 (including, for example, an "igniter arrangement") for causing the heating arrangement 300 to initiate production and emission of heat capable of igniting an ignitable article 150 (i.e., a spark generator for igniting a combustible fuel such as butane, or a switch for completing a circuit providing electrical power to a resistive heating element). In some instances, the actuator 350 may also be configured to maintain delivery of the heat precursor element 250 from the heat precursor source to the heating arrangement 300, in order to generate the emitted heat, as long as the demand is present or otherwise selected (i.e., via continued actuation of the actuator). For example, a flame lighter may be configured such that actuation of a striker provides a spark, while at the same time, releasing butane from the reservoir, wherein the spark ignites that butane to provide a flame (and heat), and wherein the flame continues to burn as long as the striker is held in the actuated position (or until the reservoir is emptied of butane). Various "conventional" lighters are disclosed, for example, by U.S. Pat. No. 2,032,695 to Gimera et al.; U.S. Pat. No. 2,737,037 to Zellweger; U.S. Pat. No. 3,551,092 to Masson; U.S. Pat. No. 3,756,766 to Green; U.S. Pat. No. 3,766,946 to Corarg; U.S. Pat. No. 3,829,737 to Johnsson; U.S. Pat. No. 4,222,734 to Nolf; U.S. Pat. No. 4,487,570 to Lowenthal; U.S. Pat. No. 5,059,852 to Meury; U.S. Pat. No. 5,308,240 to Lowenthal; U.S. Pat. No. 5,649,554 to Sprinkel et al.; U.S. Pat. No. 5,848,596 to Zelenik; U.S. Pat. No. 6,478,575 to Sher; U.S. Pat. No. 6,632,082 to Smith; U.S. Pat. No. 6,676,405 to Sewalt; U.S. Pat. No. 6,726,470 to Meister; U.S. Pat. No. 6,902,392 to Johnson; and U.S. Pat. No. 7,946,293 to Gerardi; and US Pat. App. Nos. 2012/0315588 to Kondrat; and 2014/0026904 to Monty et al.; each of which is incorporated herein by reference. The lighter fluids used within traditional or conventional types of lighters can vary, and can include fuels such as butane, ethanol and liquid hydrocarbon mixtures that provide so-called naphtha types of fluids. Various traditional types of light fluids have been commercially available; such as, for example, Colibri Premium Butane Fuel Refill by Colibri, Ronsonol Lighter Fluid from Ronson and Zippo Premium Lighter Fluid from Zippo Manufacturing Company.

In one particular instance, the heat precursor source 400 may comprise, for example, a fuel source having an ignitable or combustible fuel as the heat precursor element 250, and the heating arrangement 300 may comprise, for example, an igniter arrangement 325 (in addition to or instead of the actuator 350) configured to ignite the ignitable/combustible fuel received from the fuel source, to produce a flame having heat associated therewith, wherein the flame and/or the heat may be implemented for igniting the ignitable article 150 (i.e., a smoking article).

In particular aspects of the present disclosure, the igniter apparatus 100 also includes a sensory precursor source 400 having a sensory precursor substance 450. Generally, the sensory precursor source 400 may be arranged in communication with the heating arrangement 300, and may be configured to release the sensory precursor substance 450 in association with the heat/flame emitted by the heating arrangement 300. Further, the sensory precursor substance 450 may be configured to provide a perceptible sensory effect. As used herein, the terms "flavor," "aroma," or "odor" refer to substances, such as a liquid, a gel, or a solid (e.g., a crystalline material or a dry powder), that provide a concentrated release for a perceptible sensory effect such as, for example, taste, mouth feel, moistness, coolness/heat, and/or fragrance/aroma/odor), or otherwise may include components that aid in flavoring or scenting mainstream cigarette smoke, or may comprise, for example, a breath freshening agent for the smoker, a deodorizing agent for the cigarette butt, a moistening or cooling agent for the cigarette smoke, or a composition capable of otherwise altering the nature or character of the cigarette. One skilled in the art will also appreciate that the sensory precursor source 400 may be refillable (or rechargeable), or may otherwise be configured to be disposable or replaceable.

The sensory precursor substance 450 may comprise, for example, an aqueous or non-aqueous liquid (e.g., a solution or dispersion of at least one flavoring ingredient within water or an organic liquid such as an alcohol or oil, or a mixture of water and a miscible liquid like alcohol or glycerin). Exemplary flavoring agents providing such flavor/aroma/fragrance/odor can be natural or synthetic, and the character of these flavors can be described, without limitation, as fresh, sweet, herbal, confectionary, floral, fruity or spice. Specific types of flavors include, but are not limited to, tobacco, vanilla, coffee, chocolate, cream, mint, spearmint, menthol, peppermint, wintergreen, lavender, cardamom, nutmeg, cinnamon, clove, cascarilla, sandalwood, honey, jasmine, ginger, anise, sage, licorice, lemon, orange, apple, peach, lime, cherry, and strawberry. See also, Leffingwill et al., Tobacco Flavoring for Smoking Products, R. J. Reynolds Tobacco Company (1972). Flavorings also can include components that are considered moistening, cooling or smoothening agents, such as eucalyptus. These flavors may be provided neat (i.e., alone) or in a composite (e.g., spearmint and menthol, or orange and cinnamon). Composite flavors may be combined as a mixture. That is, in some aspects, the sensory precursor substance 450 may be a mixture of a flavoring agent and a diluting agent or carrier. Suitable diluting agents include ethanol and propylene glycol, and in certain instances water can be used as a carrier, particularly when the sensory precursor substance is housed in an arrangement physically separate from the lighter fluid of the heat precursor element. Another representative diluting agent is a triglyceride, such as a medium chain triglyceride, and more particularly a food grade mixture of medium chain triglycerides. See, for example, Radzuan et al., Porim Bulletin, 39, 33-38 (1999). The amount of flavoring and diluting agent may vary. In some instances, the diluting agent may be eliminated altogether, and the entire sensory precursor substance 450 can be comprised of flavoring agent. Alternatively, the sensory precursor substance 450 can be almost entirely comprised of diluting agent, and only contain a very small amount of relatively potent flavoring agent. In one embodiment, the composition of the mixture of flavoring and diluting agent is in the range of about 5 percent to about 75 percent flavoring, and more preferably in the range of about 5 to about 25 percent flavoring, and most preferably in the range of about 10 to about 15 percent, by weight based on the total weight of the sensory precursor substance 450, with the balance being diluting agent. One skilled in the art will also appreciate that, in some instances, the water or other liquid that may be included in the sensory precursor substance 450 may function to provide cooling for the smoke drawn through the smoking article.

The perceptible sensory effect may be provided merely upon release of the sensory precursor substance 450 from the sensory precursor source 400. For example, the sensory precursor substance 450 could comprise a liquid, vapor/ aerosol, or solid that is associated with a particular flavor or odor (i.e., aroma), when released or dispensed from the sensory precursor source 400. In one such aspect, for instance, the sensory precursor substance 450 may comprise a flavored liquid having a menthol flavor. The sensory precursor substance 450, in such instances, may be contained within a sensory precursor source 400 (i.e., reservoir) appropriately incorporated into the igniter apparatus 100. In some instances, the sensory precursor substance 450 may be pressurized within the sensory precursor source 400 so as to form a vapor, aerosol, or mist, upon dispensation thereof, and such that the sensory precursor substance 450 is emitted or delivered with force or under pressure from the igniter apparatus 100. In other instances, the sensory precursor source 400 may have associated therewith an on-demand pressurization provision (i.e., a pump sprayer or pressurizer) or a pump mechanism. In still other instances, the sensory precursor source 400 may be replaceable (i.e., a replaceable and disposable cartridge).

In other aspects, the sensory precursor component 450 may require actuation, upon release from the sensory precursor source 400, in order to provide the perceptible sensory effect. In such instances, the sensory precursor substance 450 could comprise, for example, a liquid, vapor/aerosol, or solid that is associated with a particular flavor or odor when released or dispensed from the sensory precursor source 400 and actuated, for instance, by heat. That is, in one instance, the sensory precursor substance 450 may be heat-actuated such that the perceptible sensory effect is only provided when the sensory precursor substance 450 is exposed to a sufficient level of heat. In one such particular aspect, for instance, the sensory precursor substance 450 may comprise a resinous substance that may or may not be consumed upon exposure to heat and/or flame, but releases a menthol flavor and/or odor when exposed to the heat and/or flame. In other instances, the sensory precursor substance 450 may comprise a flavored liquid having a particular flavor or odor, wherein the liquid, upon exposure to heat/flame, forms an aerosol or vapor, and wherein the heat/flame may function as a vehicle for transporting or delivering the aerosol/vapor and the associated flavor or odor.

In still other aspects, the sensory precursor component 450 may require interaction/actuation with an element disposed externally to the igniter apparatus 100, after being released from the sensory precursor source 400, in order to provide the perceptible sensory effect. That is, in some aspects, the heat and the sensory precursor substance associated therewith may generally be configured to interact with an ignitable article 150. In some aspects, the sensory precursor substance 450 may be particularly configured to interact with an element of the ignitable article 150 to form, for instance, an aerosol for delivering the perceptible sensory effect. In other aspects, for instance, in the case of the ignitable article 150 comprising a smoking article, the sensory precursor substance 450 could comprise, for example, a liquid, vapor/aerosol, or solid that is associated with a particular flavor or odor when released or dispensed from the sensory precursor source 400 and actuated, for instance, by engaging or otherwise interacting with a catalyst disposed within the smoking article, whether in the main body (tobacco rod) or filter element thereof. The catalyst example may thus represent the corresponding element for the sensory precursor substance 450, which is also disposed externally to the igniter apparatus (i.e., disposed in the smoking article). That is, in some aspects, the particular flavor or odor (i.e., aroma), or other perceptible sensory effect, may only be provided upon interaction of the sensory precursor component 450 released from the sensory precursor source 400, with the corresponding element (i.e., catalyst) included within the ignitable article 150 (i.e., smoking article). In one instance, the interaction between the sensory precursor substance 450 and the external element may be facilitated by exposure to heat, or the perceptible sensory effect may only be provided when the sensory precursor substance 450 interacts with the external element (i.e., catalyst) in the presence of heat provided, for instance, by the heating arrangement 300 of the igniter apparatus 100.

Depending on the form of the sensory precursor substance 450 and the location/disposition of the sensory precursor source 400, the sensory precursor substance 450 may be emitted/delivered in different manners. For example, in one aspect, the sensory precursor source 400 may be disposed within the igniter apparatus 100, and the fuel source (heat precursor source 200 containing, for example, a combustible fuel in liquid or vapor/aerosol form) and the sensory precursor source 400 (containing the sensory precursor substance 450) may be configured and arranged to mix the fuel with the sensory precursor substance 450, prior to the resulting mixture being received by the igniter arrangement 325/heating arrangement 300. In some instances, the heat precursor source 200 and the sensory precursor source 400 may be configured as the same reservoir, wherein, for example, the fuel and the sensory precursor substance 450 each comprise a liquid, or form a liquid solution/mixture upon interaction, and are thus pre-mixed prior to being dispensed to the igniter arrangement 325/heating arrangement 300. In instances where the heat precursor source 200 and the sensory precursor source 400 are configured as discrete reservoirs, each of the reservoirs may be configured to be in communication with a single conduit which is, in turn, in communication with the igniter arrangement 325/heating arrangement 300, such that the pre-mixed fuel and sensory precursor substance 450 is received by the igniter arrangement 325/heating arrangement 300. In such aspects, for example, the fuel may be combustible, while the sensory pre-cursor substance 450 is, for instance, not combustible or is otherwise actuated by exposure to the heat of combustion of the fuel to produce the perceptible sensory effect. In some instances, however, the sensory precursor substance 450 may be combustible or otherwise actuated by ignition thereof to produce the perceptible sensory effect. Further, in some instances, the sensory precursor substance 450 may be configured to be actuated by interaction with the fuel to produce the perceptible sensory effect. In still other instances, the sensory precursor substance 450 is configured not to be actuated by the flame and/or the heat associated therewith, but is urged into engagement with the ignitable article 150 by the flame and/or heat associated therewith. That is, the sensory precursor substance 450 may not be ignitable or otherwise actuated by heat, but can be carried to the smoking article by the flame/heat and the perceptible sensory effect associated therewith can be directed through the smoking article to the user, or can be generated through interaction of the sensory precursor substance with one or more elements within the smoking article (i.e., the sensory precursor substance 450 could at least partially comprise a catalyst).

In yet other aspects, the heat precursor source 200 and the sensory precursor source 400 are configured as discrete reservoirs, wherein each of the reservoirs may be configured to be in communication with a single conduit, and wherein each conduit, in turn, is arranged in communication with the igniter arrangement 325/heating arrangement 300. In such instances, the fuel and the sensory precursor substance 450 may be mixed in a selected manner by the igniter arrangement 325/heating arrangement 300. For example, both the fuel and the sensory precursor substance 450 may be released/dispensed upon actuation of the actuator 350. That is, for instance, the igniter arrangement 325/heating arrangement 300 may be configured to mix the fuel with the sensory precursor substance 450, upon ignition thereof, to produce the flame/heat. In other instances, the actuator 350 may be configured as a two stage actuator, wherein an initial actuation may, for example, dispense and ignite the fuel, while a second actuation or a further actuation of the actuator 350 may, for instance, dispense the sensory precursor substance 450. In still other instances, a separate actuator may be provided for dispensing the sensory precursor substance 450, which may be separately and selectively actuated in relation to the actuator 350 for dispensing and igniting the fuel. In aspects involving a separate actuator for dispensing the sensory precursor substance, the sensory or perceptive arrangement or effect associated therewith delivered to the user via the smoking article may additionally and selectively be made prominent by the user at other periods during the consumption of the smoking article, rather than merely during the initial (i.e., lighting) puffs of the smoking article. That is, the igniter apparatus 100 may, in some instances, be implemented for dispensation of the sensory precursor substance 450, via the separate actuator, at any time up to exhaustion of the consumption of the smoking article. In such instances, the dispensed sensory precursor substance 450 may be actuated by interaction with the heat generated by the ignited smoking article itself. Further, the sensory or perceptive arrangement or effect associated therewith delivered to the user may be enjoyed throughout the consumption of the smoking article. In still other instances, the separate actuator may allow the sensory or perceptive arrangement or effect associated therewith to be delivered to the user toward the end of the smoking article consumption process to dispense a pleasant taste/aroma/aftertaste/after-effect (i.e., breath freshener) at or after the last puff.

In some further instances, the igniter arrangement 325/heating arrangement 300 may be configured to direct the sensory precursor substance 450 into interaction with the flame/heat. In such aspects, for example, the fuel may be combustible, while the sensory pre-cursor substance 450 may be, for instance, not combustible or is otherwise actuated by exposure to the heat of combustion of the fuel to produce the perceptible sensory effect. In some instances, however, the sensory precursor substance 450 may be combustible or otherwise actuated by ignition thereof to produce the perceptible sensory effect. In still other instances, the sensory precursor substance 450 is configured not to be actuated by the flame and/or the heat associated therewith, but is urged into engagement with the ignitable article 150 by the flame and/or heat associated therewith. That is, the sensory precursor substance 450 may not be ignitable or otherwise actuated by heat, but can be carried to the smoking article by the flame/heat and the perceptible sensory effect associated therewith can be directed through the smoking article to the user, or can be generated through interaction of the sensory precursor substance with one or more elements within the smoking article.

The heating arrangement 300 may be configured in various manners to emit the heat capable of igniting the ignitable article 150. In general, the heating arrangement 300 may include a heat-emitting element 375. In some aspects, the sensory precursor source 400 may be disposed adjacent to the heat-emitting element 375. In particular instances, the sensory precursor substance 450 from the sensory precursor source 400 may be configured to be actuated by the heat emitted by the heat-emitting element 375. Accordingly, the sensory precursor source 400 may be arranged with respect to the heat-emitting element 375 so as to emit the sensory precursor substance 450 in association with the heat emitted by the heat-emitting element 375.

In one such aspect, the sensory precursor source 400 may be configured as a consumable element comprised of the sensory precursor substance 450. In such instances, the consumable element may be configured to be consumed, and the sensory precursor substance 450 configured to be actuated to provide the perceptible sensory effect, in response to the heat emitted by the heat-emitting element 375. In another aspect, the sensory precursor source 400 may be configured as a non-consumable element comprised of the sensory precursor substance 450. In such instances, the non-consumable element may be configured to not be consumed, and the sensory precursor substance 450 configured to be actuated to provide the perceptible sensory effect, in response to the heat emitted by the heat-emitting element 375. That is, the sensory precursor substance 450 may be actuated by the heat to produce the perceptible sensory effect, but the sensory precursor substance 450 is not otherwise consumed by exposure to the heat/flame.

The configuration of the heating arrangement 300 may vary from the combustible fuel aspects previously disclosed. For example, in some aspects, the heat precursor source 200 may comprise an electrical power source having electrical power as the heat precursor substance 250. In such instances, the heating arrangement 300 may comprise a heating element configured to be powered by the electrical power received from the electrical power source to produce the heat for igniting the ignitable article 150.

In other aspects, the heat precursor source 200 may comprise a catalyst source having a catalyst as the heat precursor substance 250. In such instances, the heating arrangement 300 may comprise a heating membrane configured to react with the catalyst received from the catalyst source to produce the heat for igniting the ignitable article 150. In other aspects, a catalyst source having a catalyst, may be additionally included in the igniter apparatus 100, wherein the heat precursor source 200 may comprise a fuel source having an ignitable fuel as the heat precursor substance 250, and wherein the heating arrangement 300 may comprise a heating membrane configured to react the fuel received from the fuel source with the catalyst received from the catalyst source to produce the heat for igniting the ignitable article 150. In such aspects, the sensory precursor substance 450 may be configured not to be actuated by the catalyst. In other instances, a separate catalyst source may not be included, but the catalyst may be present as a component of the fuel. In such cases, the catalyst may be selected to interact with the fuel, or otherwise to be non-reactive in regard to the fuel.

Figure 3:
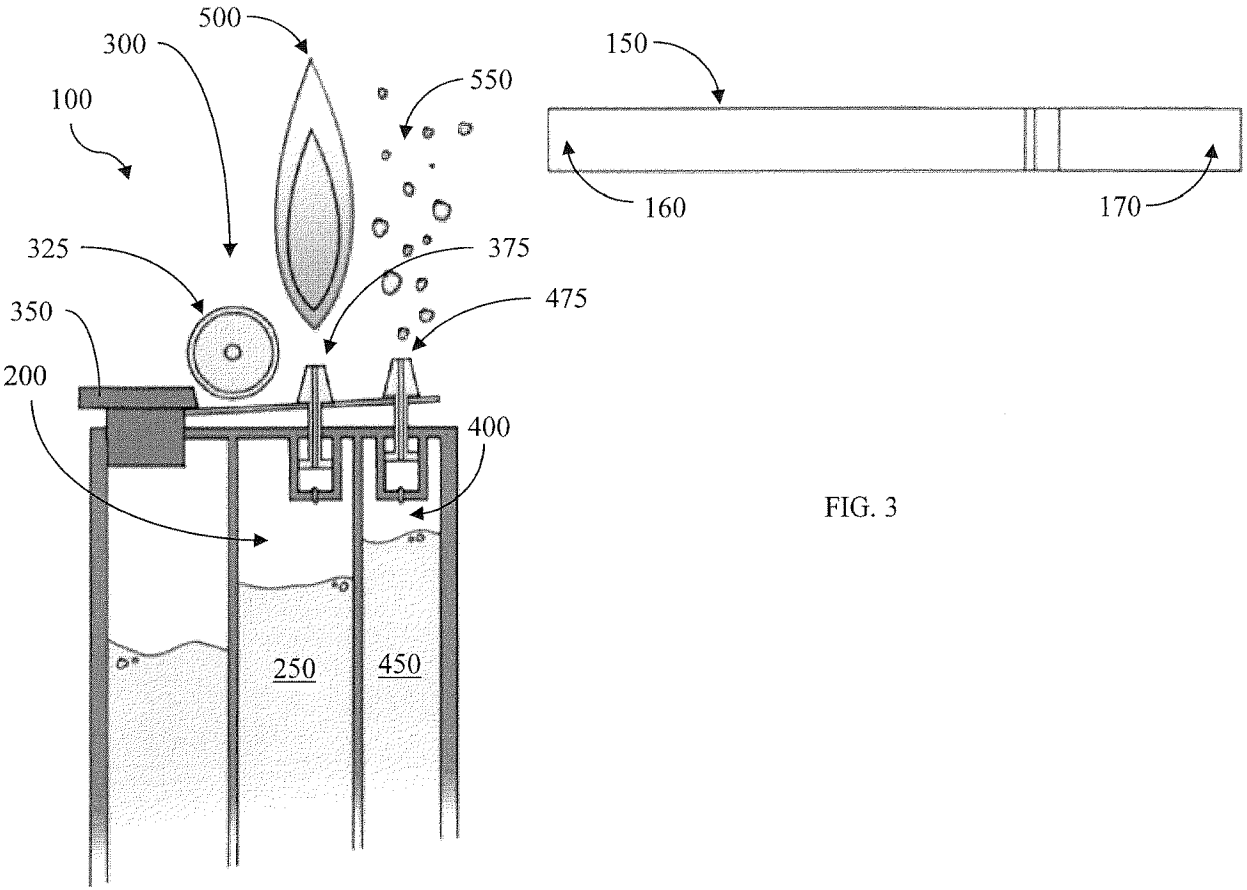

In one example aspect, as particularly shown in FIG. 3, the igniter apparatus 100 may comprise, for example, a conventional lighter, having a heat precursor source 200 configured as a pressurized reservoir for containing a heat precursor substance 250 comprising a combustible fuel such as, for example, butane. The heating arrangement 300 generally comprises an actuator 350, wherein, upon actuation, the actuator 350 may be configured to open a valve (i.e., at least a portion of the "heat-emitting element 375") associated with the heat precursor source 200 to release the heat precursor substance 250 therefrom. Further, actuation of the actuator 350 may also actuate the igniter arrangement 325 to provide a spark or other impetus for igniting the pressurized combustible fuel 250 released from the heat precursor source 200 via the heat emitting element 375 of the heating arrangement 300, to produce the flame/heat 500 for igniting the discrete ignitable article 150 (i.e., smoking article). The igniter apparatus 100 may also include a sensory precursor source 400 configured as a pressurized reservoir for containing a sensory precursor substance 450 comprising, for example, an aromatic or flavored liquid or low viscosity gel. In such instances, actuation of the actuator 350 may also open a valve (i.e., at least a portion of the "sensory precursor-emitting element 475") associated with the sensory precursor source 400 to release the sensory precursor substance 450 therefrom and into interaction with the flame/heat 500 emitted by the heat-emitting element 375. The emitted sensory precursor substance (i.e., an aerosol 550 of the sensory precursor substance 450) may be actuated or not actuated by interaction with the heat to produce the perceptible sensory effect. Once released from the sensory precursor source 400, the emitted sensory precursor substance 550 may be delivered to the ignitable article (i.e., smoking article) 150, for instance, by the pressurization in the sensory precursor source 400 released through the sensory precursor-emitting element 475, or by suction imparted to and through the smoking article 150 by the user and into interaction with the emitted sensory precursor substance 550. In some instances, the interaction of the emitted sensory precursor substance 550 with the heat/flame may create a propellant force for urging the emitted sensory precursor substance 550 into engagement with the ignitable article (smoking article) 150.

Figure 4:
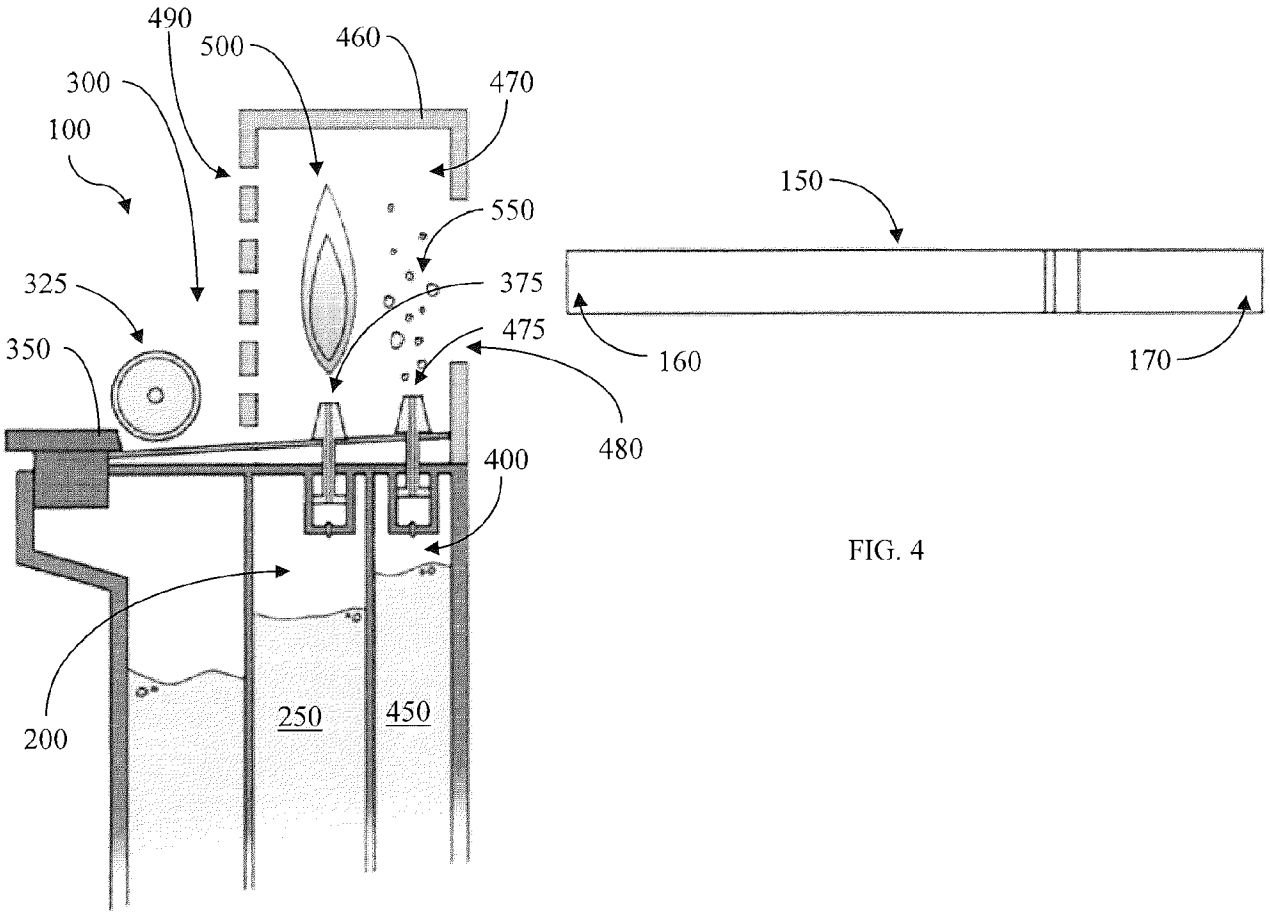

In another example aspect, as shown in FIG. 4, the igniter apparatus 100 may be similarly configured as the aspect shown in FIG. 3. However, the illustrated aspect may also include, for example, a housing 460 defining an ignition chamber 470 extending about the heat-emitting element 375 and the sensory precursor-emitting element 475. The housing 460 may also define an orifice 480 configured and arranged to receive the ignitable end of the ignitable element (i.e., smoking article) 150 for ignition thereof and/or for delivery of the emitted sensory precursor substance 550 (and associated perceptible sensory effect) thereto. In some instances, the housing 460 may also define one or more perforations 490 for allowing atmospheric oxygen into the ignition chamber 470 for supporting combustion of the fuel (heat precursor substance 250) released by the heat-emitting element 375, or otherwise for equalizing the pressure in the ignition chamber 470 is response to the suction imparted to and through the smoking article 150 by the user and into interaction with the heat 500/emitted sensory precursor substance 550 within the ignition chamber 470.

Figure 5:
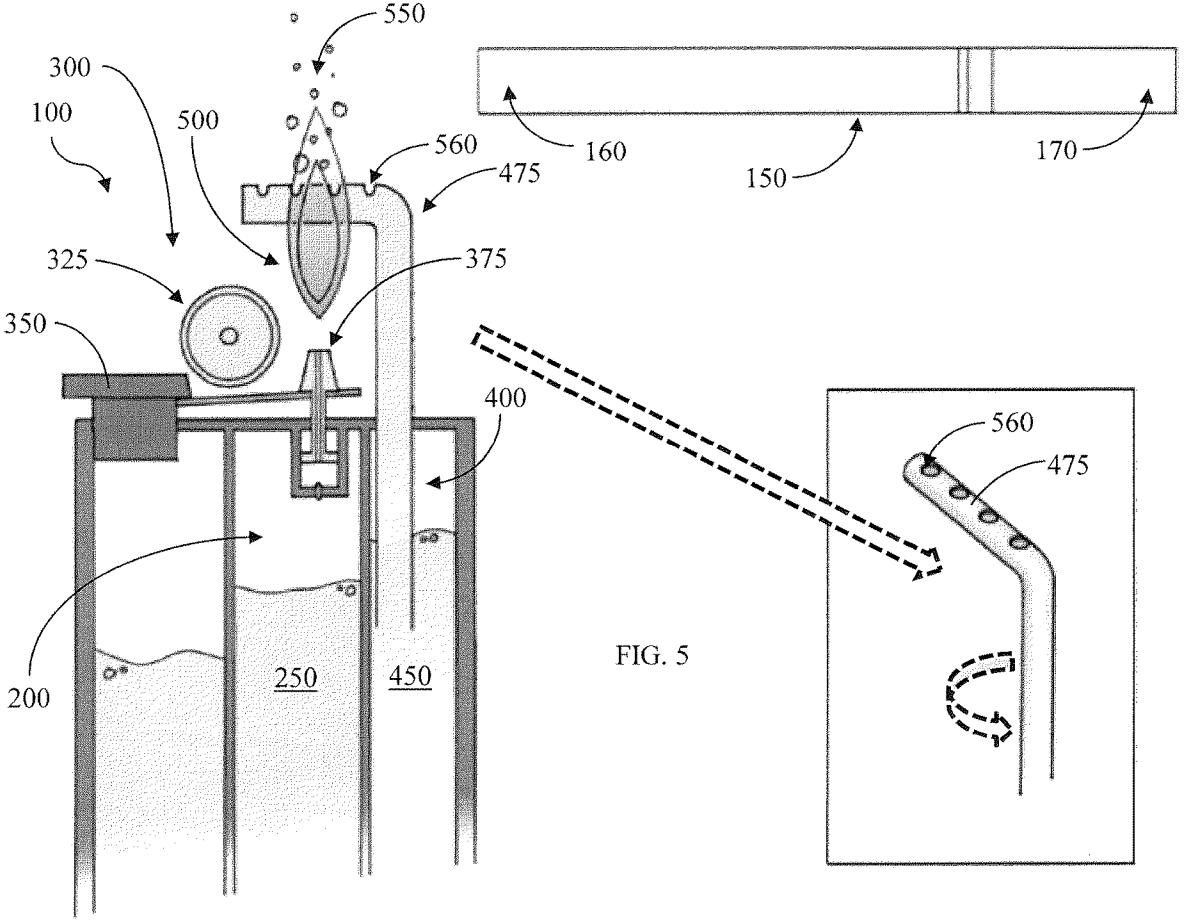

In a further example aspect, as shown in FIG. 5, the igniter apparatus 100 may be similarly configured as the aspect shown in FIG. 3. However, the illustrated aspect may have, for example, the sensory precursor-emitting element 475 configured in a different manner. For example, the sensory precursor-emitting element 475 may comprise a heat-conductive tubular member (i.e., comprised of a brass or other suitable material) extending from the sensory precursor source 400 and in communication with the sensory precursor substance 450 therein. The sensory precursor-emitting element 475 may extend into proximity with the heat-emitting element 375 (i.e., over the exit of the valve from which the ignitable fuel is dispensed), and the portion thereof in proximity to the heat-emitting element 375 may, for instance, define one or more vents 560. The sensory precursor-emitting element 475 (brass tube) may be fixed in proximity to the heat-emitting element 375, or may be movable into proximity with the heat-emitting element 375 on demand (i.e., swiveled about an axis extending through the portion of the sensory precursor-emitting element 475 into the sensory precursor source 400.

The emission of the sensory precursor substance 450 may be accomplished in different manners. For example, the sensory precursor substance 450 may be direct by pressure in the sensory precursor source 400, through the brass tube to the portion thereof disposed in proximity to the heat-emitting element 375. In some aspects, the tube may include, for example, a gravity trap or other accumulation region disposed about the dispensing end thereof so as to facilitate retention of the sensory precursor substance 450 toward the dispensing end. Upon actuation of the heat-emitting source 375, the brass tube (sensory precursor-emitting element 475) may be heated and, in turn, heat the sensory precursor substance 450 therein. In response, for instance, the sensory precursor substance 450 may form a bubble or otherwise expand within the brass tube and through the vents 560. In such instances, the emitted sensory precursor substance 550 may aerosolize and be delivered to the ignitable article 150 or, for example, the "lighting end 160" of the ignitable article 150 may be brought into contact with the bubble of the sensory precursor substance 450 (which may then force or otherwise deliver the sensory precursor substance 450 onto the end of the smoking article 150, as the smoking article is being ignited).

In other aspects, the heat-emitting element 375 may initially be actuated and then followed by actuation of the sensory precursor-emitting element 475 (i.e., direct the sensory precursor substance 450 into the brass tube for dispensation via the vents 560). The actuation of the sensory-precursor-emitting element 475 may be accomplished by the same actuator 350 used to actuate the heat-emitting element 375 (i.e., by additional actuation of the actuator 350) or by a second, separate actuator (not shown in this embodiment). In other instances, the second actuator may be configured and arranged to move the dispensing end of the sensory precursor-emitting element 475 (brass tube) into proximity with the heat-emitting element 375 for interaction with the heat/flame. In still other instances, for example, a pressure-actuated or heat-actuated valve (not shown) may be disposed within the tube prior to the dispensing end, at or about the dispensing end, or in one or more of the vents 560. The valve may be response to heat from the heat-emitting element 375 or pressure from the heat-emitting element 375 and/or the sensory precursor source 400, to release and emit the sensory precursor substance 450. In still other aspects, actuation or other movement of the tube to bring the dispensing end thereof into proximity with the heat-emitting element 375, prior to actuation thereof, may cause the sensory precursor substance 450 to be directed from the sensory precursor source 400 toward the dispensing end of the tube. In yet other instances, the igniter apparatus 100 may include a cover element (not shown) extending over the actuator 350, the heat-emitting element 375, and/or the sensory precursor-emitting element 475, when the use opening the cover prior to actuating the heat-emitting element 375, and/or the sensory precursor-emitting element 475 may cause the sensory precursor substance 450 to be directed from the sensory precursor source 400 toward the dispensing end of the tube.

Figure 6:
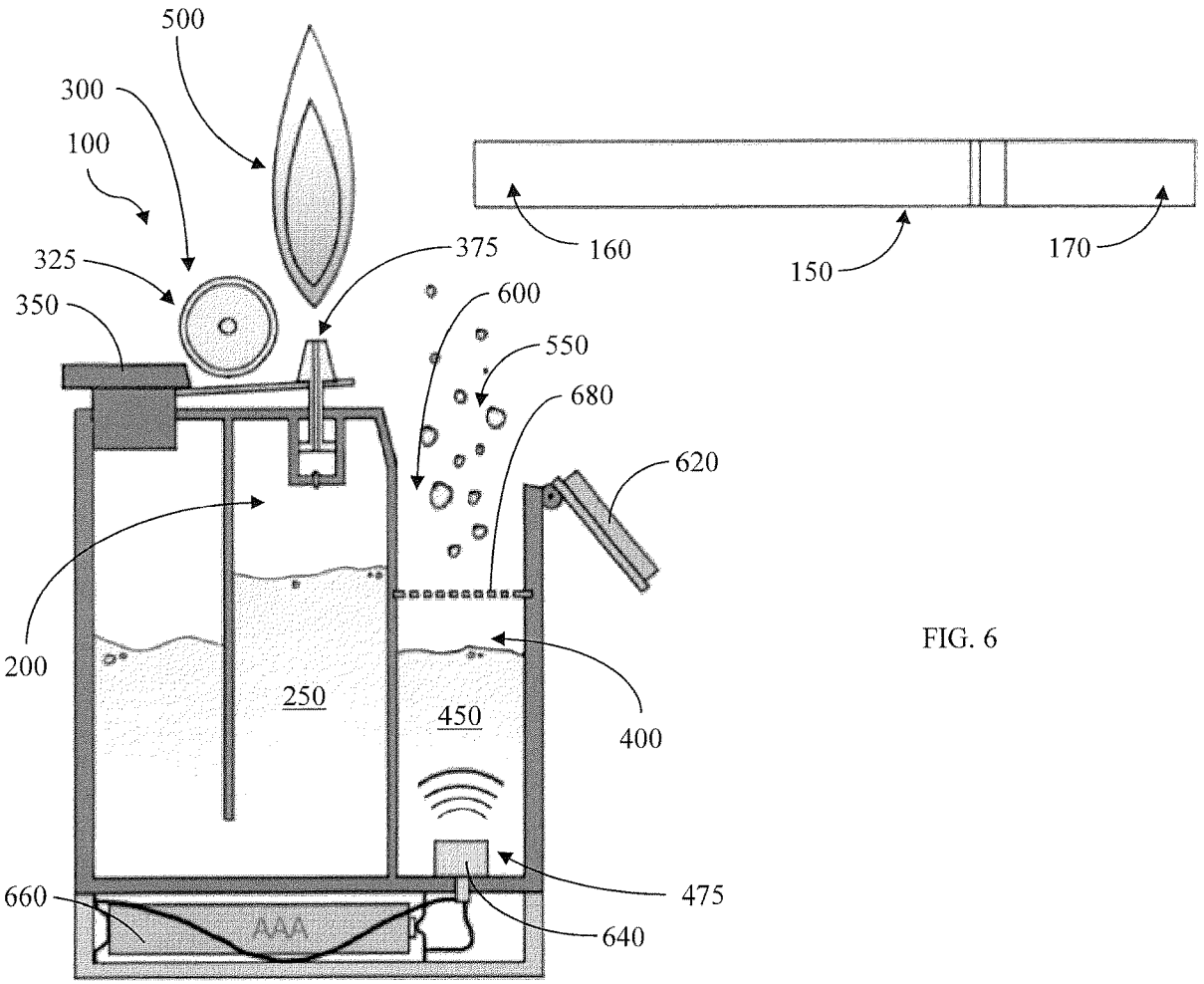

FIG. 6 schematically illustrates yet another example aspect of an igniter apparatus 100 according to the present disclosure. In this aspect, the sensory precursor source 400 may have an opening 600 disposed in proximity to the heat-emitting element 375, wherein the opening 600 may ordinarily be closed by a closure element 620. The closure element 620 may be actuated (opened) on demand (i.e., following actuation of the heat-emitting element 375). In actuating the closure element 620, the sensory precursor-emitting element 475 may, in turn, be actuated thereby (or otherwise by a separate actuator—not shown). In such instances, the sensory precursor-emitting element 475 may comprise, for example, a vibrating diaphragm, vibrating piezoelectric element, or other vibratory arrangement 640, which may be powered by a battery 660 or other appropriate power source. The actuated vibratory arrangement 640 may be configured to emit vibrations that interact with the sensory precursor substance 450, for example, to aerosolize the sensory precursor substance 450, which is then emitted through the opening 600 and into interaction with the heat-emitting element 375. In some instances, a screen or other porous member 680 may be disposed and arranged about the opening 600, wherein the porous member 680 may be configured to facilitate formation of the aerosol by the sensory precursor substance 450. In other instances, the porous member 680 may facilitate a local accumulation of the aerosol precursor substance 450 externally to the sensory precursor source 400, wherein the "lighting end 160" of the ignitable article 150 may be inserted into the opening 600 and brought into contact with the local accumulation of the sensory precursor substance 450, which may then force or otherwise deliver the sensory precursor substance 450 onto or into the lighting end 160 of the smoking article 150.

Figure 7:
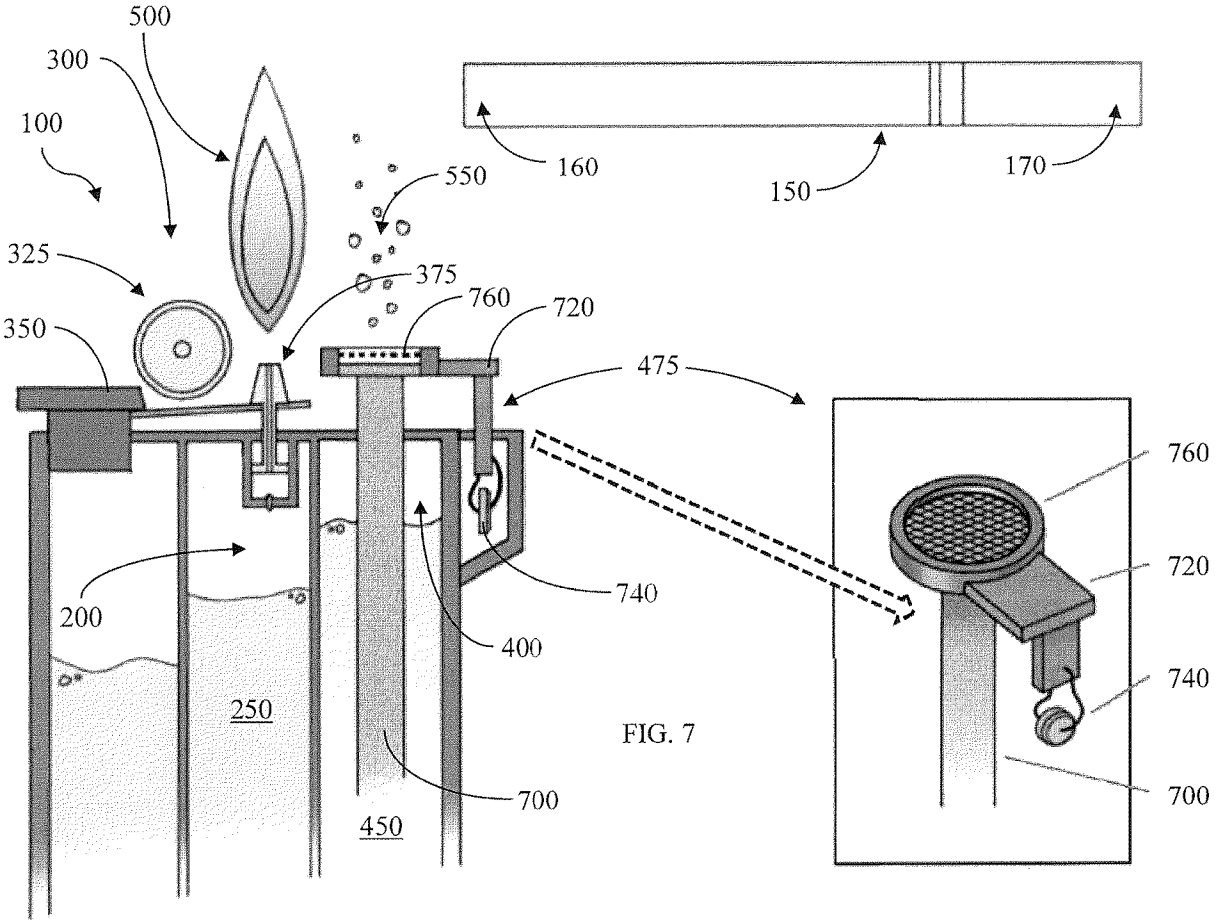

FIG. 7 schematically illustrates still another example aspect of an igniter apparatus 100 according to the present disclosure. In this aspect, the sensory precursor source 400 may have a wick or other siphoning arrangement 700 extending from the sensory precursor source 400 and into proximity with the heat-emitting element 375. The wicking/siphoning arrangement 700 may thus be configured to direct the sensory precursor substance 450 from the sensory precursor source 400 toward and into proximity with the heat-emitting element 375 (i.e., the wicking/siphoning arrangement may be continually "wetted" with the sensory precursor substance 450). The sensory precursor-emitting element 475 may, in such instances, be actuated on demand (i.e., following actuation of the heat-emitting element 375) by a separate actuator 350 (not shown). In such instances, the sensory precursor-emitting element 475 may comprise, for example, a vibrating diaphragm, vibrating piezoelectric element, or other vibratory arrangement 720 disposed about the distal end of the wick/siphoning arrangement 700, wherein the vibratory arrangement 720 may powered by a battery 740 or other appropriate power source. The actuated vibratory arrangement 720 may be configured to emit vibrations that interact with the wick/siphoning arrangement 700 and/or the sensory precursor substance 450 interacted therewith, for example, to aerosolize the sensory precursor substance 450, which is then emitted into interaction with the heat-emitting element 375. In some instances, a screen or other porous member 760 may be disposed and arranged about the distal end of the wicking/siphoning arrangement 700, wherein the porous member 760 may be configured to facilitate formation of the aerosol by the sensory precursor substance 450 (i.e., through interaction with the aerosolized sensory precursor substance formed by the vibratory arrangement 730, or through interaction with the vibratory arrangement 720 to cooperatively aerosolize the sensory precursor substance 450). In other instances, the porous member 760 may facilitate a local accumulation of the aerosol precursor substance 450 externally to the sensory precursor source 400 (i.e., on the external surface of the porous member 760), wherein the "lighting end 160" of the ignitable article 150 may be brought into contact with the local accumulation of the sensory precursor substance 450/porous member 760, which may then force or otherwise deliver the sensory precursor substance 450 onto or into the lighting end 160 of the smoking article 150.

Figure 8:
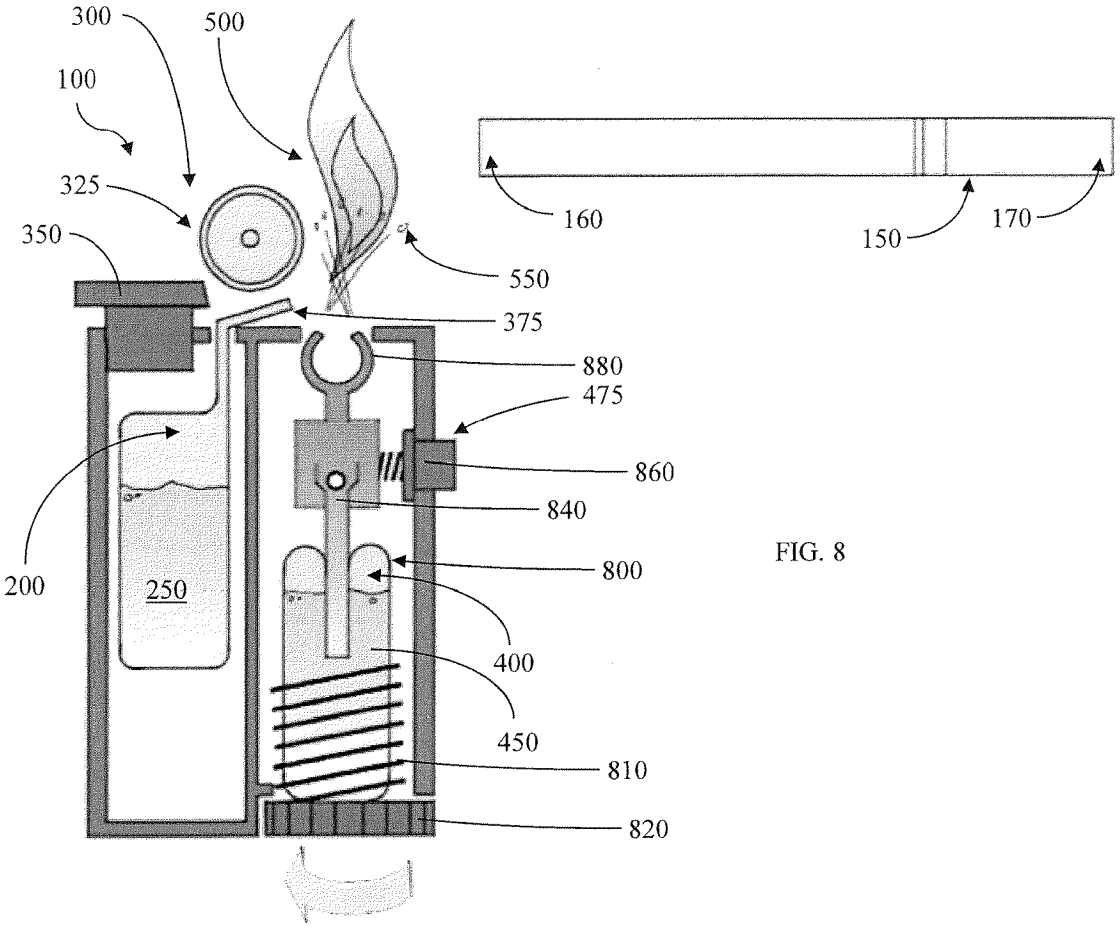

FIG. 8 schematically illustrates another example aspect of an igniter apparatus 100 according to the present disclosure. In this aspect, the sensory precursor source 400 may be configured, for example, as a bladder or other deformable container 800 for containing the sensory precursor substance 450 therein. A portion of the deformable container 800 may be at least partially surrounded by a coil spring or other suitable compressible member 810, wherein the compressible member 810 is in operable engagement with a compression actuator (i.e., thumbwheel) 820. In such instances, advancement of the thumbwheel in a particular rotational direction may, in turn, actuate the compressible member 810 to constrict and apply pressure to the deformable container 800. The pressure applied to the compressible member 810, by the thumbscrew 820, causes an increase in pressure within the compressible member 810 and thereby pressurizes the sensory precursor substance 450 therein. An actuatable valve 840 may be engaged and in communication with the deformable container 800, wherein pressurization of the deformable container 800 causes the sensory precursor substance to be directed to the valve 840. The valve 840 may be, for example, pressure-actuated or, in other instances, may be actuated by a supplemental actuator 860 (i.e., a manual release for the flow control element in the valve 840). Following the valve 840, the released sensory precursor substance 450 may then be directed to an emission arrangement 880 and, from the emission arrangement 880 toward and into proximity with the heat-emitting element 375. In some instances, the emission arrangement 880 may facilitate formation of an aerosol from the sensory precursor substance 450 upon emission thereof. The sensory precursor-emitting element 475 may, in such instances, be actuated on demand (i.e., following actuation of the heat-emitting element 375) by the supplemental actuator 860. In other instances, the emission arrangement 880 may facilitate a local accumulation of the aerosol precursor substance 450 externally to the sensory precursor source 400 (i.e., at or about the distal end of the emission arrangement 880 in proximity to the heat-emitting element 375), wherein the "lighting end 160" of the ignitable article 150 may be brought into contact with the local accumulation of the sensory precursor substance 450/emission arrangement 880, which may then force or otherwise deliver the sensory precursor substance 450 onto or into the lighting end 160 of the smoking article 150.

Figure 9:
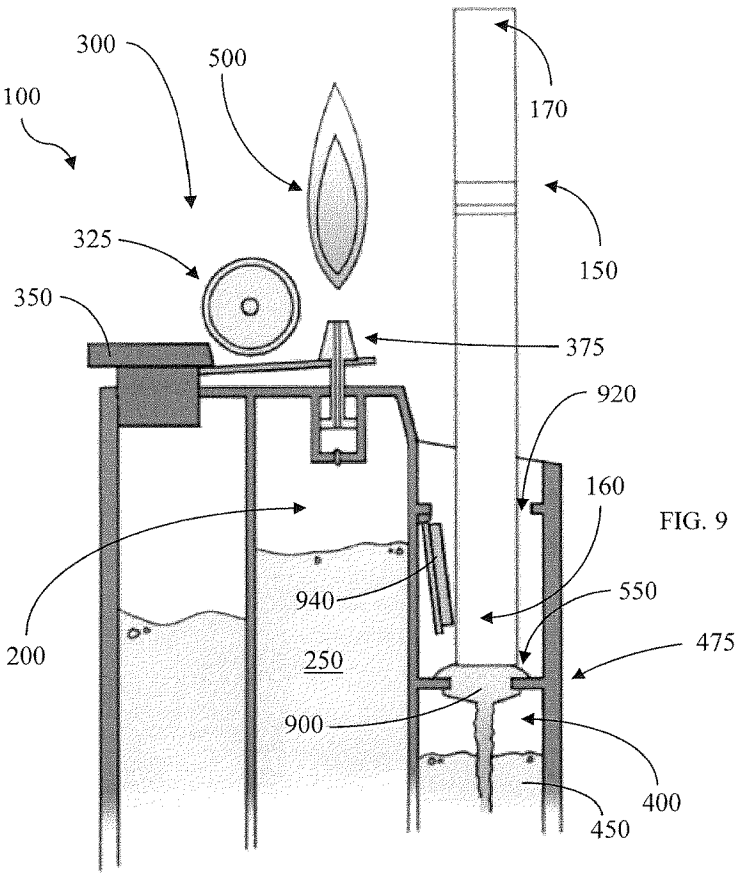
Figure 10:
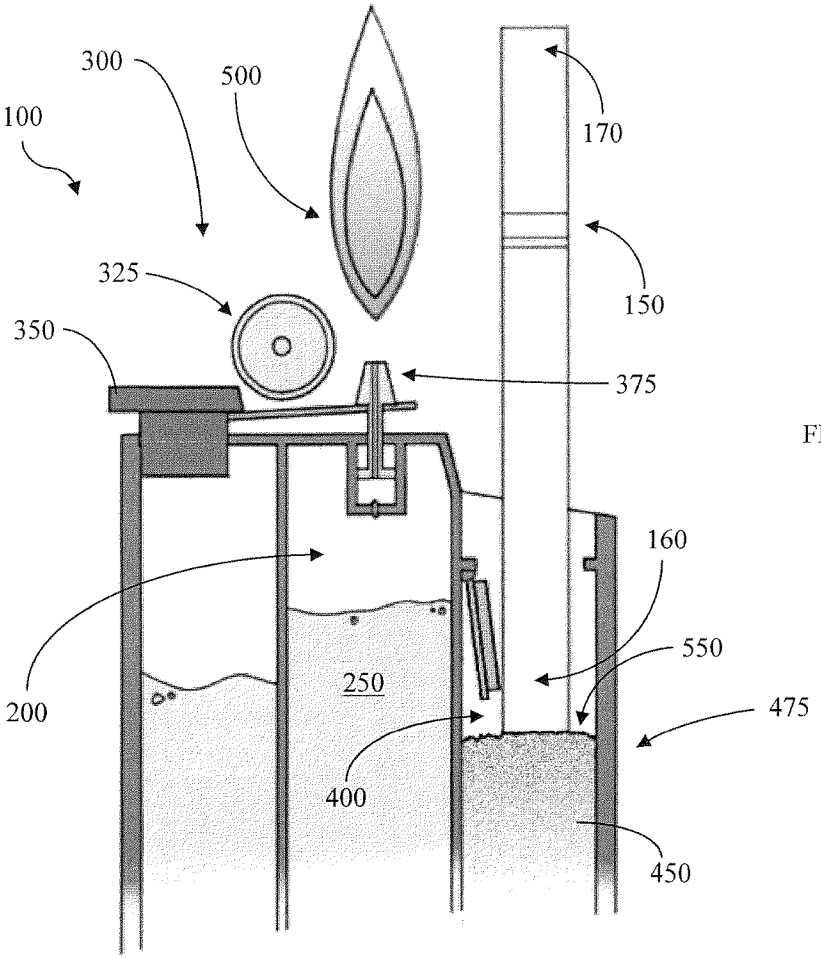

FIG. 9 schematically illustrates another example aspect of an igniter apparatus 100 according to the present disclosure. In this aspect, the sensory precursor source 400 may have a wick or other siphoning element 900 extending from the sensory precursor source 400 and toward the heat-emitting element 375. The wicking/siphoning element 900 may thus be configured to direct the sensory precursor substance 450 outwardly from the sensory precursor source 400 (i.e., the wicking/siphoning element 900 may be continually "wetted" with the sensory precursor substance 450). In this aspect, the sensory precursor source 400 may have an opening 920 which may ordinarily be closed by a closure element 940. The closure element 940 may be actuated (opened) on demand (i.e., prior to actuation of the heat-emitting element 375). In some instances, the closure element 940 may be inwardly hinged, and actuation thereof may occur, for example, through exertion of force/pressure thereto with the lighting end 160 of the smoking article 150. By urging the lighting end 160 of the smoking article 150 to actuate (open) the closure element 940, the lighting end 160 of the smoking article 150 may further be directed through the opening 920 and brought into contact with the wicking/siphoning element 900 having a local accumulation of the sensory precursor substance 450. Contact between the lighting end 160 of the smoking article 150 and the wicking/siphoning element 900 may then force or otherwise deliver the sensory precursor substance 450 onto or into the lighting end 160 of the smoking article 150. The smoking article 150 may then be withdrawn from the sensory precursor source 400 through the opening 920, and then the lighting end 160 ignited via actuation of the heat-emitting element 375, as previously disclosed in regard to other aspects.

FIG. 10 illustrates a similar example arrangement of an igniter apparatus 100, as shown for example, in FIG. 9. However, in such instances, the sensory precursor substance 450 may comprise a substance other than a liquid, and a wicking/siphoning element is not necessarily implemented. For example, the sensory precursor substance 450 may comprise, for instance, a powder or granular substance associated with the perceptible sensory effect. In such instances, the lighting end 160 of the smoking article 150 may be brought into direct engagement with the sensory precursor substance 450 in the sensory precursor source 400, which may then force or otherwise deliver the sensory precursor substance 450 onto or into the lighting end 160 of the smoking article 150. The smoking article 150 may then be withdrawn from the sensory precursor source 400 through the opening, and then the lighting end 160 ignited via actuation of the heat-emitting element 375, as previously disclosed in regard to other aspects.

Figure 11:
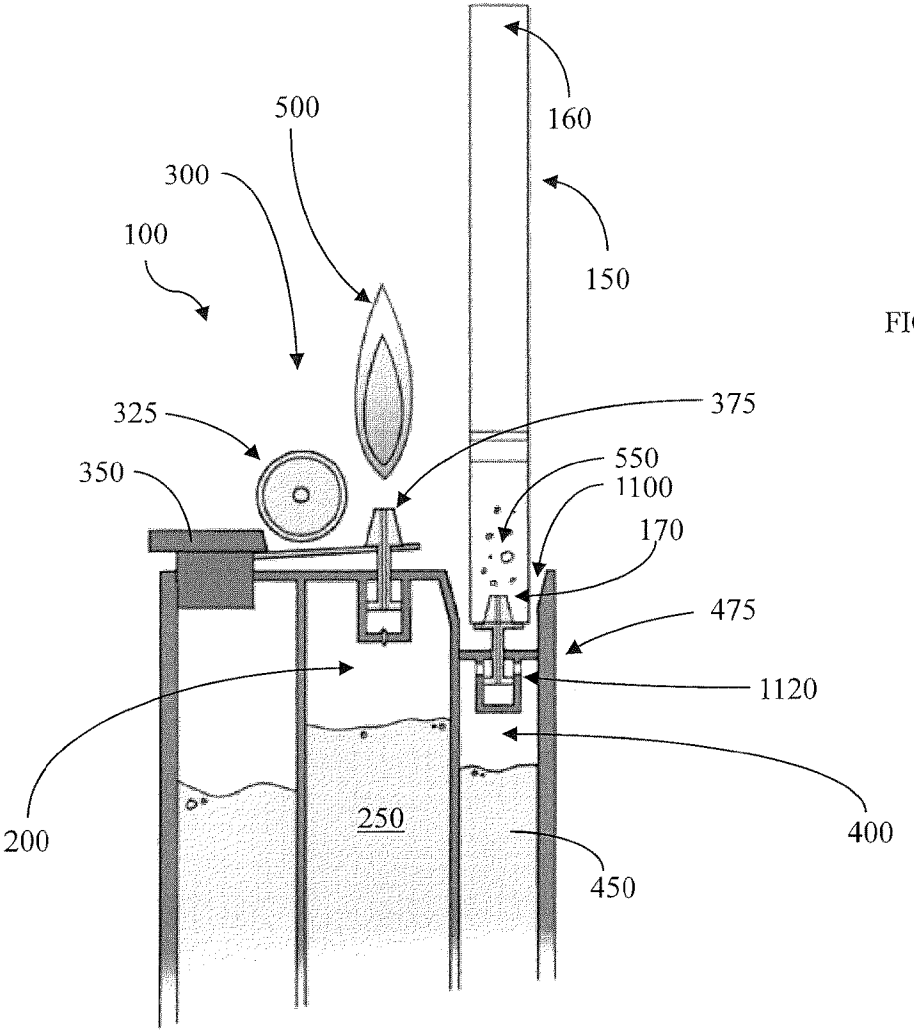

FIG. 11 schematically illustrates another example arrangement of an igniter apparatus 100 similar to the arrangement shown in FIG. 3. In such an arrangement, however, the actuator 350 may be configured solely to open a valve (i.e., at least a portion of the "heat-emitting element 375") associated with the heat precursor source 200 to release the heat precursor substance 250 therefrom, wherein actuation of the actuator 350 may also actuate the igniter arrangement 325 to provide a spark or other impetus for igniting the pressurized combustible fuel 250 released from the heat precursor source 200 via the heat emitting element 375 of the heating arrangement 300, to produce the flame/heat 500 for igniting the discrete ignitable article 150 (i.e., smoking article). The sensory precursor source 400 may be configured as a pressurized reservoir for containing a sensory precursor substance 450 comprising, for example, an aromatic or flavored liquid. In such instances, the sensory precursor-emitting element 475 may include a receptacle 1100 for receiving the lighting end 160 or mouth end 170 of the smoking article 150. Disposed within the receptacle 1100 may be a valve 1120 separating the receptacle 1100 from the sensory precursor source 400. The valve 1120 may be configured such that insertion of the lighting end 160 or mouth end 170 of the smoking article 150, and urging the lighting end 160/mouth end 170 toward the sensory precursor source 400 and against the valve 1120, manually depresses (opens) the valve 1120 to cause dispensation of the pressurized sensory precursor substance 450 directly into engagement with the lighting end 160/mouth end 170 of the smoking article 150. In other instances, the lighting end 160/mouth end 170 may be brought into engagement with the valve 1120, and a separate actuator (not shown) used to actuate the valve 1120 to release the sensory precursor substance 450. The smoking article 150 may then be withdrawn from the receptacle 1100, and then the lighting end 160 ignited via actuation of the heat-emitting element 375, as previously disclosed in regard to other aspects.

Figure 12:
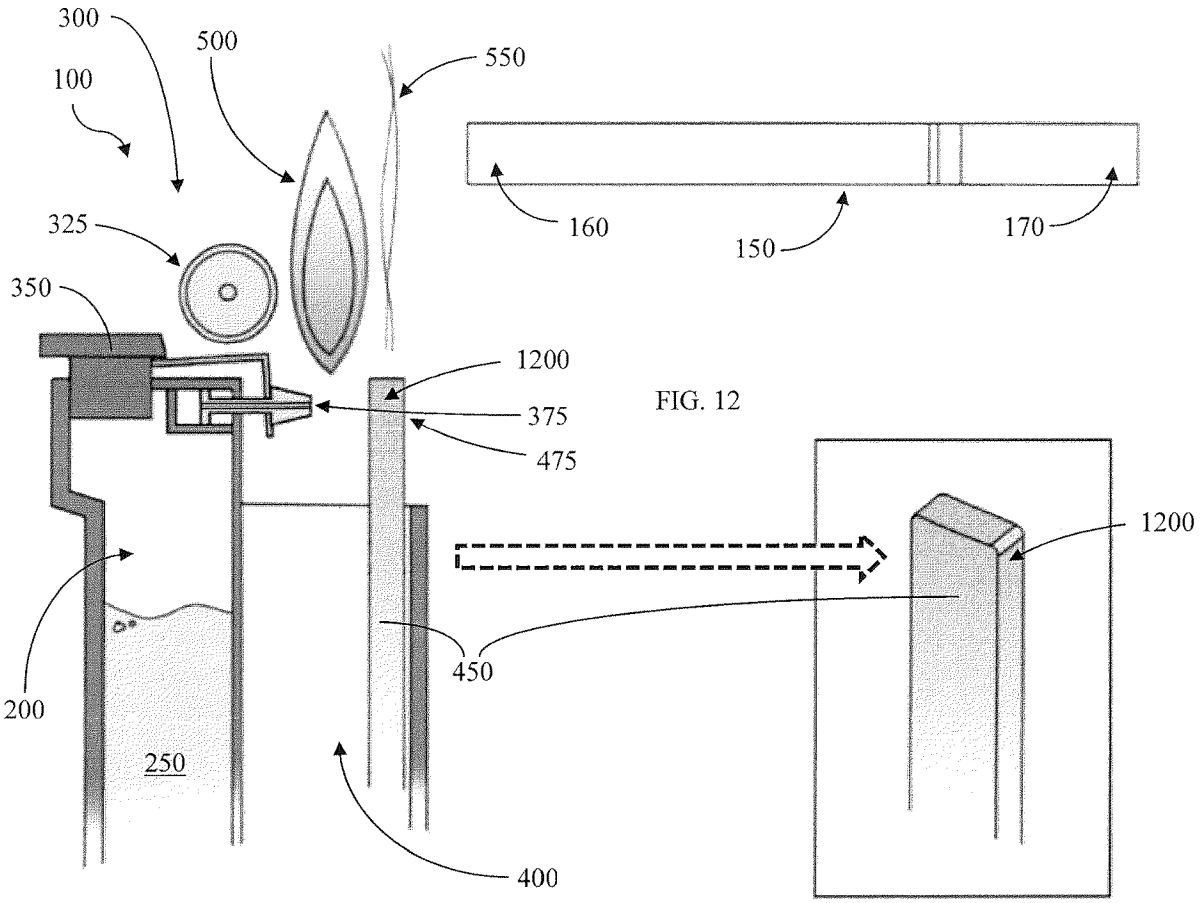

FIG. 12 schematically illustrates another example arrangement of an igniter apparatus 100 similar to the arrangement shown in FIG. 3. In such an arrangement, however, the actuator 350 may be configured solely to open a valve (i.e., at least a portion of the "heat-emitting element 375") associated with the heat precursor source 200 to release the heat precursor substance 250 therefrom, wherein actuation of the actuator 350 may also actuate the igniter arrangement 325 to provide a spark or other impetus for igniting the pressurized combustible fuel 250 released from the heat precursor source 200 via the heat emitting element 375 of the heating arrangement 300, to produce the flame/heat 500 for igniting the discrete ignitable article 150 (i.e., smoking article). In this exemplary aspect, the sensory precursor source 400 may be configured as a compartment for receiving and containing a sensory precursor substance 450 comprising, for example, an aromatic or flavored solid (i.e., a wax or other resin material). The solid sensory precursor substance 450 may be consumable in response to and in interaction with heat/flame, or may otherwise be non-consumable in response to heat/flame. Further, the sensory precursor substance 450 may have an elongate rod-like configuration, and be configured to be received by the sensory precursor source 400 to extend outwardly thereof such that a distal end 1200 thereof is in proximity with the heat-emitting element 375. In some instances, an adjustment arrangement (not shown, but see, e.g., the thumbscrew shown in FIG. 8) may be engaged with the sensory precursor substance 450 and configured to adjustably extend the rod from the sensory precursor source 400 and to retract the rod toward and into the sensory precursor source 400. In this manner, the distal end 1200 of the rod may be optimally positioned with respect to the proximity to the heat-emitting element 375. The lighting end 160 of the smoking article 150 may then be ignited via actuation of the heat-emitting element 375, and the emitted sensory precursor substance 550 brought into engagement therewith, as previously disclosed in regard to other aspects herein.

Figure 13:
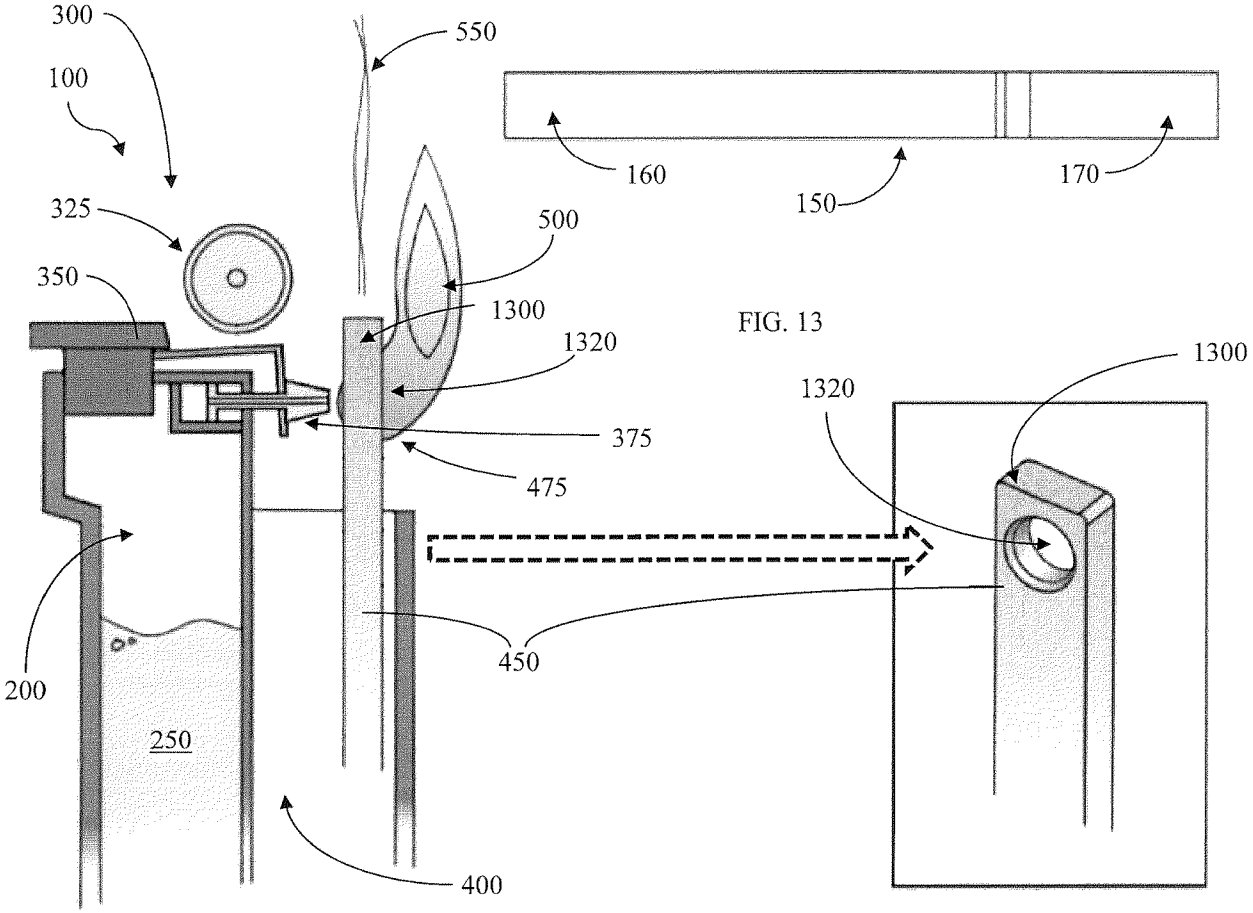
Figure 14:
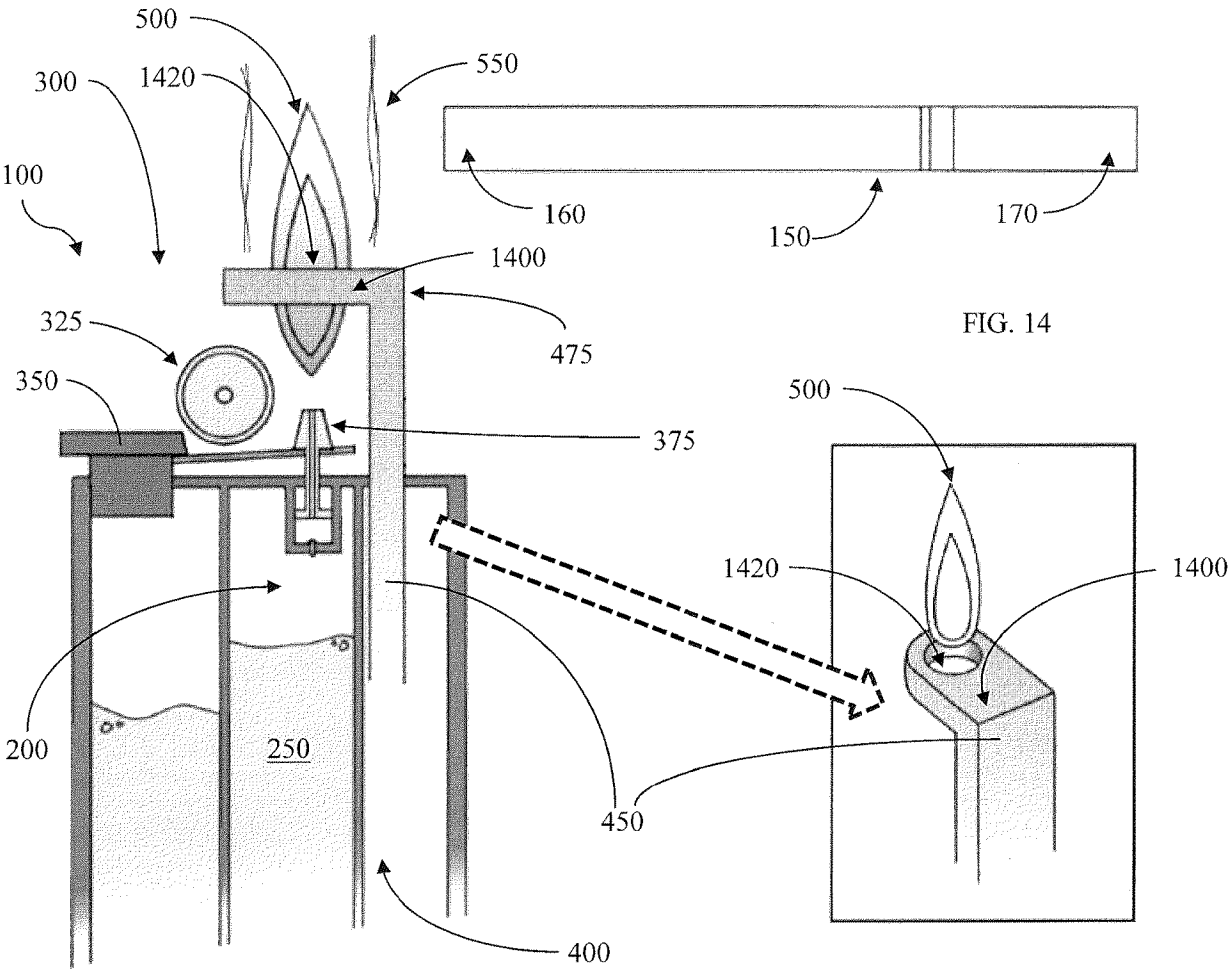

FIGS. 13 and 14 schematically illustrate still further example arrangements of an igniter apparatus 100 similar to the arrangement shown in FIG. 12. In each such arrangement, the sensory precursor source 400 may be configured as a compartment for receiving and containing a sensory precursor substance 450 comprising, for example, an aromatic or flavored solid (i.e., a wax or other resin material). The solid sensory precursor substance 450 may be consumable in response to and in interaction with heat/flame, or may otherwise be non-consumable in response to heat/flame. Further, the sensory precursor substance 450 may have an elongate rod-like configuration, and be configured to be received by the sensory precursor source 400 to extend outwardly thereof such that a distal end 1300, 1400 thereof is in proximity with the heat-emitting element 375. In some instances, the rod may define an orifice 1320, 1420 about the distal end 1300, 1400 thereof, wherein the orifice 1320, 1420 may be arranged such that the flame emitted by the heat-emitting element 375 is directed therethrough. In this manner, the lighting end 160 of the smoking article 150 may be ignited on the opposing side of the rod (i.e., through the orifice 1320, 1420) from the heat-emitting element 375, wherein the heat associated with the flame may be able to interact with the sensory precursor substance 450 about the perimeter thereof. In some aspects, an adjustment arrangement (not shown, but see, e.g., the thumbscrew shown in FIG. 8) may be engaged with the sensory precursor substance 450 and configured to adjustably extend the rod from the sensory precursor source 400 and to retract the rod toward and into the sensory precursor source 400. In this manner, the orifice 1320, 1420 defined by the distal end 1300, 1400 of the rod may be optimally positioned with respect to the proximity to the heat-emitting element 375. The lighting end 160 of the smoking article 150 may thus be ignited via actuation of the heat-emitting element 375, and the emitted sensory precursor substance 550 brought into engagement therewith, as previously disclosed in regard to other aspects herein.

Figure 15:
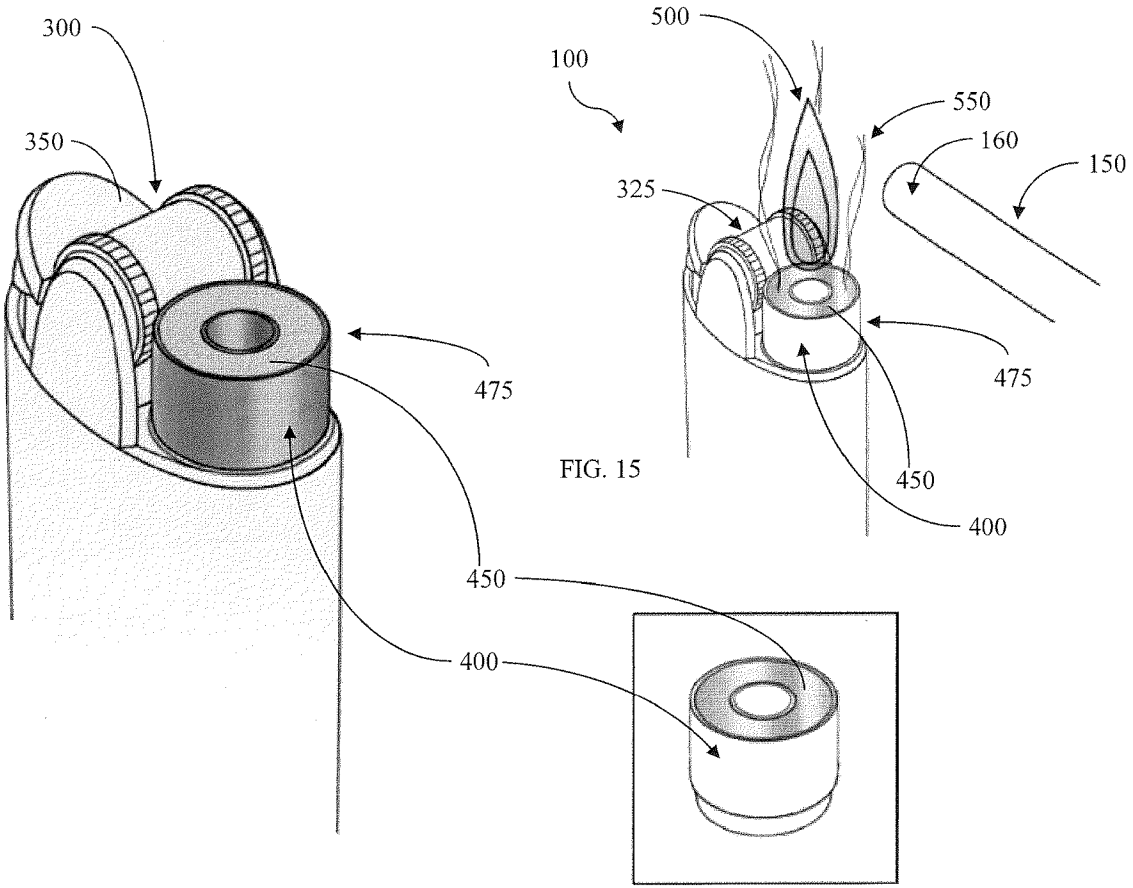

FIG. 15 schematically illustrates another example arrangement of an igniter apparatus 100 similar to the arrangements shown in FIGS. 13 and 14. In such an arrangement, however, the actuator 350 may be configured solely to open a valve (i.e., at least a portion of the "heat-emitting element 375") associated with the heat precursor source 200 to release the heat precursor substance 250 therefrom, wherein actuation of the actuator 350 may also actuate the igniter arrangement 325 to provide a spark or other impetus for igniting the pressurized combustible fuel 250 released from the heat precursor source 200 via the heat-emitting element 375 of the heating arrangement 300, to produce the flame/heat 500 for igniting the discrete ignitable article 150 (i.e., smoking article). In this exemplary aspect, the sensory precursor source 400 may be configured as a housing for receiving and containing a sensory precursor substance 450 comprising, for example, an aromatic or flavored solid (i.e., a wax or other resin material). The solid sensory precursor substance 450 may be consumable in response to and in interaction with heat/flame, or may otherwise be non-consumable in response to heat/flame. Further, the sensory precursor source 400, containing the sensory precursor substance 450, may be configured and arranged to form a tubular element. In some instances, the tubular element may include concentric inner and outer walls, wherein the sensory precursor substance 450 may be disposed between the concentric inner and outer walls. In other instances, the tubular element may include an outer wall for receiving a generally tubular form of the sensory precursor substance 450 (i.e., the sensory precursor substance 450 is formed and shaped to provide a tubular element which is received within an outer cylinder. In either instance, the sensory precursor source 400/sensory precursor substance 450 may be configured to be received by the igniter apparatus 100 so as to surround the heat-emitting element 375. That is, the sensory precursor source 400/sensory precursor substance 450 can be attached to or otherwise incorporated into the igniter apparatus 100 such that the heat-emitting element 375 is arranged to direct the heat/flame through the inner wall of the tubular element, or through the orifice defined by the tubular sensory precursor substance 450. The lighting end 160 of the smoking article 150 may then be ignited via actuation of the heat-emitting element 375 and the heat/flame extending through the inner wall of the tubular element, or through the orifice defined by the tubular sensory precursor substance 450, and the emitted sensory precursor substance 550 brought into engagement therewith, as previously disclosed in regard to other aspects herein. In such an exemplary aspect, an appropriate sensory precursor substance 450/sensory precursor source 400 may include a matrix comprising, for instance, sepiolite, an alumina composite, an adsorbent graphite composite, paraffin wax, or combinations thereof, wherein the matrix may further incorporate a flavorful or aromatic substance that may be actuated by exposure to heat/flame (i.e., an oil such as peppermint oil or spearmint oil; or a solid or composite such as ethyl vanillin glucoside which releases the ethyl vanillin flavor upon heat decomposition of the glucoside). Additionally, the sensory precursor substance 450/sensory precursor source 400 may also have the form of a suitably modified and adapted fragrance gel-type of material, such as those types of fragrance gel compositions referenced, discussed and disclosed in US Pat. App Pub. Nos. 2010/0221207 to Watkins et al., 2012/0091218 to Mikkelsen et al., 2013/0202788 to Mikkelsen et al. and 2013/0157922 to Mikkelsen et al.; each of which are incorporated herein by reference. See also, those types of fragrance gel types of materials that are commercially available from sources such as The Dial Corporation.

Figure 16:
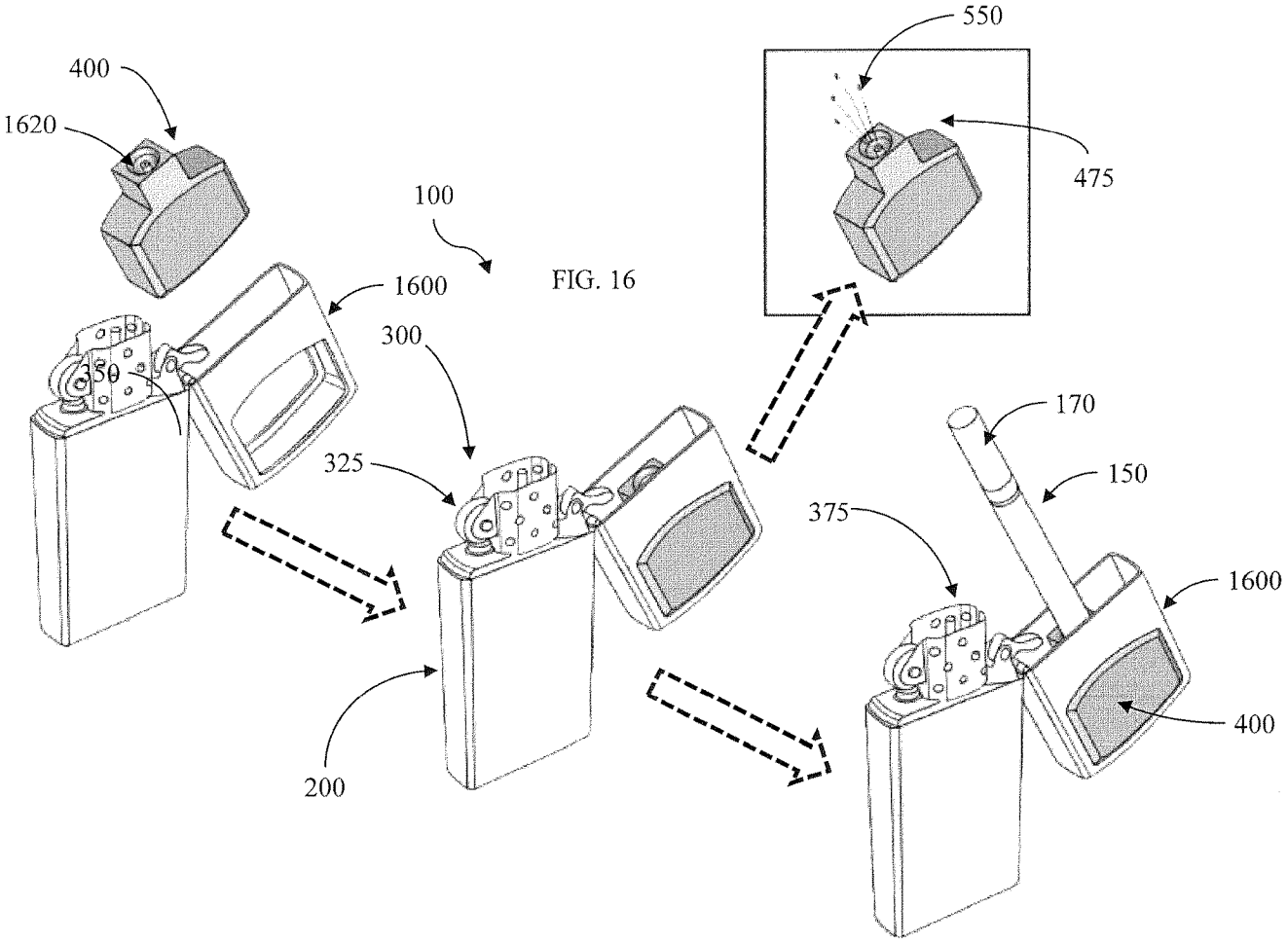

FIG. 16 schematically illustrates another example arrangement of an igniter apparatus 100 similar to the arrangement shown in FIGS. 9-11. In such an arrangement, however, the actuator 350 may be configured solely to open a valve (i.e., at least a portion of the "heat-emitting element 375") associated with the heat precursor source 200 to release the heat precursor substance 250 therefrom, wherein actuation of the actuator 350 may also actuate the igniter arrangement 325 to provide a spark or other impetus for igniting the pressurized combustible fuel 250 released from the heat precursor source 200 via the heat emitting element 375 of the heating arrangement 300, to produce the flame/heat 500 for igniting the discrete ignitable article 150 (i.e., smoking article). That is, the igniter apparatus 100 may be similar to a conventional cigarette lighter. In some instances, the igniter apparatus 100 preferably includes a "flip open" lid 1600. In such instances, aspects of the present disclosure may implement a sensory precursor source 400 configured to be received within the lid 1600. The sensory precursor source 400 may be configured as a pressurized reservoir for containing a sensory precursor substance 450 comprising, for example, an aromatic or flavored liquid. In other instances, the reservoir may be pressurizable (i.e., a "squeeze" type pressurization configuration). The lid 1600 and/or the reservoir may be configured such that the reservoir is removable/replaceable (i.e., disposable). In such instances, the sensory precursor-emitting element 475 may include a receptacle 1620 for receiving the lighting end 160 or mouth end 170 of the smoking article 150. Disposed within the receptacle 1620 may be a valve separating the receptacle 1620 from the sensory precursor source 400. The valve may be configured such that insertion of the lighting end 160 or mouth end 170 of the smoking article 150, and urging the lighting end 160/mouth end 170 toward the sensory precursor source 400 and against the valve, manually depresses (opens) the valve to cause dispensation of the pressurized sensory precursor substance 450 directly into engagement with the lighting end 160/mouth end 170 of the smoking article 150. In other instances, the lighting end 160/mouth end 170 may be brought into engagement with the valve, and a separate actuator used to actuate the valve to release the sensory precursor substance 450 (i.e., the user squeezing the reservoir may cause the sensory precursor substance 450 to be dispensed through the valve). The smoking article 150 may then be withdrawn from the receptacle 1620, and then the lighting end 160 ignited via actuation of the heat-emitting element 375, as previously disclosed in regard to other aspects.

Figure 17:
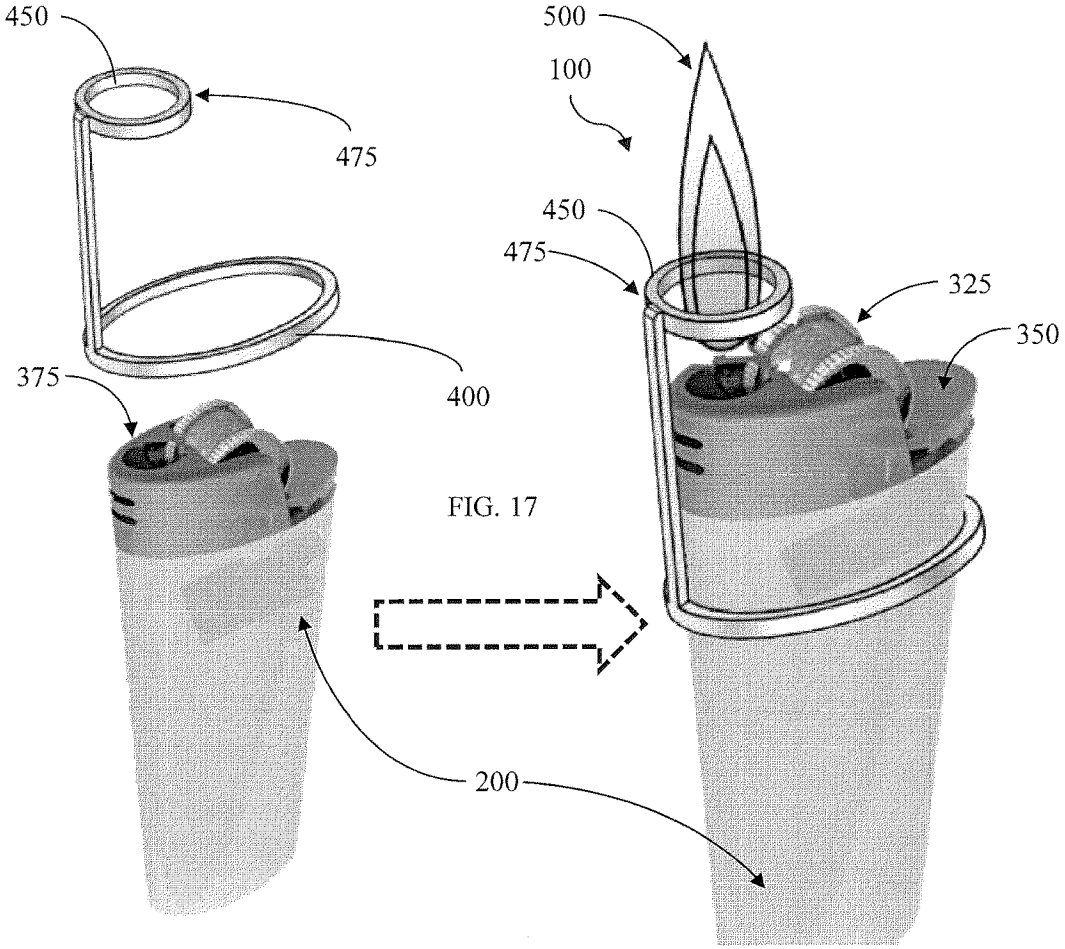

FIG. 17 schematically illustrates another example arrangement of an igniter apparatus 100 similar to the arrangement shown in FIG. 15. In such an arrangement, however, the sensory precursor source 400 may be configured as a discrete assembly for receiving and containing a sensory precursor substance 450 comprising, for example, an aromatic or flavored solid (i.e., a gel, wax or other resin material). The solid sensory precursor substance 450 may be consumable in response to and in interaction with heat/flame, or may otherwise be non-consumable in response to heat/flame. Further, the sensory precursor source 400 may be configured and arranged to be received by the igniter apparatus 100 (i.e., a conventional cigarette lighter) as an accessory. Otherwise, the sensory precursor source 400 may be configured to receive a particular configuration of a conventional cigarette lighter. For example, the sensory precursor source 400 may be configured as a ring, snap clip, or other (removable) mechanical securement arrangement that may be engaged with and secured to a conventional cigarette lighter in a desired position and in an unobtrusive manner. The securement arrangement may further include an extension member extending therefrom toward the heat-emitting element 375 of the cigarette lighter. The sensory precursor substance 450 may be formed, for example, as a tubular element, a rod-like element, or in any other suitable configuration, and secured to the extension member so as to be disposed in proximity to the heat-emitting element 375. In some instances, the sensory precursor substance 450 may be engaged with or otherwise contained by a supporting structure, wherein the supporting structure is engaged with the extension member (instead of the sensory precursor substance 450 being directly engaged with the extension member). In one particular example, the sensory precursor source 400/sensory precursor substance 450 can be attached to or otherwise incorporated into the igniter apparatus 100 such that the heat-emitting element 375 is arranged to direct the heat/flame through an orifice defined by the sensory precursor substance 450 in a ring-like form. The lighting end 160 of the smoking article 150 may then be ignited via actuation of the heat-emitting element 375 and the heat/flame extending through the orifice defined by the ring including the sensory precursor substance 450, and the emitted sensory precursor substance brought into engagement therewith, as previously disclosed in regard to other aspects herein.

Figure 18:
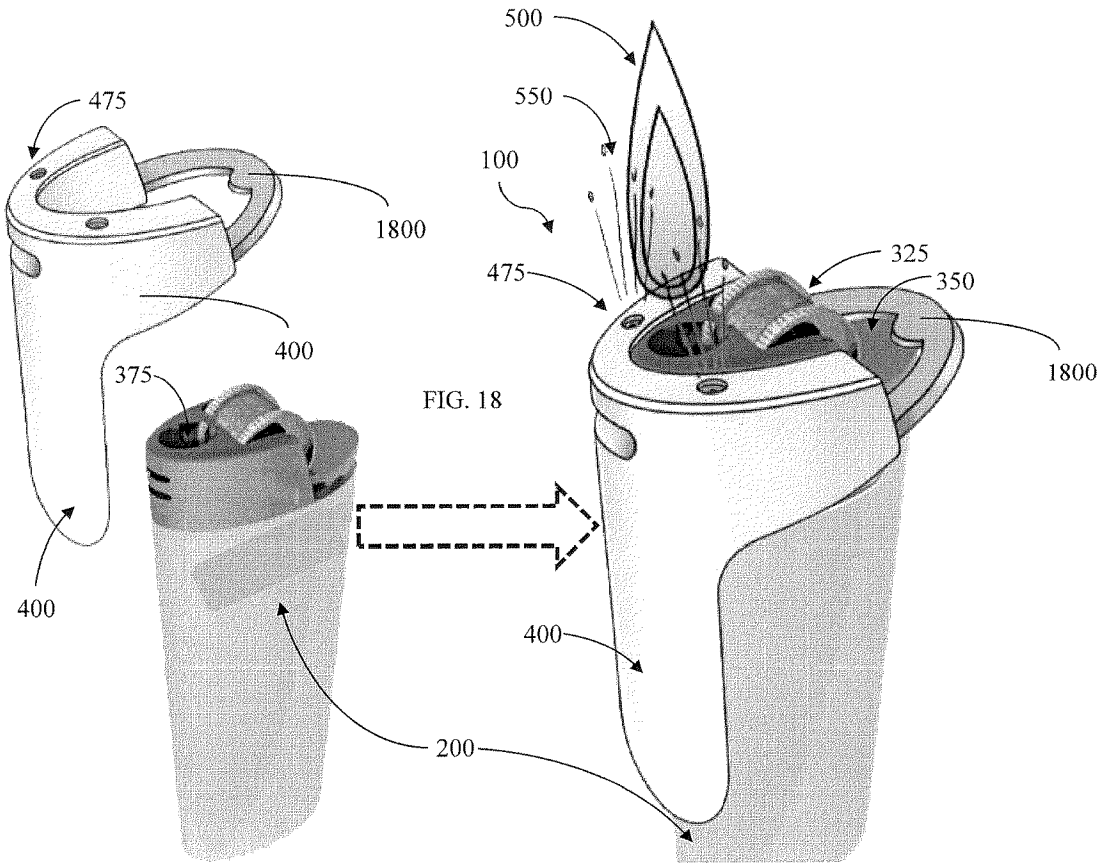

FIG. 18 schematically illustrates still another example arrangement of an igniter apparatus 100 similar to the arrangement shown in FIG. 17. In such an arrangement, however, the sensory precursor substance 450 may be in a liquid form, and the sensory precursor source 400 may be configured as a discrete assembly for receiving and containing a sensory precursor substance 450. Further, the sensory precursor source 400 may be configured and arranged to be received by the igniter apparatus 100 (i.e., a conventional cigarette lighter) as an accessory. Otherwise, the sensory precursor source 400 may be configured to receive a particular configuration of a conventional cigarette lighter. For example, the sensory precursor source 400 may be configured as or may include a ring, snap clip, or other (removable) mechanical securement arrangement that may be engaged with and secured to a conventional cigarette lighter in a desired position and in an unobtrusive manner. In instances where the sensory precursor substance 450 is a liquid, aerosol, etc., the sensory precursor source 400 may further include an actuator 1800 configured to release the sensory precursor substance 450 from the sensory precursor source 400 via the sensory-precursor-emitting element 475 and into proximity with the heat-emitting element 375 of the cigarette lighter. The sensory precursor source 400 may be formed, for example, as a "C" shaped housing or other suitable contour for extending at least partially about the heat-emitting element 375 of the cigarette lighter, while including a suitable reservoir for containing the sensory precursor substance 450 in liquid form. The sensory-precursor-emitting element(s) 475 may further be configured and arranged with respect to the sensory precursor source 400 so as to be disposed in proximity to the heat-emitting element 375. When the sensory precursor source 400 is attached to or otherwise engaged with the cigarette lighter, the actuator 1800 may be configured and arranged to extend into operable engagement with the actuator 350 for the heat-emitting element 375. For example, and as shown, the actuator 1800 for the sensory-precursor-emitting element 475 may be configured to extend into contact with the actuator 350 for the heat-emitting element 375, and to have a substantially similar actuation configuration. As such, actuation of the actuator 350 for the heat-emitting element 375 will also simultaneously actuate the actuator 1800 for the sensory-precursor-emitting element 475 such that the sensory precursor substance 450 is emitted in conjunction with the heat/flame from the heat-emitting element 375. The lighting end 160 of the smoking article 150 may then be ignited via actuation of the heat-emitting element 375, and the emitted sensory precursor substance brought into engagement therewith, as previously disclosed in regard to other aspects herein.

Figure 19:
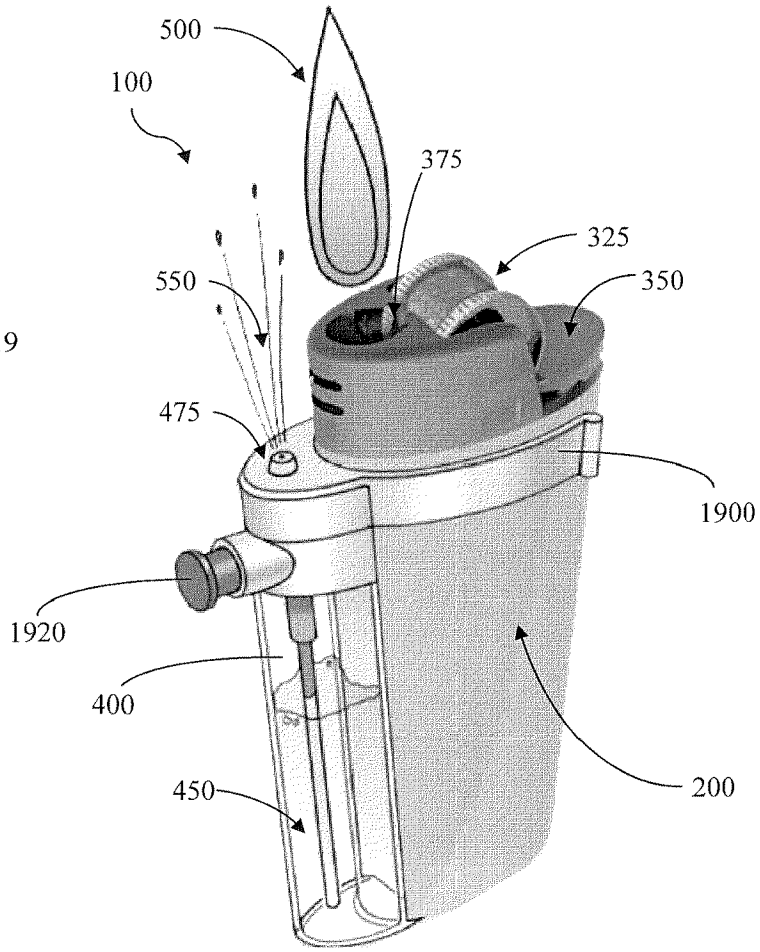

FIG. 19 schematically illustrates yet another example arrangement of an igniter apparatus 100 similar to the arrangement shown in FIG. 18. In such an arrangement, the sensory precursor source 400 may be configured as or may include a ring, snap clip, or other (removable) mechanical securement arrangement 1900 that may be engaged with and secured to a conventional cigarette lighter in a desired position and in an unobtrusive manner. In instances where the sensory precursor substance 450 is a liquid, aerosol, etc., the sensory precursor source 400 may further include an actuator 1920 configured to release the sensory precursor substance 450 from the sensory precursor source 400 via the sensory-precursor-emitting element 475 and into proximity with the heat-emitting element 375 of the cigarette lighter. The sensory precursor source 400 may be formed, for example, as a "C" shaped housing or other suitable contour for extending at least partially in proximity to the heat-emitting element 375 of the cigarette lighter, while including a suitable reservoir for containing the sensory precursor substance 450 in liquid form. The sensory-precursor-emitting element(s) 475 may particularly be configured and arranged with respect to the sensory precursor source 400 so as to be disposed in proximity to the heat-emitting element 375. However, when the sensory precursor source 400 is attached to or otherwise engaged with the cigarette lighter, the actuator 1920 may be configured and arranged to require a separate and discrete actuation from the actuator 350 for the heat-emitting element 375. For example, and as shown, the actuator 1920 for the sensory-precursor-emitting element 475 may be disposed opposite to and separate from the actuator 350 for the heat-emitting element 375, such that the user can selectively actuate the actuator 1920 for the sensory-precursor-emitting element 475 such that the sensory precursor substance 450 is only emitted, on demand, into interaction with the heat/flame from the heat-emitting element 375. The lighting end 160 of the smoking article 150 may thus be ignited via actuation of the heat-emitting element 375, and the emitted sensory precursor substance selectively and on demand brought into engagement therewith, as previously disclosed in regard to other aspects herein.

Figure 20:
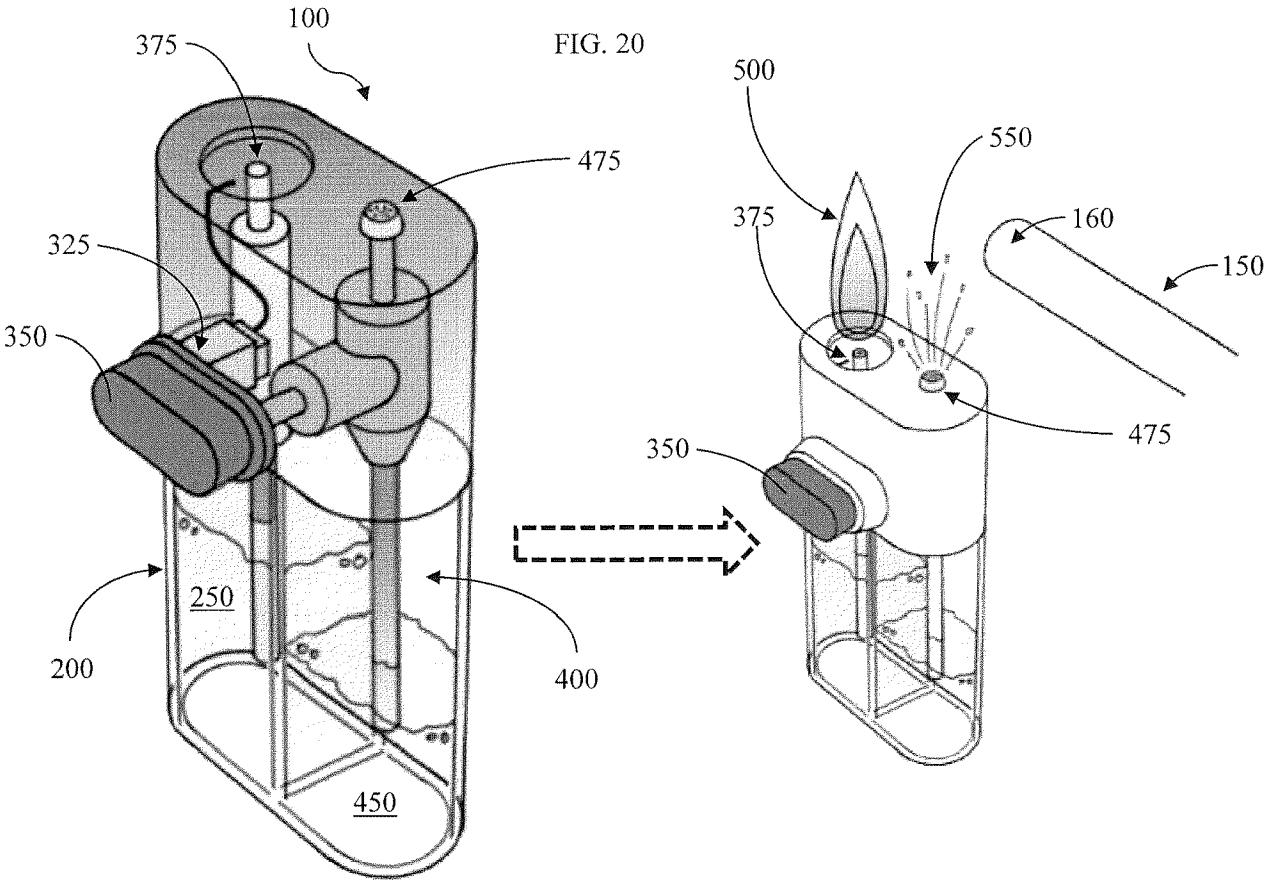

FIG. 20 schematically illustrates yet another example arrangement of an igniter apparatus 100 similar to the arrangement shown in FIG. 3. In such an aspect, the igniter apparatus 100 may comprise, for example, a conventional lighter, having a heat precursor source 200 configured as a pressurized reservoir for containing a heat precursor substance 250 comprising a combustible fuel such as, for example, butane. The heating arrangement 300 generally comprises an actuator 350, wherein, upon actuation, the actuator 350 may be configured to open a valve (i.e., at least a portion of the "heat-emitting element 375") associated with the heat precursor source 200 to release the heat precursor substance 250 therefrom. Actuation of the actuator 350 may also actuate an igniter arrangement 325, comprising, for example, a piezoelectric igniter, to provide a spark or other impetus for igniting the pressurized combustible fuel 250 released from the heat precursor source 200 via the heat emitting element 375 of the heating arrangement 300, to produce the flame/heat 500 for igniting the discrete ignitable article 150 (i.e., smoking article). The igniter apparatus 100 may also include a sensory precursor source 400 configured as a pressurized reservoir for containing a sensory precursor substance 450 comprising, for example, an aromatic or flavored liquid. In such instances, actuation of the actuator 350 may also open a valve (i.e., at least a portion of the "sensory precursor-emitting element 475") associated with the sensory precursor source 400 to release the sensory precursor substance 450 therefrom and into interaction with the flame/heat 500 emitted by the heat-emitting element 375. The sensory precursor-emitting element 475 may be configured in different manners. For example, in some instances, the sensory precursor-emitting element 475 may comprise, a spray pump, whether manual or electrically-operated, dispensing the sensory precursor substance 450 from the sensory precursor source 400 through a spray nozzle to emit the sensory precursor substance 450 in proximity to the heat-emitting element 375. The emitted sensory precursor substance (i.e., an aerosol 550 of the sensory precursor substance 450) may be actuated or not actuated by interaction with the heat to produce the perceptible sensory effect. Once released from the sensory precursor source 400, the emitted sensory precursor substance 550 may be delivered to the ignitable article (i.e., smoking article) 150, for instance, by the pressurization in the sensory precursor source 400 released through the sensory precursor-emitting element 475, or by suction imparted to and through the smoking article 150 by the user and into interaction with the emitted sensory precursor substance 550. In some instances, the interaction of the emitted sensory precursor substance 550 with the heat/flame may create a propellant force for urging the emitted sensory precursor substance 550 into engagement with the ignitable article (smoking article) 150.

Figure 21:
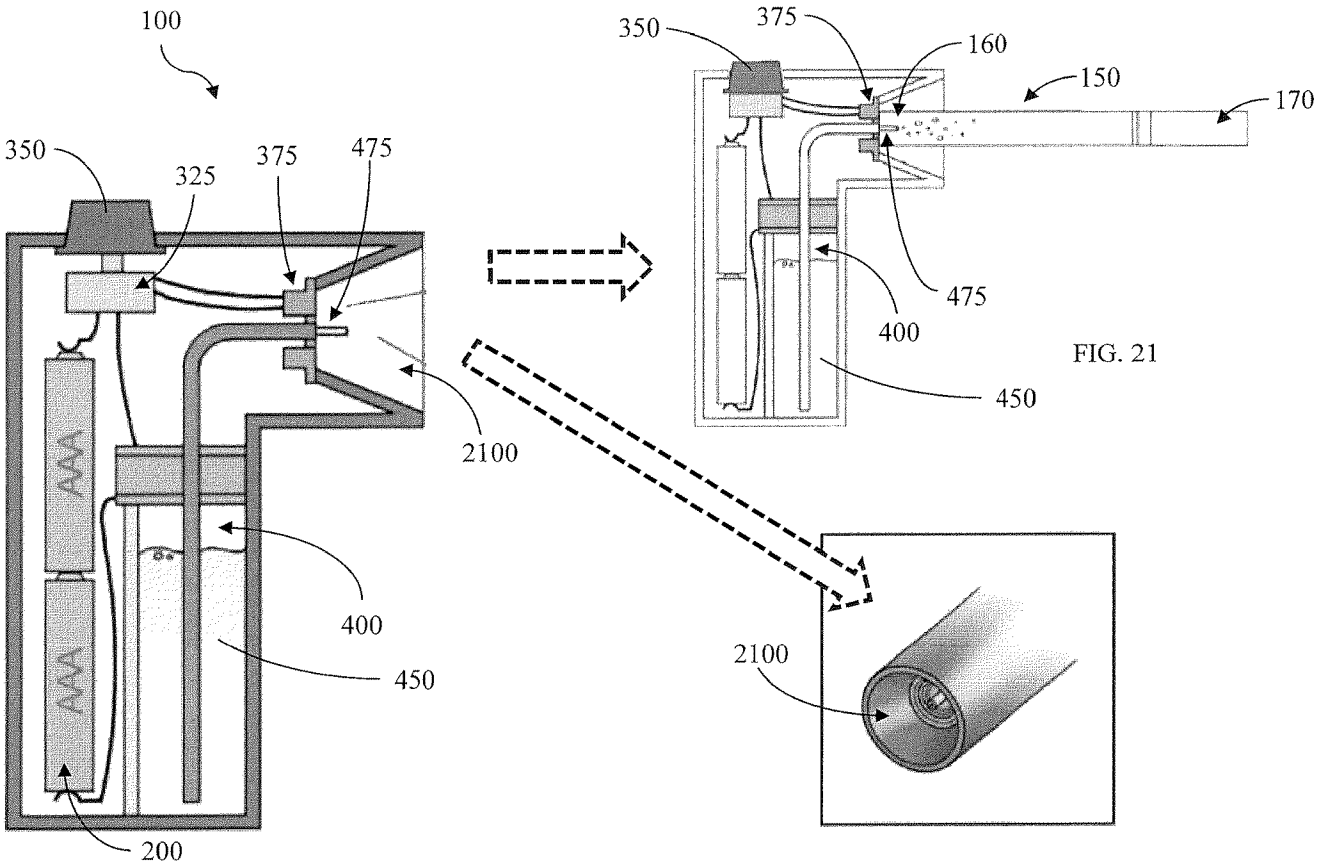

FIG. 21 schematically illustrates yet another example arrangement of an igniter apparatus 100 similar to the arrangement shown in FIG. 20. In such an aspect, the heat-emitting element 375 of the igniter apparatus 100 may comprise, for example, a resistive heating element, and the heat precursor source 200 may comprise, for instance, one or more batteries or other suitable electrical power source. The heating arrangement 300 may comprise an actuator 350, wherein, upon actuation, the actuator 350 may be configured to actuate electrical circuitry and/or the resistive heating element (i.e., at least a portion of the "igniter arrangement 325" or "heat-emitting element 375") associated with the heat precursor source 200 (i.e., batteries), and to release the heat precursor substance 250 (i.e., electrical current) therefrom, wherein the electrical current is then directed to the resistive heating element. The electrical current directed to the resistive heating element may thus produce the heat 500 for igniting the discrete ignitable article 150 (i.e., smoking article). The igniter apparatus 100 may also include a sensory precursor source 400 configured as a reservoir for containing a sensory precursor substance 450 comprising, for example, an aromatic or flavored liquid. In such instances, actuation of the actuator 350 may also actuate electrical circuitry and/or an electrically-operated pump (i.e., at least a portion of the "sensory precursor-emitting element 475") associated with the sensory precursor source 400, via the battery(ies) or other power source, to direct the sensory precursor substance 450 from the reservoir and into interaction with the heat 500 emitted by the heat-emitting element 375. In instances where the sensory precursor-emitting element 475 comprises an electrically-operated pump, the sensory precursor substance 450 may be dispensed from the sensory precursor source 400 through a spray nozzle to emit the sensory precursor substance 450 in proximity to the heat-emitting element 375. The emitted sensory precursor substance (i.e., an aerosol 550 of the sensory precursor substance 450) may be actuated or not actuated by interaction with the heat to produce the perceptible sensory effect. Once released from the sensory precursor source 400, the emitted sensory precursor substance 550 may be delivered to the ignitable article (i.e., smoking article) 150, for instance, by the pressurization in the sensory precursor source 400 released through the sensory precursor-emitting element 475, or by suction imparted to and through the smoking article 150 by the user and into interaction with the emitted sensory precursor substance 550. In some instances, the interaction of the emitted sensory precursor substance 550 with the heat may create a propellant force for urging the emitted sensory precursor substance 550 into engagement with the ignitable article (smoking article) 150. In some instances, similarly to the aspects shown in FIG. 4, the heat-emitting element 375 (i.e., the resistive heating element) and the sensory-precursor-emitting element 475 (i.e., the spray nozzle) may be disposed in a receptacle 2100 configured to receive the lighting end 160 of the smoking article 150, for ignition thereof and/or for delivery of the emitted sensory precursor substance 550 (and associated perceptible sensory effect) thereto through direct contact therebetween.

Figure 22:
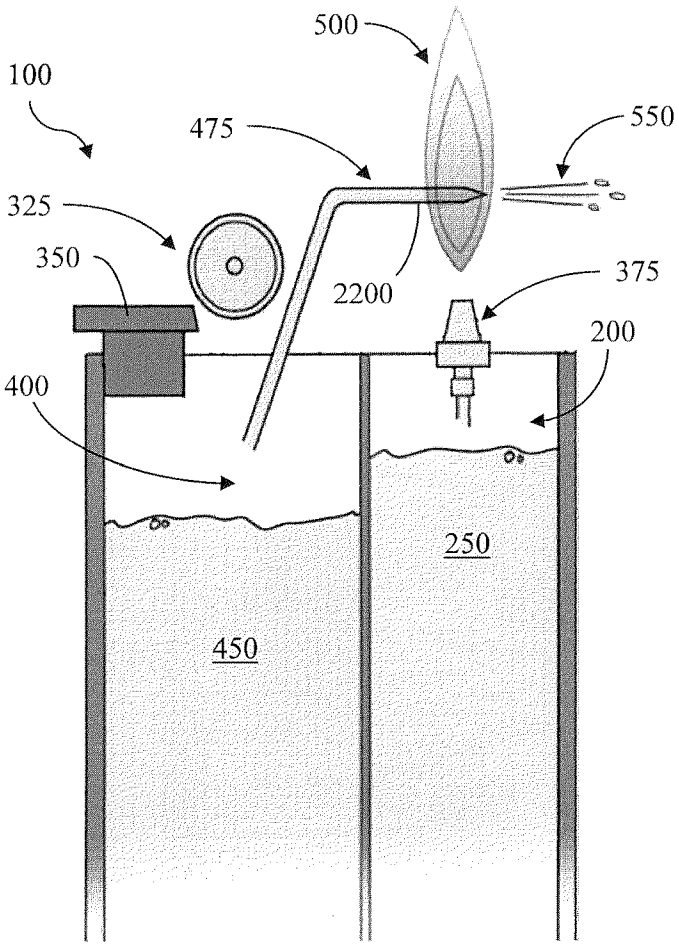

FIG. 22 schematically illustrates a further arrangement aspect of an igniter apparatus 100 similar to the arrangement shown in FIG. 3. The igniter apparatus 100 may comprise, for example, a conventional lighter, having a heat precursor source 200 configured as a pressurized reservoir for containing a heat precursor substance 250 comprising a combustible fuel such as, for example, butane. The heating arrangement 300 generally comprises an actuator 350, wherein, upon actuation, the actuator 350 may be configured to open a valve (i.e., at least a portion of the "heat-emitting element 375") associated with the heat precursor source 200 to release the heat precursor substance 250 therefrom. Further, actuation of the actuator 350 may also actuate the igniter arrangement 325 to provide a spark or other impetus for igniting the pressurized combustible fuel 250 released from the heat precursor source 200 via the heat emitting element 375 of the heating arrangement 300, to produce the flame/heat 500 for igniting the discrete ignitable article 150 (i.e., smoking article). The igniter apparatus 100 may also include a sensory precursor source 400 configured as a pressurized reservoir for containing a sensory precursor substance 450 comprising, for example, an aromatic or flavored liquid. In such instances, actuation of the actuator 350 may also open a valve (i.e., at least a portion of the "sensory precursor-emitting element 475") associated with the sensory precursor source 400 to release the sensory precursor substance 450 therefrom and into interaction with the flame/heat 500 emitted by the heat-emitting element 375. In such aspects, the sensory precursor-emitting element 475 may include an injector member 2200 extending from the sensory precursor source 400 and into proximity to (or extending through) the flame/heat emitted by the heat-emitting element 375 (the injector member 2200 may also be configured to be movable into proximity to (or extending through) the flame/heat emitted by the heat-emitting element 375), such that, for example, the heat/flame warms the sensory precursor substance 450 within the injector member 2200 and facilitates injection of the sensory precursor substance 450 into the smoking article 150. The injector member 2200 may be configured to be received within the lighting end 160 of the smoking article 150 (i.e., in order for the lighting end 160 to be inserted into the emitted heat/flame, the lighting end 160 must be positioned such that the distal end of the injector member 2200 is received therein). In some instances, the injector member 2200 may include an alignment aide (not shown) to facilitate centering of the injector member 2200 in the lighting end 160 and/or limiting the extent to which the injector member 2200 can be inserted into the smoking article 150 through the lighting end 160. In some instances, the sensory precursor source 400 may comprise a replaceable cartridge or the like, wherein the sensory-precursor-emitting element 475 may at least in part support such replaceability of the reservoir for the sensory precursor substance 450. The emitted sensory precursor substance (i.e., an aerosol 550 of the sensory precursor substance 450) may be actuated or not actuated by interaction with the heat to produce the perceptible sensory effect. Once released from the sensory precursor source 400 via the injector member 2200, the emitted sensory precursor substance 550 may be delivered directly into the smoking article 150, for instance, by the pressurization in the sensory precursor source 400 released through the sensory precursor-emitting element 475, or by suction imparted to and through the smoking article 150 by the user and into interaction with the emitted sensory precursor substance 550. In some instances, the interaction of the emitted sensory precursor substance 550 with the heat/flame may create a propellant force for urging the emitted sensory precursor substance 550 into engagement with the ignitable article (smoking article) 150.

Figure 23:
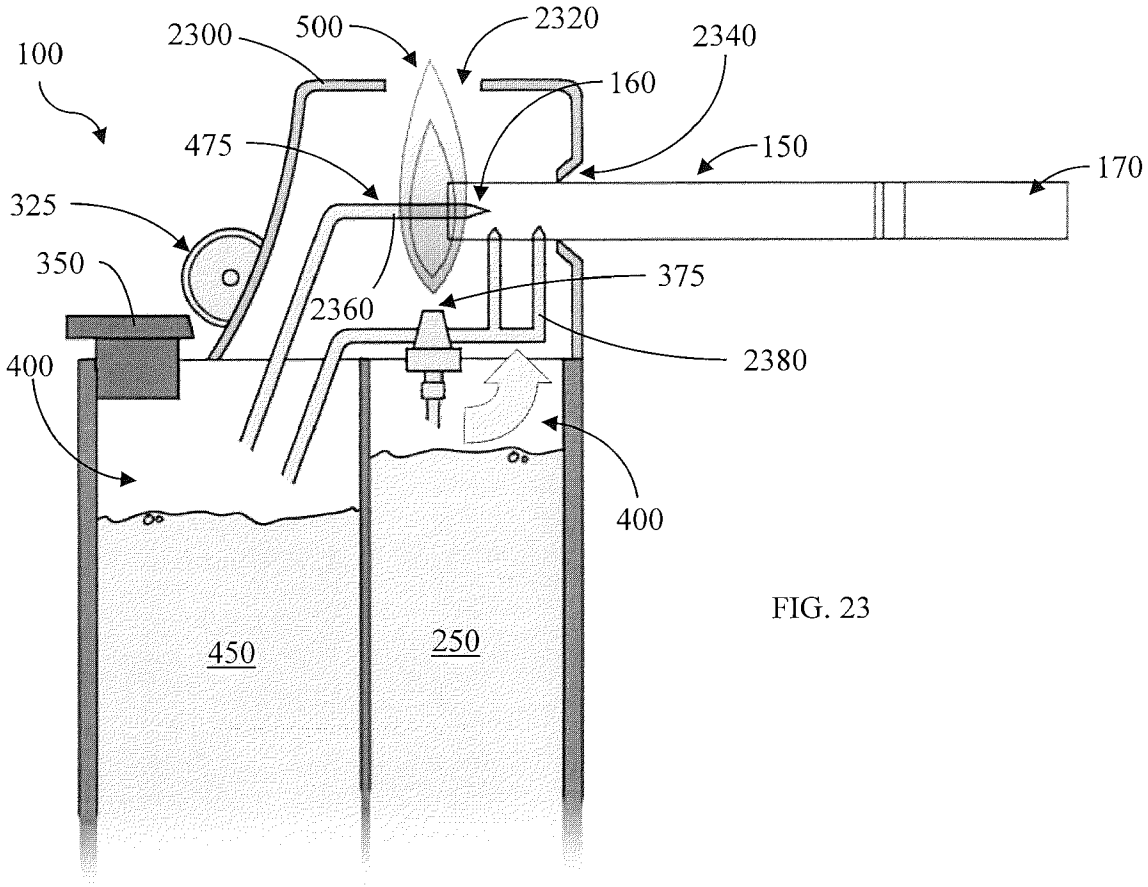

FIG. 23 schematically illustrates another arrangement aspect of an igniter apparatus 100 similar to the arrangement shown in FIG. 22. In such instances, the igniter apparatus 100 may further include a lighting chamber 2300 extending to cover the heat-emitting element 375 and the sensory-precursor-emitting element 475. The lighting chamber 2300 may define a lighting port 2320 generally aligned with the flame/heat 500 emitted by the heat-emitting element 375. Accordingly, the lighting port 2320 may be used if the igniter apparatus 10 is used only for ignition purposes. The lighting chamber 2300 may also define a sensory precursor port 2340 generally aligned with the sensory precursor-emitting element 475, which may be in the form of an injector member 2360, as otherwise disclosed herein in relation to FIG. 22. The sensory precursor port 2340 may this facilitate alignment of the lighting end 160 of the smoking article 150 with the injector member 2360. As disclosed in regard to FIG. 22, the actuator 350 may be configured to actuate valves associated with the sensory precursor source 400/sensory precursor-emitting element 475 and the heat precursor source 200/heat-emitting element 375. In some instances, the actuator 350 may thus be implemented to provide further actuation functions. For example, the actuator 350 may further be configured to actuate (mechanically or otherwise) one or more supplemental injectors 2380 configured to pierce and enter a lateral or side surface of the smoking article 150, instead of or in addition to the injector member 2360 extending longitudinally into the smoking article 150 through the lighting end 160. Actuating the supplemental injector(s) 2380 into engagement with the smoking article 150 may further actuate a valve in communication with the sensory precursor source 400 to release the sensory precursor substance 450 through the supplemental injector(s) 2380 and directly into the smoking article 150. In other instances, actuation of the actuator 350 may also actuate a pump (not shown) to pump the sensory precursor substance 450 through the supplemental injector(s) 2380.

Figure 24:
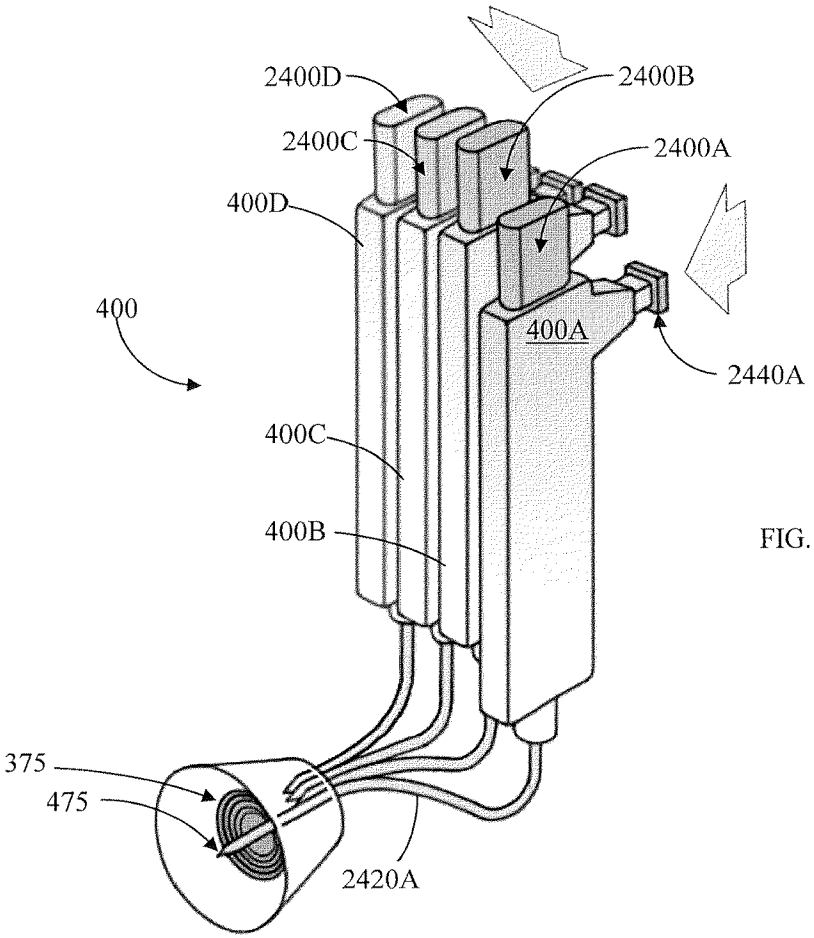

FIG. 24 schematically illustrates another arrangement aspect of an igniter apparatus 100 similar to the arrangement shown in FIG. 21. In such instances, the igniter apparatus 100 may implement two or more selectable sensory precursor sources (e.g., 400A, 400B, 400C, 400D). The desired sensory precursor source may be selected by an associated selector (i.e., 2400A, 2400B, 2400C, 2400D). Upon selection of a desired sensory precursor source (i.e., 400A) by actuation of the associated selector (i.e., 2400A), a corresponding sensory precursor-emitting element 475 (i.e., injector member 2420A) may be actuated for cooperating with the heat-emitting element 375 to dispense the corresponding sensory precursor substance 450. In other instances, a common injector member may be implemented, with the selectable sensory precursor sources (e.g., 400A, 400B, 400C, 400D) being in communication therewith, such that the selected sensory precursor source (i.e., 400A) directs the corresponding sensory precursor substance to that common injector member. Upon selecting the desired sensory precursor source (i.e., 400A), the corresponding sensory precursor substance may be dispensed, for example, by a manual pump dispenser mechanism (i.e., 2440A), wherein each manual pump or actuation thereof causes the dispensation of a selected amount of the corresponding sensory precursor substance through the injector member (i.e., 2420A).

Figure 25:
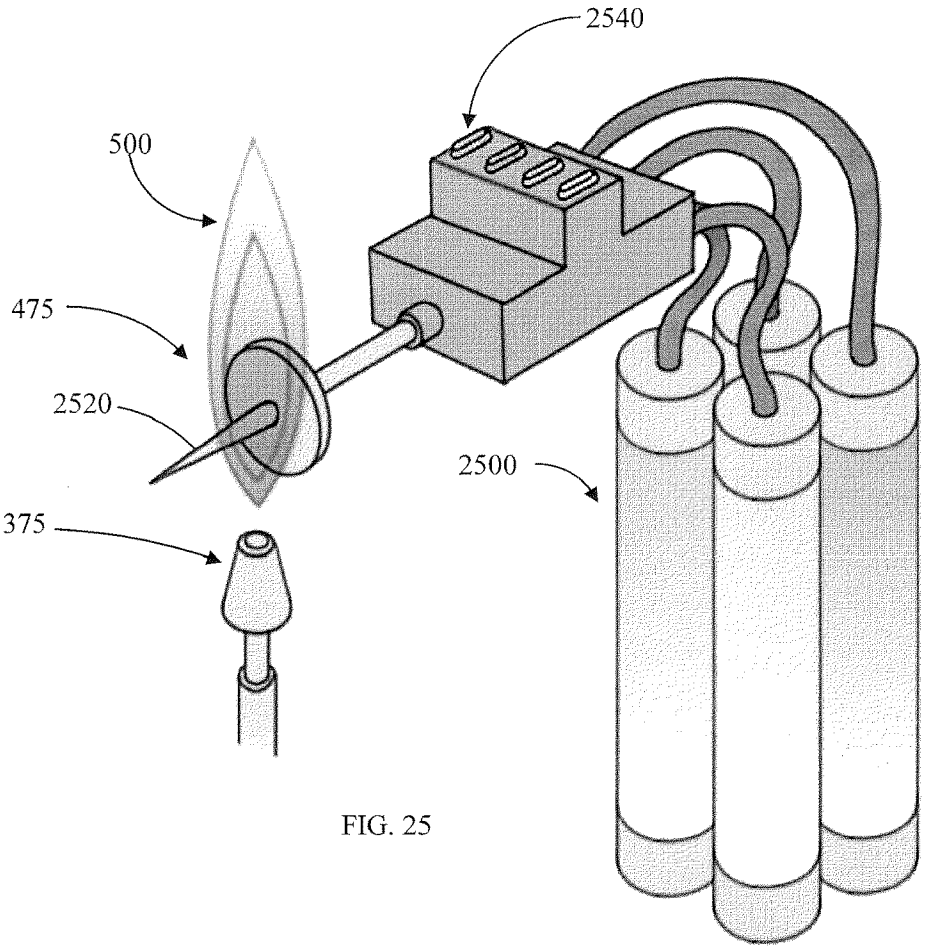

FIG. 25 schematically illustrates another arrangement aspect of an igniter apparatus 100 similar to the arrangement shown in FIGS. 22 and 24. In such instances, the selectable sensory precursor sources 2500 may comprise, for example, pressurized cartridges each containing a particular sensory precursor substance, with the selectable sensory precursor sources 2500 being configured to dispense the corresponding sensory precursor substance, for instance, through a common injector member 2520. A particular sensory precursor source may be selected, for example, by way of a selector 2540 configured to release the corresponding sensory precursor substance from the corresponding pressurized sensory precursor source 2500 to be dispensed via the common injector member 2520.

Figure 26:
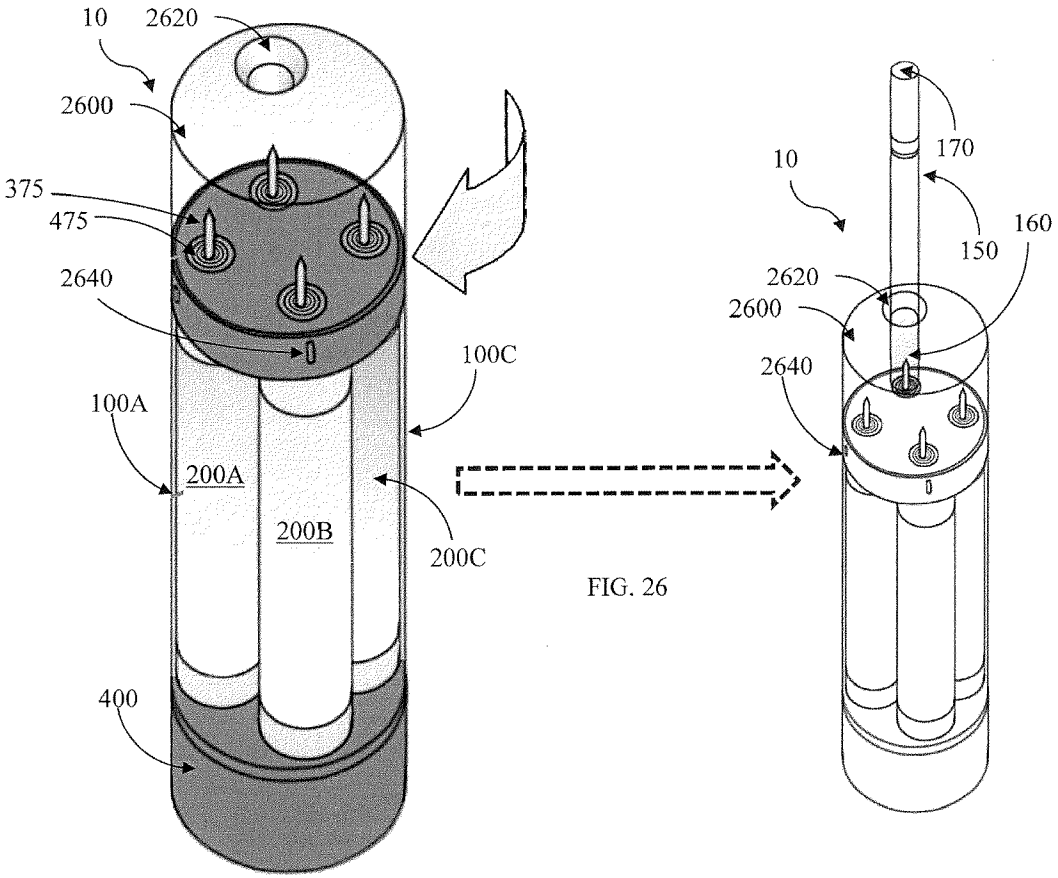

FIG. 26 schematically illustrates another arrangement aspect of an igniter apparatus 100, implementing selectable sensory precursor source configuration similar to the arrangement shown in FIGS. 24 and 25. In such instances, an igniter module 5 may comprise two or more igniter apparatuses (e.g., 100A, 100B, 100C) of the types otherwise disclosed herein. Each igniter apparatus 100A, 100B, 100C, may include a corresponding sensory precursor source (e.g., 200A, 200B, 200C), as well as a corresponding heat-emitting element 375 and sensory precursor-emitting element 475. The sensory precursor sources can be, though are not necessarily, the same. Similarly, the corresponding sensory precursor substances 450, heat-emitting elements 375 and sensory precursor-emitting elements 475 can each be, though are not necessarily, the same. In some instances, the sensory precursor sources 200A, 200B, 200C can comprise replaceable/disposable cartridges. The heat precursor source(s) 400 can be, though are not necessarily, the same. In some instances, the heat-emitting elements 375 can share a single heat precursor source 400. If implemented, the sensory precursor sources 200A, 200B, 200C, can share a single pump or have individual pumps associated therewith. In the example arrangement shown, the igniter arrangements (e.g., 100A, 100B, 100C) can be arranged adjacent to each other in the igniter module 5, and the heat-emitting elements 375 and sensory precursor-emitting elements 475 can be covered with a single access housing 2600 defining an access port 2620 configured to receive the lighting end 160 of the smoking article 150. In some instances, the interface between the access housing 2600 and the igniter module 5 may include one or more alignment aides 2640 for facilitating alignment of the access port 2620 with the heat-emitting element 375 and sensory precursor-emitting element 475 of each of the available igniter apparatuses. The access housing 2600 may be, for example, arranged to rotate the access port 2620 about a central axis wherein the alignment aides 2640 may provide a positive indicia of alignment with one of the igniter apparatuses (i.e., a "click" sound, a detent engagement, or opening of the access port 2620 only when aligned with one of the igniter apparatuses).

Figure 27:
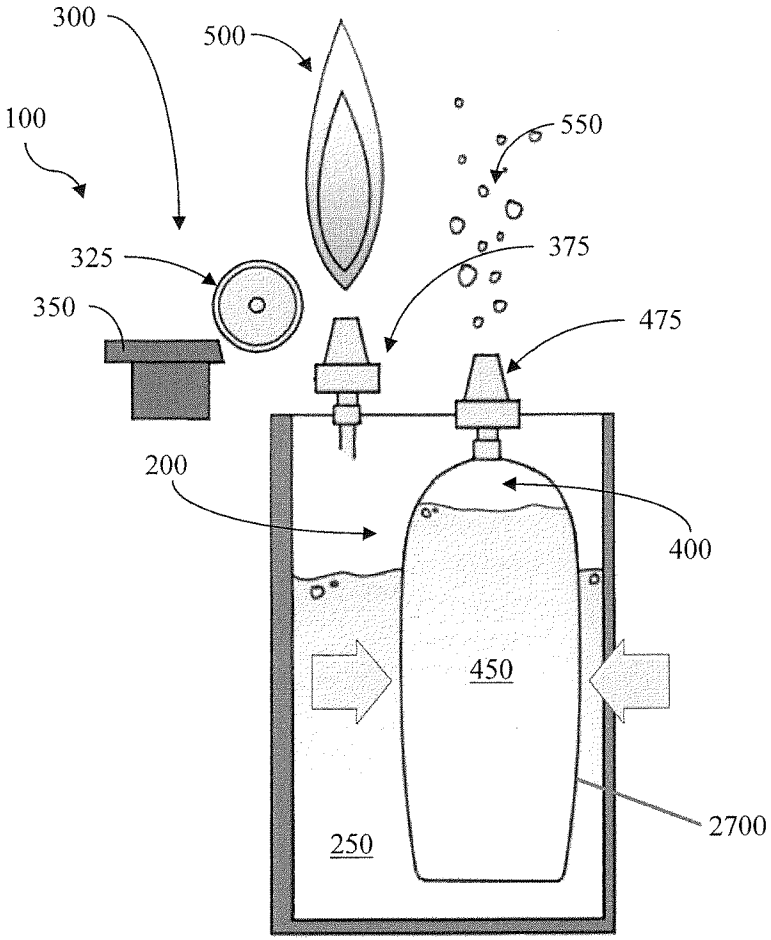

FIG. 27 schematically illustrates another arrangement aspect of an igniter apparatus 100 similar to the arrangement shown in FIG. 3. In such instances, the sensory precursor source 400 may comprise, for example, a flexible pouch or bladder 2700 disposed within the heat precursor substance 250 (i.e., butane) in the heat precursor source 200. That is, in one example, the sensory precursor source 400 may be a flexible (i.e., rubber) pouch or bladder 2700 disposed within the butane in the fuel reservoir comprising the heat precursor source 200. In such instances, an increase in pressure of the butane upon vaporization (i.e., actuating the heat-emitting element 375 to produce the heat/flame) may, in turn, exert an increased pressure on the flexible pouch/bladder 2700 and cause the emission of the sensory precursor substance 450 via the sensory precursor-emitting element 475 (configured, for example, as a pressure release valve). In other instances, the sensory precursor-emitting element 475 may be actuated by the actuator 350 in conjunction with actuation of the heat-emitting element 375 by the actuator 350, as disclosed in relation to FIG. 3.

Figure 28:
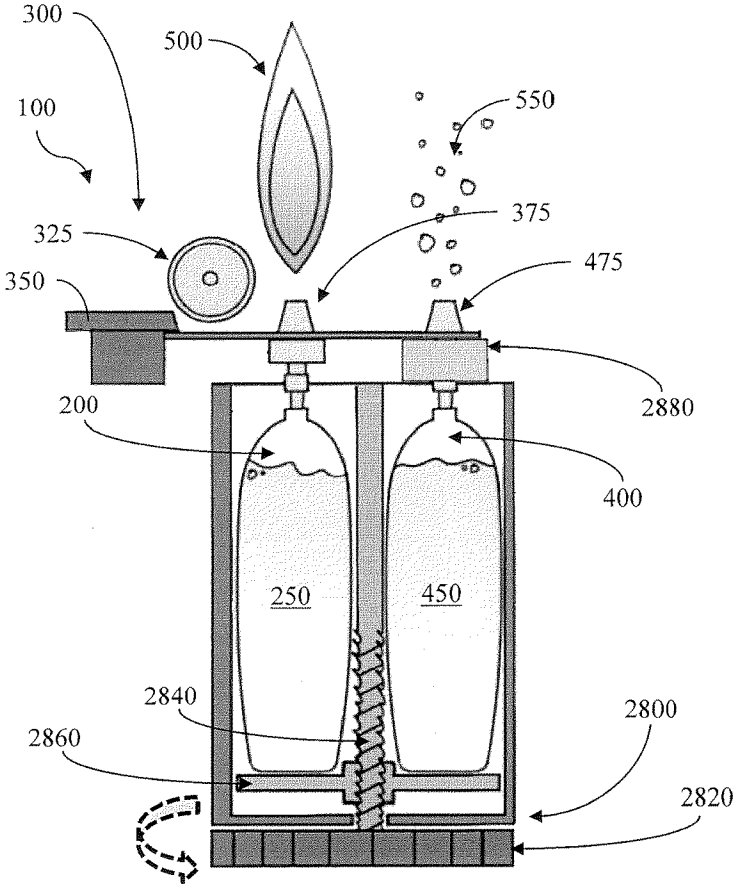

FIG. 28 schematically illustrates another arrangement aspect of an igniter apparatus 100 similar to the arrangement shown in FIG. 3. In such instances, either or both of the heat precursor source 200 and the sensory precursor source 400 may comprise, for example, a flexible pouch or bladder, and a mechanically-actuated pressure mechanism 2800 may be provided to pressurize the heat precursor substance 250 and/or the sensory precursor substance 450 within the corresponding heat precursor source 200/sensory precursor source 400. That is, in one example, a manually-actuated rotary knob 2820 may be engaged with a threaded rod 2840. A compression member 2860 may be engaged with the threaded rod 2840, wherein the compression member 2860 is constrained from rotating with the threaded rod 2840. Accordingly, rotation of the rotary knob 2820 by the user, in turn, causes the threaded rod 2840 to rotate. The threaded engagement between the threaded rod 2840 and the compression member 2860 thereby causes the compression member 2860 to travel in a direction parallel to the axis of the threaded rod 2840, depending on the direction in which the rotary knob 2820 is rotated. The pressure mechanism 2800 may thus be configured such that rotation of the rotary knob 2820 moves the compression member 2860 in a particular direction so as to compress or otherwise impart pressure to either or both of the heat precursor source 200 and the sensory precursor source 400. In such a manner, either or both of the heat precursor source 200 and the sensory precursor source 400 may be manually pressurized for emitting the heat precursor substance 250 and/or the sensory precursor substance 450 upon actuation of the actuator 350. In some particular instances, a dosing chamber 2880 may be implemented in association with the sensory precursor source 400/sensory precursor-emitting element 475, in order for a pre-selected dosage of the sensory precursor substance 450 to be emitted upon actuation thereof, as predetermined or otherwise selected.

Figure 29:
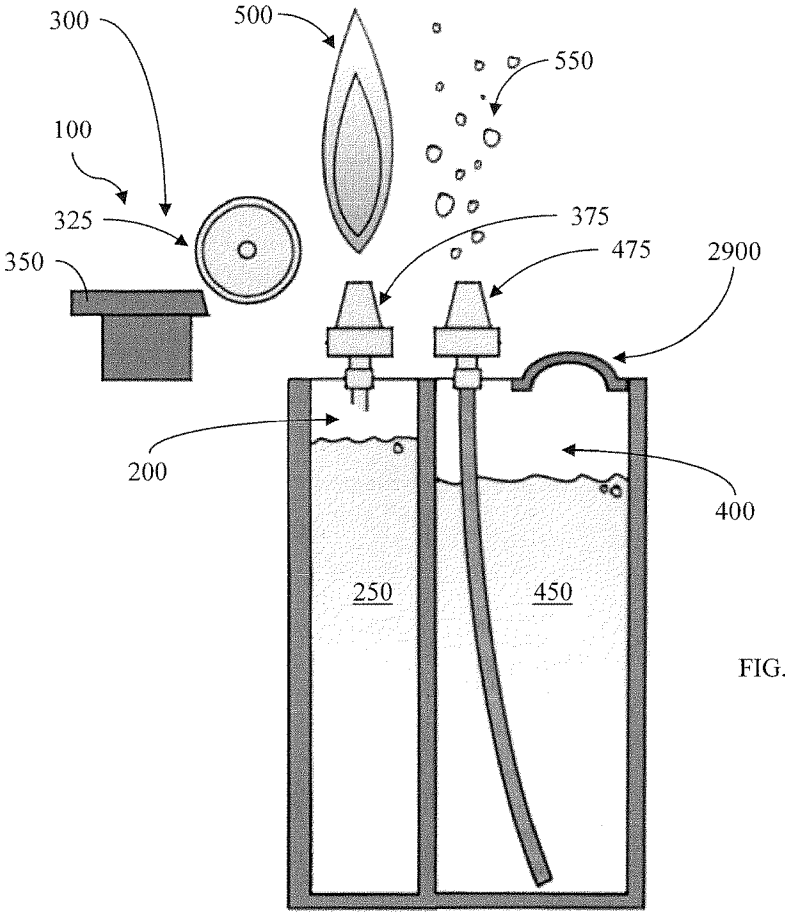

FIG. 29 schematically illustrates another arrangement aspect of an igniter apparatus 100 similar to the arrangement shown in FIG. 28. In such instances, pressurization of at least the sensory precursor source 400 may be accomplished in a different manner. For example, a manually-actuated pump diaphragm or pump membrane 2900 may be engaged with the sensory precursor source 400 such that manual actuation thereof by the user introduces air into the sensory precursor source 400 to pressurize the sensory precursor substance 450 therein (i.e., deforming or pumping the "bulb" forces air into the sensory precursor source 400 and increases the pressure therein). The sensory precursor-emitting element 475 may thus be actuated by the actuator 350 in conjunction with actuation of the heat-emitting element 375 by the actuator 350, as disclosed in relation to FIG. 3, such that both the sensory precursor substance 450 and the heat precursor substance 250 are both emitted, with at least the sensory precursor substance 450 being emitted in association with the pressure imparted to the sensory precursor source 400 by the pump membrane 2900.

Figure 30:
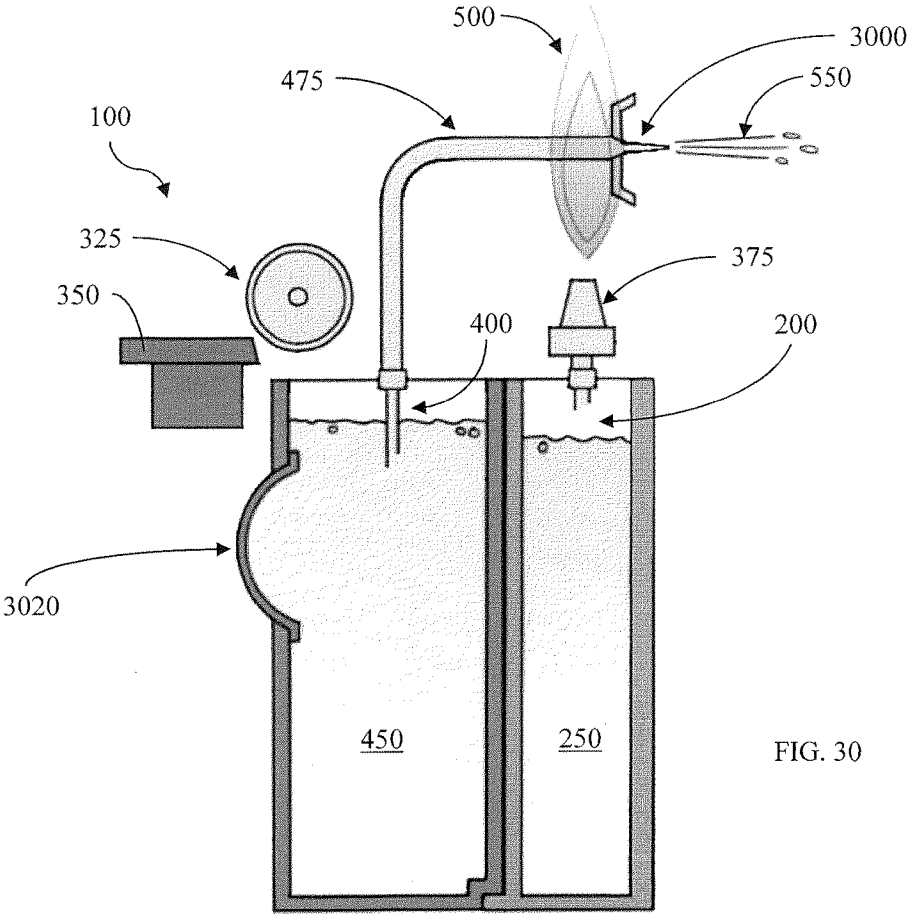

FIG. 30 schematically illustrates another arrangement aspect of an igniter apparatus 100 similar to the arrangement shown in FIGS. 22 and 29. In such instances, particularly where an injector member 3000 is implemented to directly inject or introduce the sensory precursor substance 450 into the smoking article 150 via the lighting end 160 thereof as shown, for example, in relation to FIG. 22, the manually-actuated pump diaphragm or pump membrane 3020 as shown, for example, in FIG. 29, may also be implemented with respect to the sensory precursor source 400. In such instances, the dosage of the sensory precursor substance 450 emitted into the smoking article 150 may be directly proportional to the number of manual actuations of the pump membrane 3020 (i.e., the greater the number of pumps or actuations of the pump membrane 3020, the greater the amount of the sensory precursor substance 450 emitted via the injector member 3000 into the smoking article 150.

In another example aspect, as shown in FIG. 31, an igniter apparatus 100 can be arranged similarly to the arrangement shown in FIG. 19. In such an arrangement, the sensory precursor source 400 may be configured as or may include a ring, snap clip, or other (removable) mechanical securement arrangement 3100 that may be engaged with and secured to a conventional cigarette lighter in a desired position and in an unobtrusive manner. In instances where the sensory precursor substance 450 is a liquid, aerosol, etc., the sensory precursor source 400 may further include a wicking member 3120 configured to wick the sensory precursor substance 450 from the sensory precursor source 400 via the sensory-precursor-emitting element 475. The wicking member 3120 may be further configured to extend into proximity with the heat-emitting element 375 of the cigarette lighter. The sensory precursor source 400 may be formed, for example, as a "C" shaped housing or other suitable contour for extending at least partially in proximity to the heat-emitting element 375 of the cigarette lighter, while including a suitable reservoir for containing the sensory precursor substance 450 in liquid form. The sensory-precursor-emitting element 475 may particularly be configured and arranged with respect to the sensory precursor source 400 so as to be disposed in proximity to the heat-emitting element 375. In this manner, the wicking member 3120 may be continually wetted with the sensory precursor substance 450 and arranged to be in interaction with the heat/flame from the heat-emitting element 375 upon actuation thereof. The lighting end 160 of the smoking article 150 may thus be ignited via actuation of the heat-emitting element 375, and the emitted sensory precursor substance brought into engagement therewith in conjunction with such actuation of the heat-emitting element 375, as previously disclosed in regard to other aspects herein. One skilled in the art will further appreciate that, in some instances, the igniter apparatus 100 may also implement a wicking member or other wicking arrangement involving the delivery of the heat precursor substance 250 to the heat-emitting element 375 (i.e., to form a "dual wick" igniter apparatus), in addition to other aspects of delivering the heat precursor substance 250 from the heat precursor source 200 to the heat-emitting arrangement, as otherwise disclosed herein. In some instances, the "dual wicks" may be combined upon extending from the heat precursor source 200 and the sensory precursor source 400 so as to provide, for example, a "dual reservoir, single wick" configuration. In addition, the wicking member(s) may be configured to as to be flammable or non-flammable, as necessary or desired. The wicking member(s) as implemented in such exemplary aspects may be of the type(s) used for conventional heat-emitting elements of certain types of lighters disclosed herein and, in particular instances, the implemented wicking member 3120 may correspond to a commercially available replacement wick for those certain types of lighters.

In still another example aspect, as shown in FIG. 32, an igniter apparatus 100 can be arranged similarly to the arrangement shown in FIG. 21. In such instances, the actuator 350/igniter arrangement 325 may also be configured to actuate a heating element 3200 disposed and arranged to interact with the sensory precursor substance 450 (i.e., a resistive heating coil disposed within the sensory precursor source 400 so as to directly interact with the sensory precursor substance 450). The heating element 3200 may thus, on demand, vaporize at least a portion of the sensory precursor substance 450, and direct the vaporized sensory precursor substance 3220 toward the sensory precursor-emitting element 475, such that the vaporized sensory precursor substance 450 is delivered directly into the lighting end 160 of the smoking article 150. In such instances, similarly to the operation and function of an electronic cigarette ("e-cigarette"), the delivery of the vaporized sensory precursor substance 450 in conjunction with the user draw (i.e., suction) through the smoking article may combine to produce and deliver the perceptible sensory effect to the user.

In other instances, as shown, for example, in FIG. 33, the sensory precursor substance 450 may comprise a consumable strip configured to be dispensed from a sensory precursor source 400 comprising a suitable dispenser, as will be appreciated by one skilled in the art. The consumable strip may be further configured to adhere, for example, to the tobacco rod portion of a smoking article (i.e., cigarette) 150, by way of, for instance, a suitable adhesive. In some instances, such as adhesive is preferably heat-resistant. Once the consumable strip is attached/adhered to the tobacco rod portion of the smoking article 150 (generally toward the lighting end 160), the smoking article 150 may be ignited and consumed by the user. In doing so, combustion of the tobacco rod portion will eventually extend to the portion having the strip adhered thereto, and further consumption of the smoking article 150 will cause the strip to interact with the heat/combustion of the tobacco rod portion and thereby cause consumption of the strip. The strip may further be responsive to the heat and/or combustion/consumption thereof to produce the perceptible sensory effect, which may then be drawn into and through the smoking article in response to the suction imparted to the mouth end 170 by the user.

In light of possible interrelationships between aspects of the present disclosure in providing the noted benefits and advantages associated therewith, the present disclosure thus particularly and explicitly includes, without limitation, embodiments representing various combinations of the disclosed aspects. Thus, the present disclosure includes any combination of two, three, four, or more features or elements set forth in this disclosure, regardless of whether such features or elements are expressly combined or otherwise recited in a specific embodiment description herein. This disclosure is intended to be read holistically such that any separable features or elements of the disclosure, in any of its aspects and embodiments, should be viewed as intended, namely to be combinable, unless the context of the disclosure clearly dictates otherwise.

Aerosols that are produced by cigarettes of the present disclosure are those that comprise air-containing components such as vapors, gases, suspended particulates, and the like. Aerosol components can be generated from burning tobacco of some form (and optionally other components that are burned to generate heat); by thermally decomposing tobacco caused by heating tobacco and charring tobacco (or otherwise causing tobacco to undergo some form of smolder); and by vaporizing aerosol-forming agent. As such, the aerosol can contain volatilized components, combustion products (e.g., carbon dioxide and water), incomplete combustion products, and products of pyrolysis.

Aerosol components may also be generated by the action of heat from burning tobacco of some form (and optionally other components that are burned to generate heat), upon substances that are located in a heat exchange relationship with tobacco material that is burned and other components that are burned. Aerosol components may also be generated by the aerosol-generation system as a result of the action of the heat generation segment upon an aerosol-generating segment. In some embodiments, components of the aerosol-generating segment have an overall composition, and are positioned within the smoking article, such that those components will have a tendency not to undergo a significant degree of thermal decomposition (e.g., as a result of combustion, smoldering or pyrolysis) during conditions of normal use.

In one exemplary aspect of the present invention, a cigarette lighter available under the tradename 207 Regular Street Chrome from Zippo Manufacturing Company is provided, for instance, as the igniter apparatus. Essentially pure spearmint oil (i.e., the sensory precursor substance) is provided, and that spearmint oil is dissolved in a lighter fluid commercially available as Zippo Premium Lighter Fluid from Zippo Manufacturing Company (i.e., the heat precursor substance). In particular, about 15 weight parts spearmint oil is dissolved in about 85 weight parts lighter fluid. The resulting lighter fluid mixture is loaded into the empty cigarette lighter, so as to provide the lighter fluid for that lighter. The cigarette lighter then is used in a conventional way to light a commercially available, tobacco burning cigarette (e.g., a filtered cigarette marketed under the brandname Camel by R. J. Reynolds Tobacco Company as the ignitable article). Upon draw during the lighting puff, the drawn cigarette tobacco smoke possesses the aroma and flavor of spearmint. That is, the spearmint flavor incorporated within the cigarette lighter (i.e., spearmint flavor exogenous to the cigarette) is transferred to the cigarette (and is drawn into the cigarette). Additionally, the aroma and flavor of spearmint is perceived as being present in drawn smoke on later puffs of that cigarette, after the lighting puff. Typically, the amount of spearmint oil that is employed relative to the lighter fluid is at least about 5 weight parts, often at least about 10 weight parts spearmint oil (and less than about 95 weight parts, often less than about 90 weight parts lighter fluid); while the upper level of spearmint oil relative to the lighter fluid is about 25 weight parts, often at least about 20 weight parts spearmint oil (and at least about 75 weight parts, often at least about 80 weight parts lighter fluid). In such mixtures with the lighter fluid, different flavors may be provided in different amounts to obtain the desired efficacy. For example, such mixtures with the lighter fluid could involve menthol of between about 5 weight parts and about 75 weight parts with respect to the lighter fluid, or peppermint of between about 10 weight parts and about 30 weight parts with respect to the lighter fluid.

In another exemplary aspect of the present invention, a cigarette lighter available under the tradename 207 Regular Street Chrome from Zippo Manufacturing Company is provided. Essentially pure spearmint oil is provided, and that spearmint oil is dissolved in a lighter fluid that is 190 proof ethanol (USP). In particular, about 15 weight parts spearmint oil is dissolved in about 85 weight parts lighter fluid. The resulting lighter fluid mixture is loaded into the empty cigarette lighter, so as to provide the lighter fluid for that lighter. The cigarette lighter then is used in a conventional way to light a commercially available, tobacco burning cigarette (e.g., a filtered cigarette marketed under the brandname Camel by R. J. Reynolds Tobacco Company. Upon draw during the lighting puff, the drawn cigarette tobacco smoke possesses the aroma and flavor of spearmint. That is, the spearmint flavor incorporated within the cigarette lighter (i.e., spearmint flavor exogenous to the cigarette) is transferred to the cigarette (and is drawn into the cigarette). Additionally, the aroma and flavor of spearmint is perceived as being present in drawn smoke on later puffs of that cigarette, after the lighting puff. Typically, the amount of spearmint oil that is employed relative to the lighter fluid is at least about 5 weight parts, often at least about 10 weight parts spearmint oil (and less than about 95 weight parts, often less than about 90 weight parts lighter fluid); while the upper level of spearmint oil relative to the lighter fluid is about 25 weight parts, often at least about 20 weight parts spearmint oil (and at least about 75 weight parts, often at least about 80 weight parts lighter fluid). In such mixtures with the ethanol (USP) lighter fluid, different flavors may be provided in different amounts to obtain the desired efficacy, wherein such flavors may be provided, for example, by aromatic compounds such as pyrazines, vanillin, menthol, and/or essential oils such as spearmint oil or peppermint oil. For example, such mixtures with the lighter fluid could involve a berry note substance of between about 5 weight parts and about 15 weight parts with respect to the ethanol-based lighter fluid, or brown note (i.e., pyrazines and/or other flavors characteristic of tobacco) of between about 5 weight parts and about 15 weight parts with respect to the lighter fluid.

In another exemplary aspect of the present invention, a cigarette lighter generally of the type described with reference to FIGS. 19 and 31 is provided. Essentially pure menthol crystals (solids) are provided, and that those crystals are dissolved in propylene glycol. In particular, about 75 weight parts menthol crystals are dissolved in about 25 weight parts propylene glycol, to form a liquid solution. The resulting flavored, fluid mixture (i.e., the sensory precursor substance) is loaded into the appropriate additional compartment of the cigarette lighter. The cigarette lighter then is used in a conventional way to light a commercially available, tobacco burning cigarette (e.g., a filtered cigarette marketed under the brandname Camel by R. J. Reynolds Tobacco Company). Upon draw during the lighting puff, the drawn cigarette tobacco smoke possesses the aroma and flavor of menthol that is provided from the additional compartment (i.e., the sensory precursor source) of the cigarette lighter. That is, the menthol flavor incorporated within the cigarette lighter (i.e., menthol exogenous to the cigarette) is transferred to the cigarette (and is drawn into the cigarette). Additionally, the aroma and flavor of menthol is perceived as being present in drawn smoke on later puffs of that cigarette, after the lighting puff. Typically, the amount of menthol that is employed relative to the propylene glycol is at least about 50 weight parts, often at least about 70 weight parts menthol (and less than about 50 weight parts, often less than about 30 weight parts propylene glycol).

In another exemplary aspect of the present invention, a cigarette lighter generally of the type described with reference to FIGS. 19 and 31 is provided. Essentially pure peppermint oil is provided, and that oil is dissolved in vegetable oil (e.g., a mixture of medium chain triglycerides). In particular, about 75 weight parts peppermint oil is dissolved in about 25 weight parts vegetable oil, to form a liquid solution. The resulting flavored, fluid mixture is loaded into the appropriate additional compartment of the cigarette lighter. The cigarette lighter then is used in a conventional way to light a commercially available, tobacco burning cigarette (e.g., a filtered cigarette marketed under the brandname Camel by R. J. Reynolds Tobacco Company). Upon draw during the lighting puff, the drawn cigarette tobacco smoke possesses the aroma and flavor of peppermint that is provided from the additional compartment of the cigarette lighter. That is, the peppermint flavor incorporated within the cigarette lighter (i.e., peppermint exogenous to the cigarette) is transferred to the cigarette (and is drawn into the cigarette). Additionally, the aroma and flavor of peppermint is perceived as being present in drawn smoke on later puffs of that cigarette, after the lighting puff. Typically, the amount of peppermint oil that is employed relative to the vegetable oil is at least about 50 weight parts, often at least about 70 weight parts peppermint (and less than about 50 weight parts, often less than about 30 weight parts vegetable oil).

In another exemplary aspect of the present invention, a cigarette lighter generally of the type described with reference to FIGS. 19 and 31 is provided. Essentially pure vanillin (which may be in solid form) is provided, and is dissolved in ethanol. In particular, about 25 weight parts vanillin is dissolved in about 75 weight parts ethanol, to foul' a liquid solution. The resulting flavored, fluid mixture is loaded into the appropriate additional compartment of the cigarette lighter. The cigarette lighter then is used in a conventional way to light a commercially available, tobacco burning cigarette (e.g., a filtered cigarette marketed under the brandname Camel by R. J. Reynolds Tobacco Company). Upon draw during the lighting puff, the drawn cigarette tobacco smoke possesses an enhanced aroma and flavor of vanillin, and that enhanced flavor and aroma is provided from the additional compartment of the cigarette lighter. That is, the vanillin incorporated within the cigarette lighter (i.e., vanillin exogenous to the cigarette) is transferred to the cigarette (and is drawn into the cigarette). Additionally, the enhanced aroma and flavor of vanillin is perceived as being present in drawn smoke on later puffs of that cigarette, after the lighting puff.

Many modifications and other aspects of the disclosures set forth herein will come to mind to one skilled in the art to which these disclosures pertain having the benefit of the teachings presented in the foregoing descriptions and the associated drawings. For example, those of skill in the art will appreciate that embodiments not expressly illustrated herein may be practiced within the scope of the present disclosure, including that features described herein for different embodiments may be combined with each other and/or with currently-known or future-developed technologies while remaining within the scope of the claims presented here. In one particular example, one skilled in the art will appreciate that, in some instances, the various sensory precursor source 400/sensory precursor substance 450 arrangements disclosed herein may be configured as discrete components or assemblies that may be retrofitted or otherwise configured as an optional accessory for an igniter apparatus 100, such as a conventional cigarette lighter, of the types also disclosed herein. One skilled in the art will also appreciate that the various sensory precursor source 400/ sensory precursor substance 450 arrangements disclosed herein may be discrete components or assemblies that may be configured to receive an igniter apparatus 100, such as a conventional cigarette lighter, of the types also disclosed herein. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. An igniter apparatus, comprising:

a heat precursor source having a heat precursor;

a heating arrangement configured to, on demand, receive the heat precursor from the heat precursor source and to emit heat associated with the heat precursor, the emitted heat being capable of igniting an ignitable article; and a sensory precursor source having a sensory precursor substance, the sensory precursor substance being configured to provide a perceptible sensory effect upon actuating with a catalyst disposed within the ignitable article, the sensory precursor source being in communication with the heating arrangement and being configured to dispense the sensory precursor substance;

wherein the heat precursor comprises an ignitable fuel, and the heating arrangement comprises an igniter arrangement configured to ignite the fuel from the heat precursor source to produce a flame having the heat associated therewith for igniting the ignitable article; and wherein the sensory precursor substance is configured to be dispensed separately from, and not to be actuated by, the flame or the heat associated with the ignited fuel.

2. The apparatus according to claim 1, wherein the heat precursor source and the sensory precursor source are discrete reservoirs, and the igniter arrangement includes discrete actuators in communication with the corresponding reservoir for dispensing each of the fuel and the sensory precursor substance from the respective reservoir.

3. The apparatus according to claim 1, wherein the fuel and the sensory precursor substance associated therewith are configured to interact with an ignitable article, and wherein the sensory precursor substance is configured to interact with an element of the ignitable article to form an aerosol.

4. The apparatus according to claim 1, wherein the sensory precursor substance is configured to provide one of a flavor and an aroma as the perceptible sensory effect.

5. The apparatus according to claim 1, wherein the heat precursor source comprises a catalyst source having a catalyst, and the heating arrangement comprises a heating membrane configured to react with the catalyst received from the catalyst source to produce the heat for igniting the ignitable article.

6. The apparatus according to claim 1, further comprising a catalyst source having a catalyst, wherein the heating arrangement comprises a heating membrane configured to react the fuel received from the heat precursor source with the catalyst received from the catalyst source to produce the heat for igniting the ignitable article.

7. The apparatus according to claim 1, wherein the sensory precursor substance is configured to be actuated by interacting with the catalyst and the heat generated by the ignitable article upon ignition thereof.

8. The apparatus according to claim 7, wherein the heating arrangement is configured to direct the sensory precursor substance into interaction with the ignitable article by a propellant force generated by the flame and the heat associated with the ignited fuel.

9. An ignition method, comprising:

providing, on demand, a heat precursor comprising a fuel from a heat precursor source;

emitting heat associated with the heat precursor from a heating arrangement that is capable of igniting an ignitable article, the heating arrangement comprising an igniter arrangement configured to receive the heat precursor from the heat precursor source and ignite the fuel from the heat precursor source to produce a flame having the heat associated therewith for igniting the ignitable article; and providing a perceptible sensory effect upon actuating with a catalyst disposed within the ignitable article, the perceptible sensory effect being associated with a sensory precursor substance from a sensory precursor source in communication with the heating arrangement, the heating arrangement being configured to dispense the sensory precursor substance separately from, and not to be actuated by, the flame or the heat associated with the ignited fuel.

10. The method according to claim 9, wherein the heat precursor source and the sensory precursor source are discrete reservoirs, and the igniter arrangement includes discrete actuators in communication with the corresponding reservoir, and the method further comprises dispensing each of the fuel and the sensory precursor substance from the respective reservoir by actuation of the corresponding actuator.

11. The method according to claim 9, wherein the heat and the sensory precursor substance associated therewith are configured to interact with an ignitable article, and wherein the method further comprises interacting the sensory precursor substance with an element of the ignitable article to form an aerosol.

12. The method according to claim 9, wherein providing the perceptible sensory effect further comprises providing one of a flavor and an aroma as the perceptible sensory effect.

13. The method according to claim 9, wherein the heat precursor source comprises a catalyst source having a catalyst, and the heating arrangement comprises a heating membrane, and wherein the method further comprises reacting the heating membrane with the catalyst received from the catalyst source to produce the heat for igniting the ignitable article.

14. The method according to claim 9, wherein the heating arrangement comprises a heating membrane, and wherein the method further comprises reacting the fuel received from the heat precursor source with a catalyst received from a catalyst source to produce the heat for igniting the ignitable article.

* * * * *